US007496988B2

(12) United States Patent
Takemoto et al.

(10) Patent No.: US 7,496,988 B2
(45) Date of Patent: Mar. 3, 2009

(54) ELECTRIC VACUUM CLEANER PROVIDED WITH A DUST SEPARATION SECTION FOR SEPARATING SUCKED DUST AND DUST COLLECTING SECTION FOR COLLECTING THE DUST

(75) Inventors: Ritsuo Takemoto, Hadano (JP); Masatoshi Tanaka, Ebina (JP); Hiroshi Yokoyama, Ohi-machi (JP); Hitoshi Suzuki, Yokohama (JP); Kiyoshi Ebe, Hiratsuka (JP); Yoshihiro Tsuchiya, Nagaizumi-machi (JP); Ai Tanaka, Hadano (JP); Yasushi Nakatogawa, Odawara (JP); Ikuo Oshima, Yokohama (JP); Yutaka Maeda, Hadano (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 762 days.

(21) Appl. No.: 10/504,629

(22) PCT Filed: Mar. 18, 2003

(86) PCT No.: PCT/JP03/03253

§ 371 (c)(1), (2), (4) Date: Aug. 13, 2004

(87) PCT Pub. No.: WO2004/028327

PCT Pub. Date: Apr. 8, 2004

(65) Prior Publication Data

US 2005/0150075 A1 Jul. 14, 2005

(30) Foreign Application Priority Data

| | | |
|---|---|---|
| Sep. 25, 2002 | (JP) | 2002-279381 |
| Sep. 25, 2002 | (JP) | 2002-279617 |
| Oct. 31, 2002 | (JP) | 2002-317590 |
| Oct. 31, 2002 | (JP) | 2002-317920 |
| Oct. 31, 2002 | (JP) | 2002-318213 |
| Nov. 22, 2002 | (JP) | 2002-339411 |
| Nov. 29, 2002 | (JP) | 2002-346905 |

(51) Int. Cl.
*A47L 9/10* (2006.01)

(52) U.S. Cl. ..... 15/347; 15/327.7

(58) Field of Classification Search ..... 15/327.7, 15/347, 352, 353; 55/DIG. 3, 462, 465, 309, 55/327, 392, 394, 467
See application file for complete search history.

(56) References Cited

U.S. PATENT DOCUMENTS

| | | | | |
|---|---|---|---|---|
| 2,400,217 | A * | 5/1946 | White | 15/352 |
| 3,877,902 | A * | 4/1975 | Eriksson et al. | 55/DIG. 3 |
| 4,172,710 | A * | 10/1979 | van der Molen | 15/353 |
| RE33,074 | E * | 10/1989 | Levine | 15/353 |
| 6,154,917 | A * | 12/2000 | Zahuranec et al. | 15/353 |
| 6,524,358 | B2 * | 2/2003 | Yang | 15/353 |
| 6,589,309 | B2 * | 7/2003 | Oh et al. | 55/DIG. 3 |
| 6,640,385 | B2 * | 11/2003 | Oh et al. | 15/352 |
| 6,840,972 | B1 * | 1/2005 | Kim | 55/DIG. 3 |
| 6,968,593 | B1 * | 11/2005 | Lenkiewicz et al. | 15/353 |
| 7,198,656 | B2 * | 4/2007 | Takemoto et al. | 15/352 |

FOREIGN PATENT DOCUMENTS

| | | | |
|---|---|---|---|
| JP | 41-018947 | | 9/1941 |
| JP | 50-020462 | | 3/1975 |
| JP | 52-099651 | | 8/1977 |
| JP | 54-12152 | | 1/1979 |
| JP | 61-22563 | B2 | 6/1986 |
| JP | 2-289214 | A | 11/1990 |
| JP | 6-41815 | U | 6/1994 |
| JP | 11-187987 | A | 7/1999 |
| JP | 2001-104223 | A | 4/2001 |
| WO | WO 2004/039232 | A1 | 5/2004 |

* cited by examiner

*Primary Examiner*—David B Thomas
(74) *Attorney, Agent, or Firm*—Frishauf, Holtz, Goodman & Chick, P.C.

(57) ABSTRACT

A dust separation section is provided at a suction air passage between a suction opening of a vacuum cleaner main body and an intake opening of a motor fan to separate dust sucked from the suction opening with air and a dust collection section provided at the suction air passage for collecting the dust separated from the air from the dust separation section. Moreover, the dust separation section of the electric vacuum cleaner has a dust guiding space adapted to inflow the dust sucked from the suction opening from one end of the dust guiding space and for guiding the dust from an other end of the dust guiding space to the dust collection section, through a dust strike section, by an inertia force, and an air guiding air passage is provided to guide air from a midstream of the dust guiding space to the intake opening of the motor fan without passing through the dust collection section.

13 Claims, 33 Drawing Sheets

ELECTRIC VACUUM CLEANER PROVIDED WITH A DUST SEPARATION SECTION FOR SEPARATING SUCKED DUST AND DUST COLLECTING SECTION FOR COLLECTING THE DUST

This application is a U.S. National Phase Application under 35 USC 371 of International Application PCT/JP2003/003253 filed Mar. 18, 2003.

TECHNICAL FIELD

The present invention relates to an electric vacuum cleaner provided with a dust separation section for separating sucked dust and a dust collection section for collecting the dust.

BACKGROUND ART

Heretofore, there have been known an electric vacuum cleaner provided with a cyclone system as shown in FIG. 34 (for example, see Japanese Patent Laid Open No. 2001-104223).

The electric vacuum cleaner is provided with a dust cup 1 whose upper part is opened and a motor fan 2 for causing inside of the dust cup 1 to be negatively pressured or the like. An intake vent 3 is formed at a peripheral wall 1A of the dust cup 1 and the intake vent 3 is communicated with a suction opening body 4 for sucking a dust through an intake passage 5.

The dust sucked from the suction opening body 4 is sucked inside of the dust cup 1 from the intake vent 3 of the dust cup 1 through the intake passage 5. A spiral flow is generated inside of the dust cup 1, thereby the dust and air are separated, and only the air is sucked from the upper part opening of the dust cup 1 by the motor fan 2 and is exhausted outside.

By the way, in such electric vacuum cleaner, the air sucked upwardly toward the intake passage 5 changes direction at 90 degrees and enters inside of the dust cup 1 from the intake vent 3, and at this point, the air is turned into the spiral flow and adapted to be revolved along the peripheral wall 1A of the dust cup 1 and then only the air is sucked upwardly toward the motor fan 2. Like so, because the direction of the air is changed twice, its loss of air passage is large (i.e., loss in an amount of air passing through is large), and furthermore, because the air is sucked to the motor fan 2 after revolving inside of the dust cup 1, its loss of air passage becomes exceedingly large, causing a problem that a performance of the motor fan deteriorates.

Additionally, there have been also known such a conventional electric vacuum cleaner that allows the dust which is sucked inside of a dust collection case to be separated by hitting the dust to a hyperbolic wall section as disclosed in Japanese Patent Publication No. 61-22563 for example.

In this electric vacuum cleaner, there is provided a cylindrical dust collection case that extends toward upward and downward direction, and a main body case which is loaded on a top edge of the dust collection case. Inside of the main body, the motor fan is built-in for causing a sucking-negative pressure to operate in the dust collection case.

Furthermore, in a bottom of the dust collection case, a longitudinal wall is provided which projects upwardly from a part proximity to an edge of a bottom wall. At a center of the longitudinal wall, there is formed a helical groove disengaging in an upward direction. Also, at the longitudinal wall, a partition wall is continuously built to divide inside of the dust collection case into lower side's first dust collection room and upper side's second dust collection room by marking off inside of the dust collection case into an upper part and a lower part.

The partition wall has a bottom plate whose edge has a U-shape and is also provided with a projecting portion that engages to a lower end of the helical groove of the longitudinal wall, an internal side wall which is continuously built to both sides edge of the helical groove respectively and is also built projective toward an upward direction at a part proximity to side edge in a U-shape along the side edge of the bottom plate, and a hyperbolic external side wall which is formed with a hyperbolic shape at an edge of the bottom plate corresponding to the U-shaped part of the internal wall and is also positioned opposite to the longitudinal wall. Further, at the hyperbolic part of the internal side wall, there is formed an opening, and between the internal side wall and the hyperbolic external side wall, there is formed a hyperbolic air passage.

Also, a ventilation opening is formed between the hyperbolic external wall and the longitudinal wall, and a mesh shaped filter is loaded to the ventilation opening. In addition, the hyperbolic external side wall is provided as a primary filter at the opposite side of the side wall's longitudinal wall in such a manner as to extend in upward and downward direction and roughly concentric to the dust collection case, and a hose opening is provided at the dust collection case facing the hyperbolic external side wall. Moreover, in this electric vacuum cleaner, an upper end of the dust collection case is closed with a filter holding plate, and at the filter holding plate, there is formed a tube section connected to an upper part of a hyperbolic internal side wall, and a main filter is loaded to a lower end of the tube section.

In such an electric vacuum cleaner as mentioned, when the motor fan is activated, the motor fan's sucking negative pressure acts upon the first dust collection room through the main filter, the second dust collection room and the mesh shaped filter, and the intake negative pressure that acts upon the first dust collection room acts upon the suction opening body which is not shown in the figure through dust collection hose and extension pipe for example that are connected to a hose connection opening.

By the aforementioned method, the dust sucked from the suction opening body is sucked to the first dust collection room with the air from the hose opening through the dust collection hose. And, some of the sucked dust and the air hit hyperbolic external side wall and then, flow along the hyperbolic external wall toward a side of the mesh shape filter. On this occasion, relatively heavy dust is adapted to be dropped and deposited on a bottom of a rough dust room, and remained dust's light cotton dust, for example, is captured by the mesh shaped filter when the air percolates the mesh shaped filter.

Furthermore, microscopic dust even smaller than the cotton dust passes through the mesh shaped filter together with the air. Such microscopic dust is captured through the main filter when the air passes through the main filter, and is deposited on a bottom of the second dust collection room.

But, in fact, because the air that hits the hyperbolic external side wall flows toward the side of the mesh shaped filter along the hyperbolic external side wall, the dust flows toward the side of the mesh shape filter along the hyperbolic external side wall together with the air.

In addition, relatively large and heavy dust is adapted to be deposited at a lower part of the mesh shape filter. Consequently, if an amount of dust deposited increases, then the amount of deposited dust increases at the side of the mesh shaped filter before the dust is captured in entire rough dust room, causing a tendency that the filter clogs at an early stage.

Also, because some of the air hits the hyperbolic external wall flows to the lower part along the hyperbolic external wall, the dust that hits the hyperbolic wall and drops to the lower part flows to the side of the longitudinal wall together with the air that flows to the lower part, causing some of the dust deposited on the side of the longitudinal wall to fly up, so there is a tendency that the dust flew up attaches to the mesh shaped filter and the mesh shaped filter clogs at an early stage.

The reason that these phenomena occurs is because all the air that are sucked from the hose connection opening are adapted to flow only to the first dust collection room which is to capture the dust, then adapted to flow to side of the second dust collection room through the ventilation openings' mesh shape filter which opens at the first collection room.

In addition, there is also a conventional electric vacuum cleaner in a type that loads a paper package as a paper filter at the dust collection room. In this common electric vacuum cleaner, since the intake vent, the paper package and the motor fan are arranged linearly, the loss of air passage is relatively small. However, in such common electric vacuum cleaner there is a problem that an amount of air decreases significantly once the dust accumulates in the paper package.

It is an object of the invention to provide an electric vacuum cleaner which is capable of reducing the loss of air passage, and furthermore, in which the amount of air does not decrease at the early stage even if the dust accumulates.

DISCLOSURE OF INVENTION

An electric vacuum cleaner of the present invention has a dust separation section provided at a suction air passage which is leading from a suction opening of a vacuum cleaner main body to an intake opening of a motor fan to separate dust sucked from the suction opening with air and a dust collection section provided at the suction air passage for collecting the dust separated from the air at the dust separation section.

In addition, the dust separation section has a dust guiding space adapted to inflow the dust sucked from the suction opening from an one end and for guiding the dust which flows in from an other end to the dust collection section by an inertia force. Also, an air guiding air passage is provided in the electric vacuum cleaner of the present invention to be communicated with a midstream of the dust guiding duct and is communicated with the intake opening of the motor fan without passing through the dust collection section.

According to the structure mentioned above, since the dust sucked with the air goes straight by inertia and is collected, and the air is sucked by the motor fan through the opening, the air and the dust are separated without generating the spiral flow, therefore loss of air passage becomes less.

Additionally, the dust guiding space can be provided as a tubular passage which an one end communicates with the suction opening so that the dust sucked from the suction opening flows in and an other end communicates with the dust collection section. Moreover, it is possible to provide an air guiding opening provided at a peripheral wall of the tubular passage and communicate with the intake opening of the motor fan.

BRIEF DESCRIPTION OF DRAWINGS

FIG. 17(*b*) is a sectional view taken along an A-A line in FIG. 17(*a*).

BEST MODE FOR CARRYING OUT THE INVENTION

[Principle of the Invention]

Hereinafter embodiments of the present invention will be described with reference to the accompanying drawings.

First, a principle of the present invention will be described briefly with reference to FIG. 9.

Figure 9:
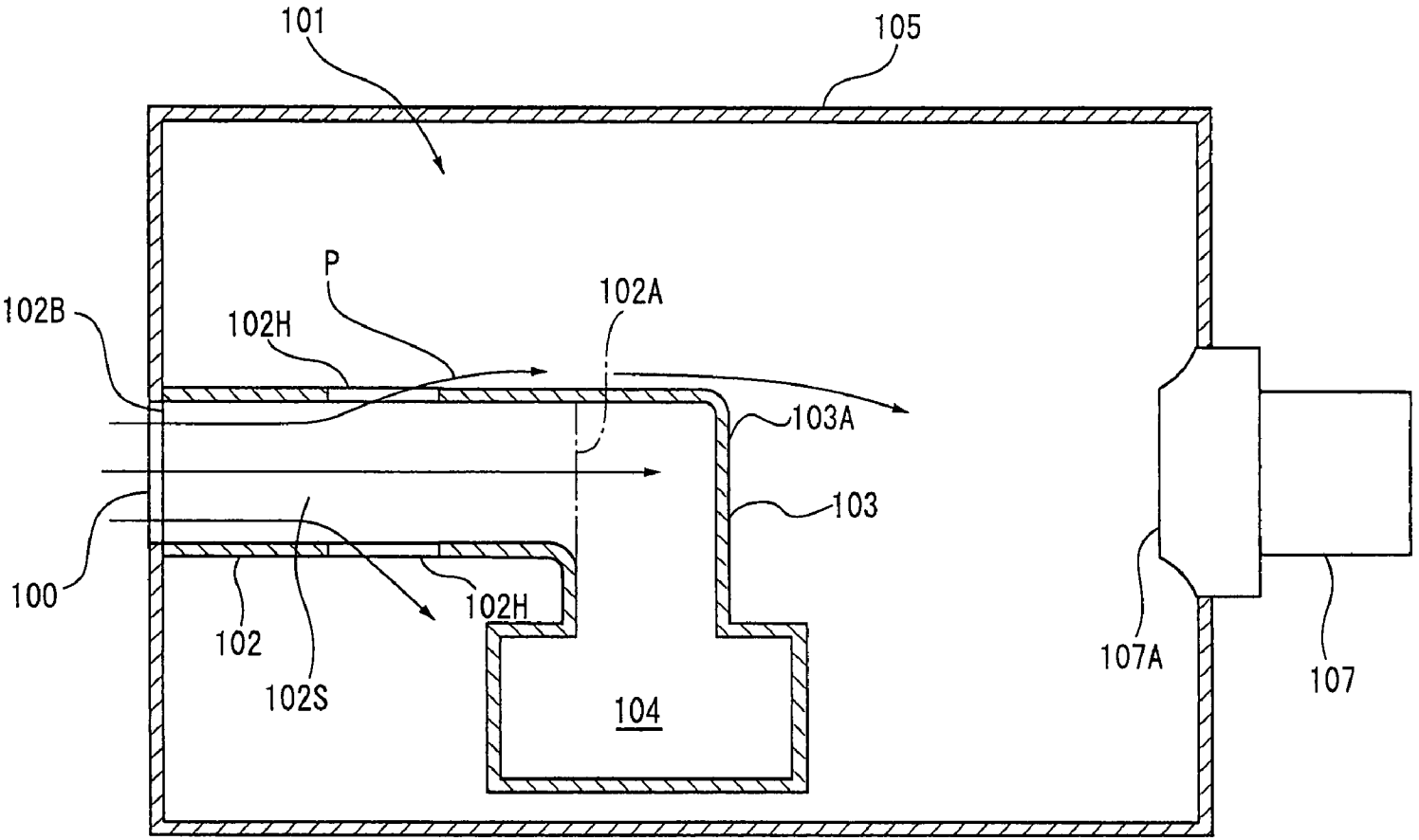
FIG. 9 is an explanatory view showing a principle of the present invention.

In FIG. 9, 100 is a suction opening (intake vent) for sucking dust in a vacuum cleaner main body. A dust separation section 101 is provided between the suction opening 100 and a motor fan 107. 107A is an intake opening of the motor fan.

The dust separation section 101 has a tube section 102 which is forming a tubular passage 102S that extends linearly and its cross-sectional area is constant, and a strike section 103 which is continuously built to an other side opening 102A of the tube section 102. The strike section 103 is communicated with the tube section 102 and is composed of a pipe section that protrudes to a lower direction.

103A is a wall of the strike section 103, and the wall 103A is adapted to be faced to the other side opening 102A. And substantially, the wall 103A is a dust strike section.

A dust collection room 104 is formed at a lower part of the strike section 103. The dust collection room 104 and the tube section 102 are communicated through the strike section 103 which is more specifically, the pipe section. Additionally, the suction opening 100, the tube section 102 and the motor fan 107 are arranged in alignment. Also, one end opening 102B of the tube section 102 is communicated with the suction opening 100.

A plurality of openings 102H are formed at a peripheral wall of the tube section 102. In addition, the dust separation section 101 is covered with a case 105. The motor fan 107 is loaded to the case 105, and the inside of the case 105 is adapted to be negatively pressured by the motor fan 107.

Once the inside of the case 105 becomes the negative pressure by an activation of the motor fan 107, the negative pressure acts upon the passage (tubular air passage) 102S which is in the tube section 102 through the openings 102H of the tube section 102, and the dust is sucked together with air from the suction opening 100. The air and the dust that are sucked from the suction opening 100 go straight through the passage 102S within the tube section 102, and the air is, on the way, sucked inside of the case 105 through the openings 102H. The sucked air is sucked from the intake opening 107A by the motor fan 107. Normally, a filter for capturing microscopic dust is arranged in front of the intake opening 107A.

On the other hand, the dust which has more weight than predetermined weight goes straight inside of the passage 102S of the tube section 102 by inertia without change, and after hitting the wall 103A of the strike section 103, falls to the dust collection room 104 through a pipe section which composes the strike section 103, and it becomes accumulated (deposited) at the dust collection room 104.

As mentioned above, because the dust and the air are separated in the passage 102S without generation of a spiral flow, a loss of air passage in the passage 102S becomes less. Furthermore, as the suction opening 100, the tube section 102 and the motor fan 107 are arranged in alignment, the air that is sucked to the opening 107A flows virtually linearly and sucked by the motor fan 107 without changing its direction of the airflow significantly as shown by an arrow P. Consequently, since an overall loss of air passage becomes even less (i.e., overall loss in an amount of air passing through is less), performance of the motor fan 107 is improved.

In this principle, although the plurality of openings 102H are provided at the pipe section 102, it may be also recommendable to provide a single opening 102H. In addition, the strike section 103 is not necessarily required to separate the dust from the air by an inertia force.

As described above, in this electric vacuum cleaner of the present invention of such principle, the dust separation section 101 is provided at a suction air passage leading from the suction opening 100 of the vacuum cleaner main body to the intake opening 107A of the motor fan 107 to separate the dust that sucked from the suction opening 100 with the air and the dust collection section (dust collection room 104) provided at the suction air passage for collecting the dust separated from the air at the dust separation section 101. In addition, the dust separation section 101 has the tubular passage (passage 102S) which communicates at one end with the suction opening 100 to flow the dust sucked from the suction opening 100 in the tubular passage and at the other end with the dust collection section (dust collection room 104) and the air guiding opening (102H) which is provided at the peripheral wall of the tubular passage (102S) and which is communicated with the intake opening 107A of the motor fan 107.

Generally in the conventional electric vacuum cleaner of the cyclone type, since the air is, after swirled, reversed, drifted and sucked, therefore the loss of air passage of the air is large. Also in the conventional electric vacuum cleaner with the paper package as the paper filter, when a predetermined amount of dust is accumulated in the paper package, the amount of air decreases easily. On the contrary, in the electric vacuum cleaner of the present embodiment, because the dust sucked with the air goes straight by the inertia and is collected, and the air is sucked by the motor fan (107) through an air guiding opening (opening 102H), the air and the dust are separated without generating spiral flow, therefore the loss of air passage becomes less.

Additionally, in this electric vacuum cleaner of the present invention of such principle, the dust separation section 101 is provided at the suction air passage which is leading from the suction opening 100 of the vacuum cleaner main body to the intake opening 107A of the motor fan 107 to separate the dust sucked from the suction opening 100 with the air and the dust collection section (dust collection room 104) provided at the suction air passage for collecting the dust separated from the air at the dust separation section 101. Moreover, the dust separation section 101 has a dust guiding duct (passage 102S) for inflowing the dust sucked from the suction opening 100 from one end of the duct and for guiding the dust that inflows from an other end to the dust collection section (dust collection room 104) by the inertia force. Still moreover, an air passage for guiding air (air passage from the plurality of openings 102H to the intake opening 107A of the motor fan 107) is provided to be communicated with a midstream of the dust guiding duct (passage 102S) and is communicated with the intake opening 107A of the motor fan 107 without passing through the dust collection section (dust collection room 104).

As well as in this electric vacuum cleaner, as the dust sucked with the air goes straight by inertia and is collected, and the air is sucked by the motor fan (107) through the air guiding opening (opening 102H), the air and the dust are separated without generating spiral flow, therefore the loss of air passage becomes less. By the way, in the principle of the present invention, although the dust guiding duct is formed in the linear shaped pipe section 102, it is not necessarily limited to this. For example, the tube section 102 which the dust guiding duct is formed may also be shaped such that the diameter of the tube section 102 gradually decreases while going to a direction of a downstream of airflow, or on the contrary, in such a shape that expands its diameter as going to a direction of the downstream of airflow, or its cross section is square or polygon in shape. Also, it may also be recommendable to provide the tube section 102 with an inertia applying pipe section for applying a direct advancing inertia force to the dust and a dust guiding pipe section for guiding the dust which is going straight to a dust collection section (dust collection room 104). In this instance, it may also be recommendable that the inertia applying pipe section and the dust collection section are separated as long as the inertia applying pipe section and the dust guiding pipe section are provided concentrically and a diameter of the dust guiding pipe section is formed larger enough than a diameter of the inertia applying pipe section.

More additionally, in this electric vacuum cleaner of the present invention of such principle, the dust separation section 101 is provided at the suction air passage leading from the suction opening 100 of the vacuum cleaner main body to the intake opening 107A of the motor fan 107 to separate the dust sucked from the suction opening 100 with the air and the dust collection section (dust collection room 104) provided at the suction air passage for collecting the dust separated from the air at the dust separation section 101. Furthermore, the dust separation section 101 has the tubular passage (passage 102S) as a dust guiding air passage (dust inflow air passage) which at one end is communicated with the suction opening 100 and adapted to flow in the dust sucked from the suction opening 100, and an air guiding air passage provided with the air guiding opening (102H) which is provided on the peripheral wall of the passage (102S) at one end, and at the other end is communicated with the intake opening 107A of the motor fan 107 without passing through the dust collection section (dust collection room 104).

As well as in this electric vacuum cleaner, as the dust sucked with the air goes straight by the inertia and is collected, and the air is sucked by the motor fan (107) through the air guiding opening (opening 102H), the air and the dust are separated without generating the spiral flow, therefore the loss of air passage becomes less.

[Mode for Carrying Out the Invention 1]

Next, embodiments of an electric vacuum cleaner applied with above mentioned principle of the invention will be described with reference to the accompanying drawings.

Figure 1:
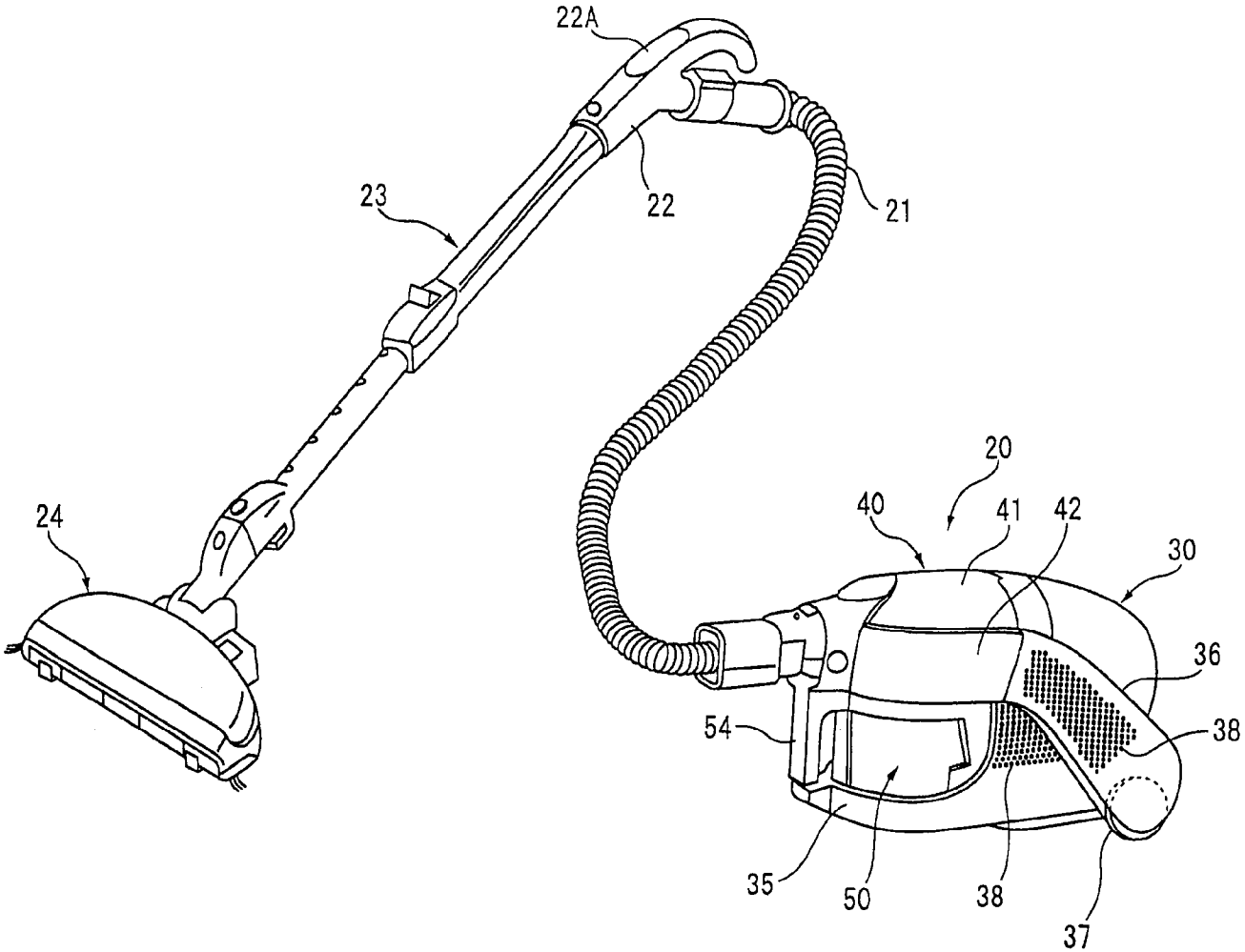
FIG. 1 is a perspective view schematically showing an external appearance of an electric vacuum cleaner relating to the present invention.
Figure 2:
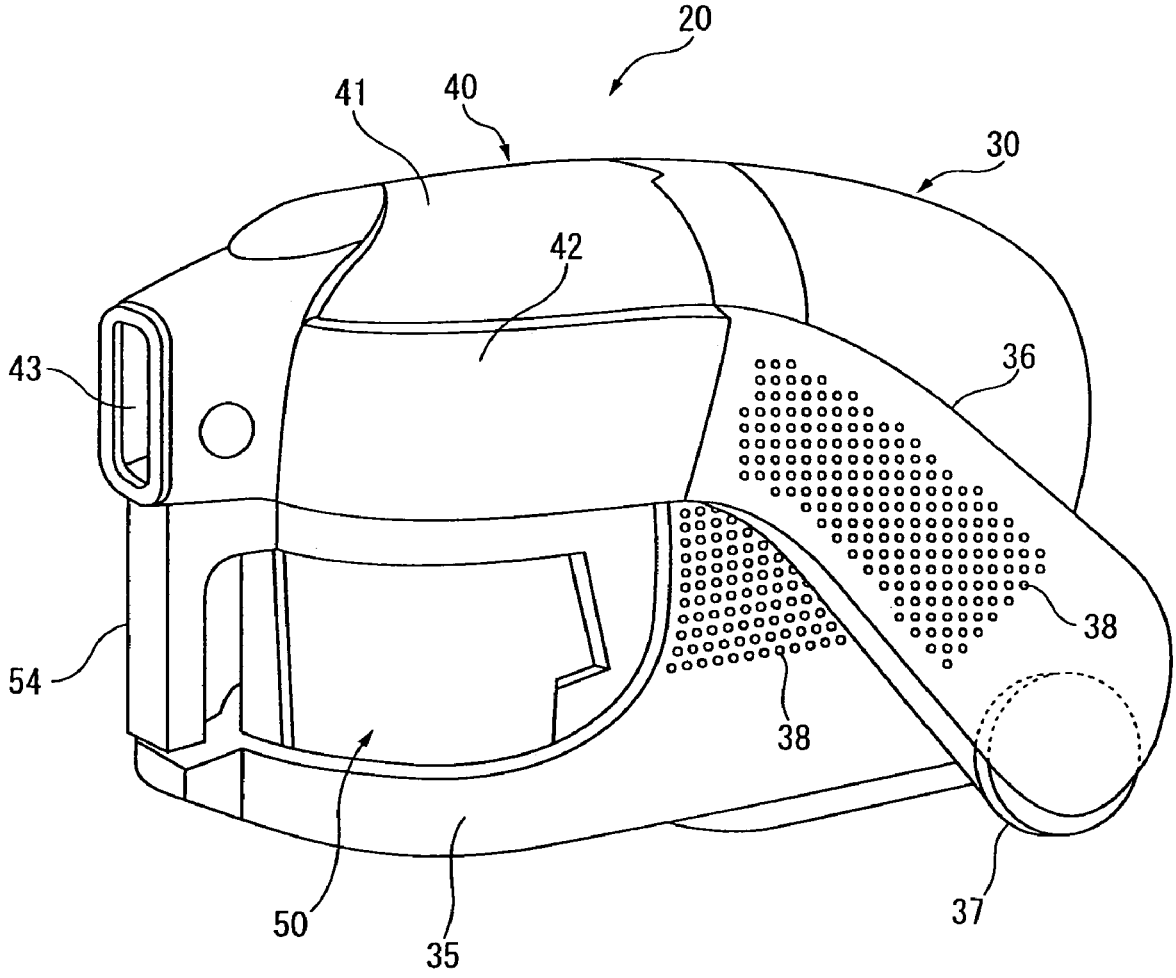
FIG. 2 is a perspective view showing a vacuum cleaner main body of the electric vacuum cleaner shown in FIG. 1.
Figure 3:
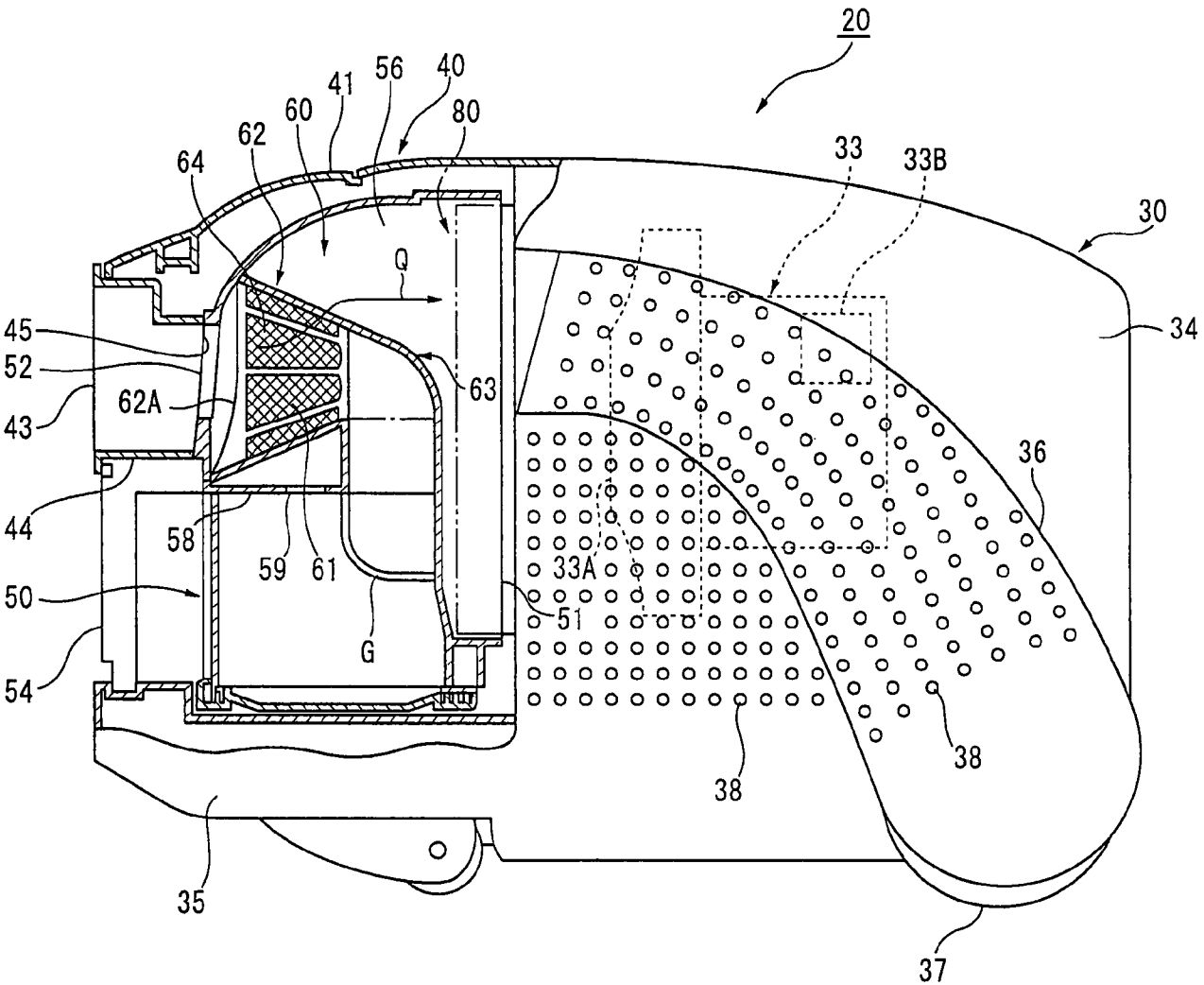
FIG. 3 is a partial sectional side view showing the vacuum cleaner main body shown in FIG. 2.

In FIG. 1, 20 is a vacuum cleaner main body, and one end of a hose 21 is connected attachably and detachably to the vacuum cleaner main body 20 and a hand operating pipe 22 is provided on the other end. An extension pipe 23 is connected attachably and detachably to the hand operating pipe 22 and a suction opening body 24 is connected to the end of the extension pipe 23 attachably and detachably. Also, a control section 22A is provided on the hand operating pipe 22, and there is provided on the control section 22A a control switch which is not shown.

As shown in FIGS. 2 to 5, the vacuum cleaner main body 20 is provided with a main body case 30 and a dust collection case (dust cup, dust collection container) 50 which is attachably and detachably mounted on the main body case 30 and a lid body 40 capable of opening and closing in upward and downward directions, that a back end is connected to the main body case 30 by a hinge connection.

The main body case 30 has a motor-driven section 34 which is a rear case section loaded with a motor fan 33. At a lower part of front side of the motor-driven section 34, there is provided a mounting section 35 which is in a plate-shape that protrudes to a forward direction. Onto the mounting section 35, the dust collection case 50 is attachably and detachably mounted. Furthermore, the dust collection case 50 is adapted to be fixed by holding of the lid body 40 and the mounting section 35 when the lid body 40 is closed.

Also, a front side of the motor-driven section 34, that is, a front side of the rear case section has opening 34A which is provided with a frame 34*b* in a radial pattern for retaining a filter. The opening 34A faces an intake opening 33A of the motor fan 33 and are communicated.

At both side faces of the main body case 30, an expanded section 36 is formed throughout an upper part of a front side and to a lower part of a back side. A rear wheel 37 is retained at a lower part of the expanded section 36 which is capable of revolving freely. Additionally, at a front side of both side faces of the expanded section 36 and the main body case 30, a plurality of exhaust holes 38 are formed. These exhaust holes 38 are communicated with an exhaust opening 33B of the motor fan 33 through an exhaust air passage which is not shown. By this, the air that is exhausted from the exhaust opening 33B of the motor fan 33 is exhausted outside from the exhaust hole 38 through the exhaust air passage. Also, in the motor-driven section 34 of the main body case 30, a battery which is not shown is contained at a lower part of the motor fan 33.

The lid body 40 has a top panel 41 which is formed virtually elliptical in shape if seen in flatways, and a peripheral wall 42 is integrally formed at a perimeter of the top panel 41. At a front part of this peripheral wall 42, a connection pipe 44 which has a connection opening (suction opening) 43 for attachably and detachably connecting the dust collection hose 21 is provided. The connection pipe 44 extends in a longitudinal direction, and a back end 45 of it is opened.

Figure 7:
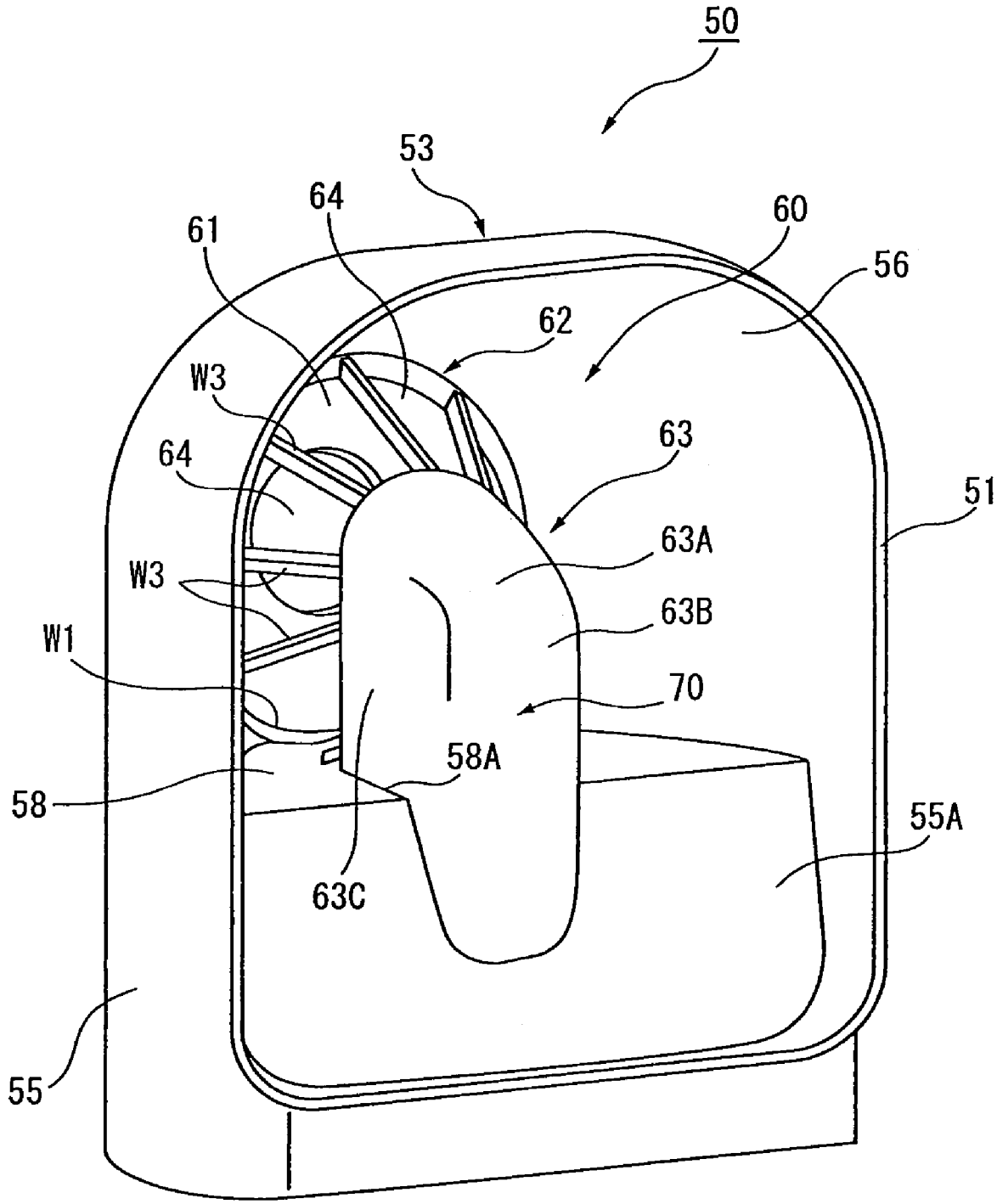
FIG. 7 is a perspective view showing the dust collection case.
Figure 8:
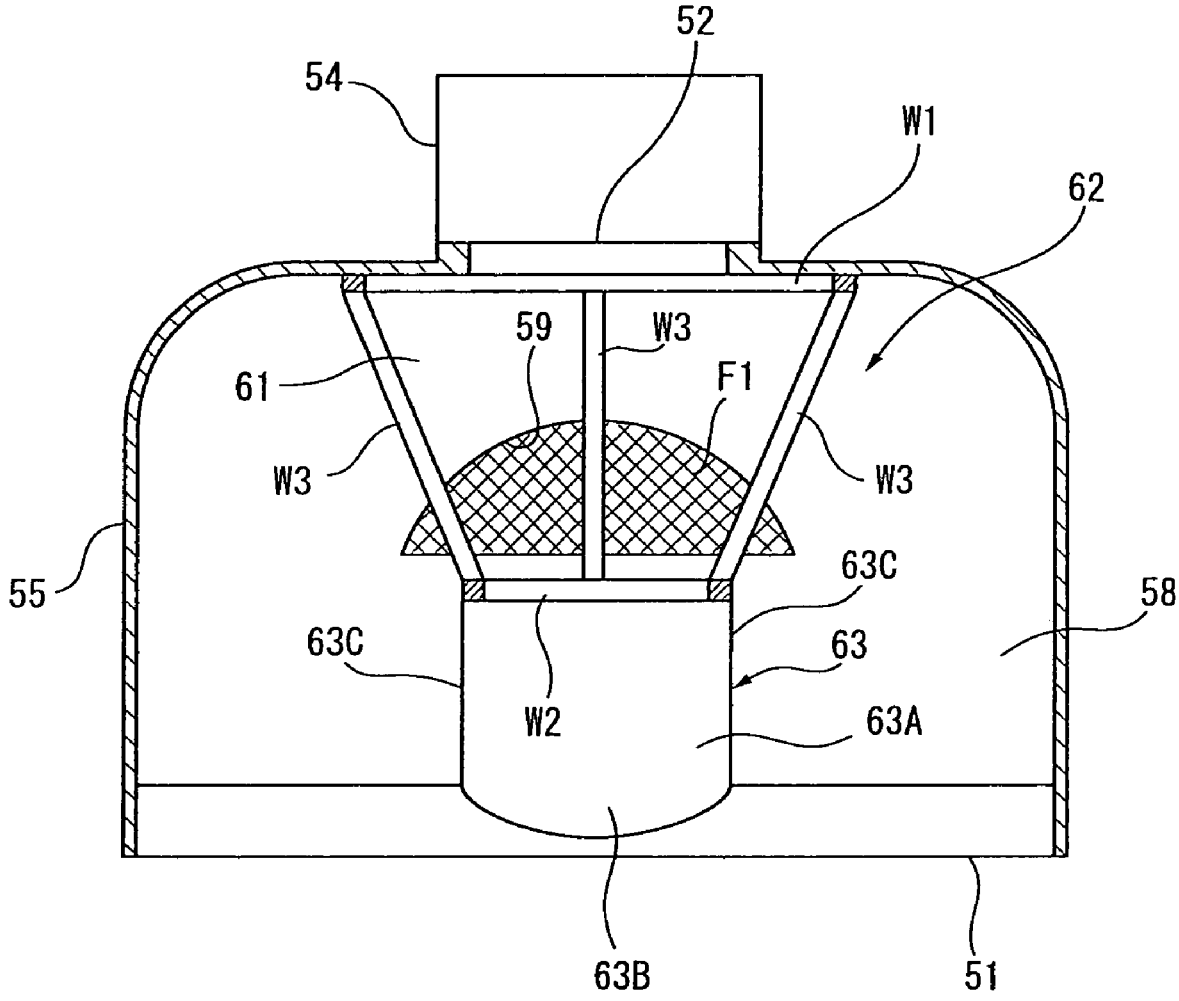
FIG. 8 is a partial horizontal sectional view showing a part of the dust collection case.

With respect to FIGS. 6 to 8, the dust collection case 50 has a container case body 53 (shown in FIG. 7) which has an opening 51 on a rear face (right side in FIG. 6) and a suction opening (air inflow opening) 52 at a front face, and a handle section 54 which is integrally formed at below the suction opening 52 of the container case body 53.

The container case body 53 has a dust collection room section (dust collection section) 55 formed at a lower part, a negative pressure room section 56 as an air guiding air passage formed above the dust collection room section 55, a dust separation section 60 provided within the negative pressure room section 56 and a guide pipe 70 for guiding the dust separated at the dust separation section 60 to the dust collection room section 55. In addition, the container case body 53 has a front wall 53*a* and the suction opening 52 is formed at a side of an upper part of the front wall 53*a*.

At a bottom of the dust collection room section 55, a bottom plate 57 is attached capable of opening and closing about an axis J, and it is made capable of throwing away the dust accumulated in the dust collection room section 55 by opening the bottom plate 57. A ventilation opening 59 as an exhaust opening (ventilation aperture) is formed at a top panel 58 of the dust collection room section 55 which divides the dust collection room section 55 and the negative pressure room section 56. The ventilation opening 59 is closed by a net filter (exhaust filter) F1 that is attached to the ventilation opening 59.

A connection hole 58A is formed behind the ventilation opening 59 of the top panel 58. At lower part of the connection hole 58A, there is provided a guide wall G to generate spiral flow at inside of the dust collection room section 55.

The dust separation section 60 has a tubular filter 62 which forms a tubular passage (flow passage, or more specifically, the air passage) 61, and a strike section 63 which is provided at an other end opening 62B of the tubular filter 62. A diameter of one end opening 62A of the tubular filter 62 is formed larger than a diameter of the suction opening 52. The one end opening 62A of the tubular filter 62 and the suction opening 52 of the container case body 53 are connected so as the suction opening 52 to be located at an inner side. A diameter of the other end opening 62B of the tubular filter 62 is set virtually similarly as the diameter of its suction opening 52, and a diameter of the tubular filter 62 decreases gradually as going from one end to the other end linearly. That is to say, the tubular filter 62 of the dust separation section 60 is adapted to have a reducing diameter which is in a circular cone shape (taper shape) as gradually going to the downstream direction of the air passage. By the way, it may be recommendable to set the diameter of the other end opening 62B of the tubular filter 62 smaller than the diameter of the suction opening 52.

The passage 61 of the tubular filter 62 extends linearly to a longitudinal direction. The connection pipe 44 of the lid body 40, the suction opening 52 of the container case body 53, the tubular filter 62, the opening 51 of the container case body 53 and the intake opening 33A of the motor fan 33 are arranged in alignment.

Figure 6:
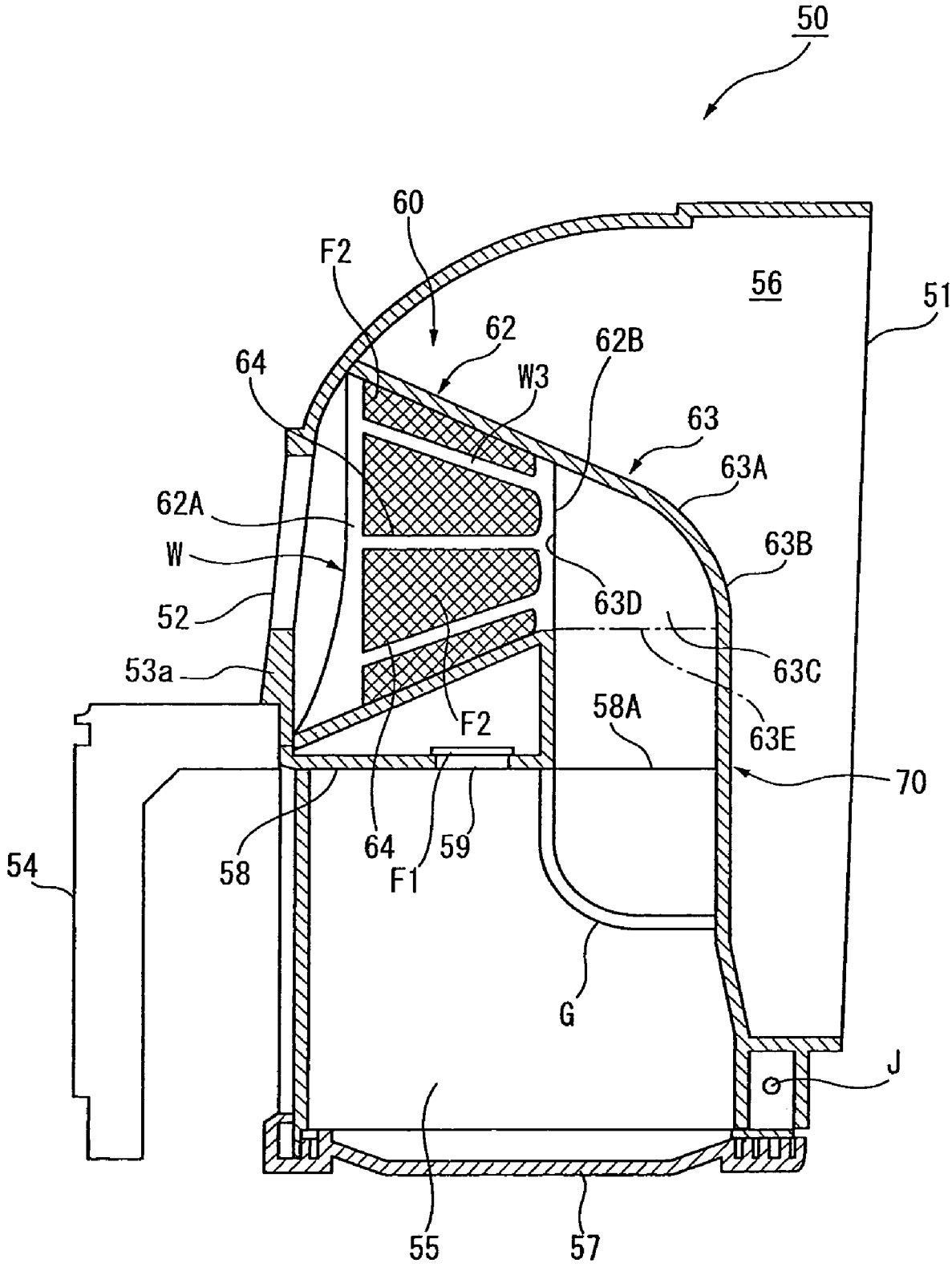
FIG. 6 is a vertical sectional view showing a structure of the dust collection case.

As shown in FIG. 6, the tubular filter 62 has a tubular frame (equivalent to the tube section 102 indicated in the principle of the invention) W which is provided with a plurality of openings 64 as an air guiding opening, and a net filter (mesh shape filter) F2 which is in a mesh shape attached to an inner peripheral side of the tubular frame W. The tubular frame W also has a frame section W1 in a circular shape (round shape) forming the one end opening 62A, a frame section W2 which is in a round shape and a tubular shape (circular shape) forming the other end opening 62B, and a plurality of frame sections W3 (rib shaped frame section) which are in a rib shape that connect the frame sections W1 and W2. By the way, the spaces surrounded by each frame sections W1-W3 are the openings (air guiding opening) 64. The openings 64 as an air guiding opening are equally provided throughout entire circumference of the tubular filter 62. In addition, the passage 61 is formed and surrounded by the frame sections W1-W3 and the net filter F2. In FIG. 7, indication of the net filter F2 shown in FIG. 6 has been omitted as a matter of convenience to describe the openings 64.

Furthermore, the net filter F2 is formed in a tubular shape along the inner periphery of the tubular frame W as a filter tube section, and is attached to the tubular frame W by adhesion or fusion bonding for example in such a manner as to cover the plurality of openings 64. Moreover, a metallic coating layer formed on a surface of a mesh shape resin fiber by sputtering is used for the net filter F2, therefore the net filter F2 is made to provide extremely easy slippage so as to avoid an attachment of the dust.

The passage 61 of the tubular filter 62 is communicated with the intake opening 33A of the motor fan 33 through the openings 64 of the tubular filter 62, the negative pressure room section 56 of the container case body 53 and the opening 34A of the motor-driven section 34 of the main body case 30. Also, the extending directions of the passage 61 of the tubular filter 62 and the connection pipe 44 of the lid body 40 are in alignment, and the intake opening 33A of the motor fan 33 faces toward the extending of direction the passage 61 of the tubular filter 62.

The strike section 63 has a slant wall section 63A extending from an upper side of the other end opening 62B of the tubular filter 62 to a lower side on a slant, and a strike wall section 63B which faces to the other end opening 62B of the tubular filter 62 and is also incurved from one end of the slant wall section 63A and extending to a lower part, and a side wall section 63C which is formed at both sides of the slant wall section 63A and the strike wall section 63B. Additionally, the strike section 63 has an opening 63D jointed to the other end opening 62B of the tubular filter 62 and also has an opening 63E which faces to a lower part.

The guide pipe 70 extends in a vertical direction, and is communicated with inside of the dust collection room section 55 through the opening 63E of the strike section 63 and the connection hole 58A of the top panel 58.

Further, there is fitted a filter 80 at the opening 51 of the container case body 53 to capture the microscopic dust failed to be captured by the net filters F1 and F2. Furthermore, the filter 80 is pressed and attached by the motor-driven section, that is, by a frame 34*b* which is provided at the front surface of the rear case section.

[Operation]

Next, an operation of the electric vacuum cleaner constituted as above will be described.

Figure 4:
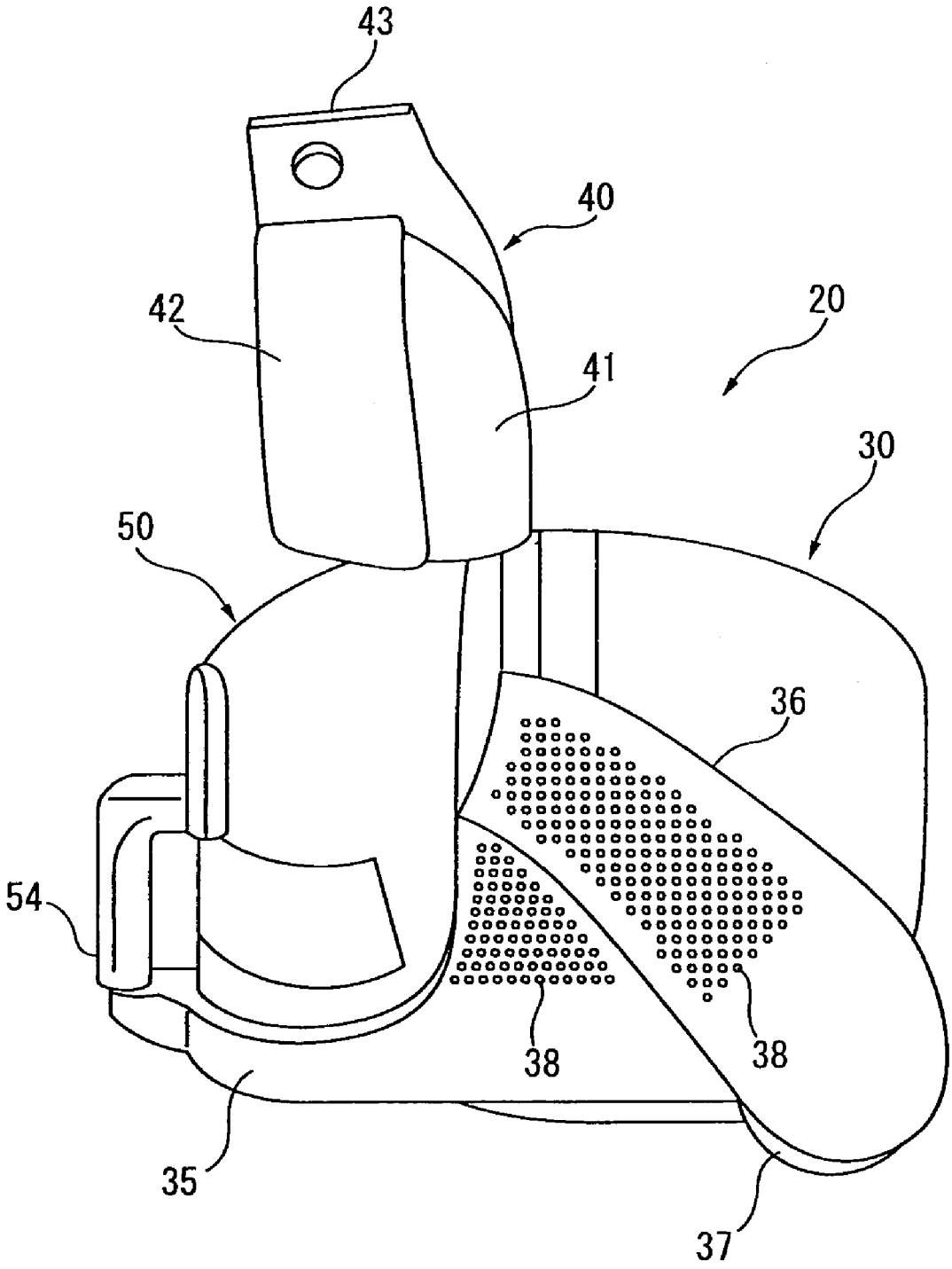
FIG. 4 is a side view showing a condition that a lid body is opened.
Figure 5:
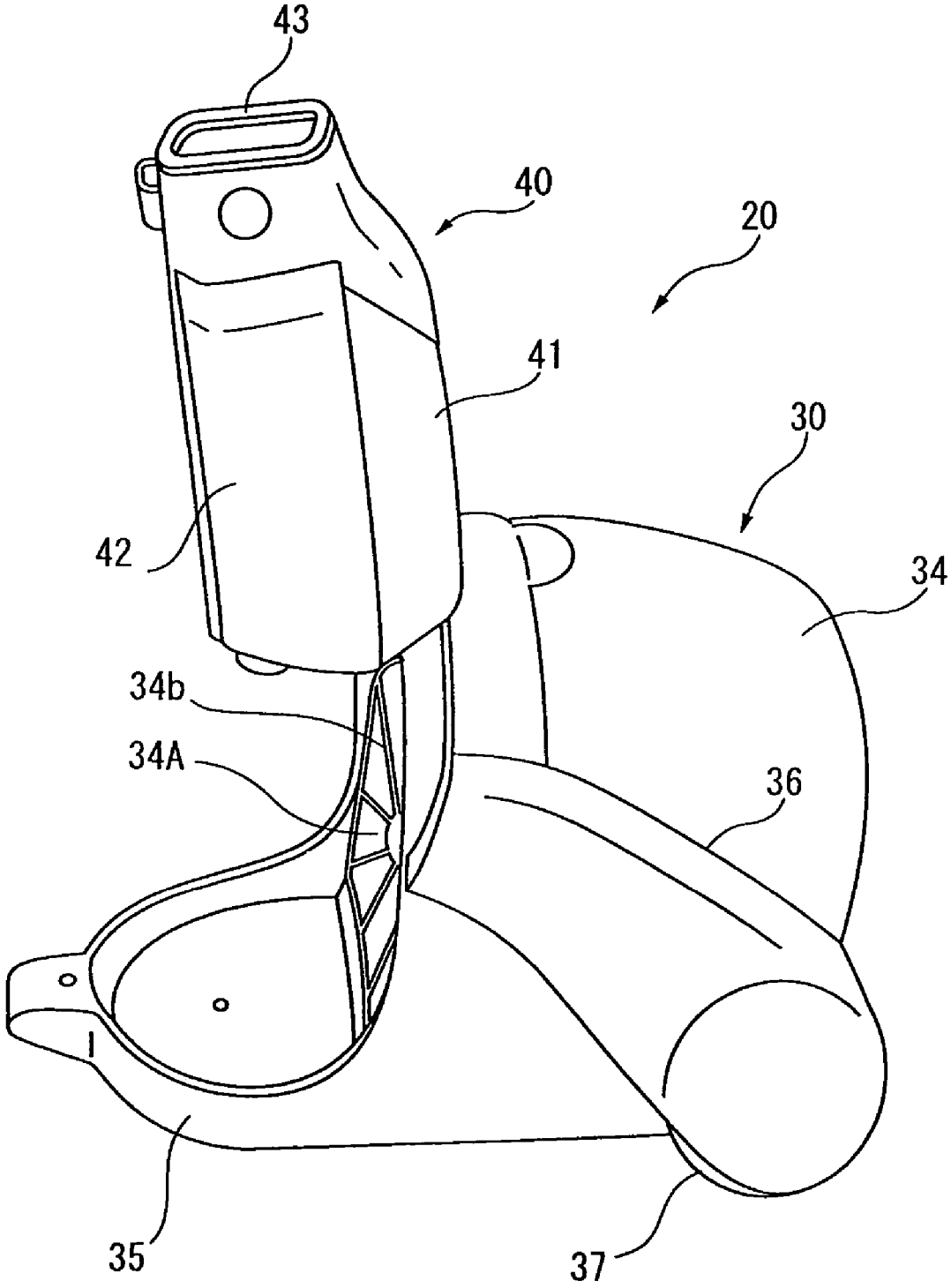
FIG. 5 is a perspective view showing the vacuum cleaner main body in a condition that the lid body is opened and a dust collection case is unloaded.

First, as shown in FIG. 4, the dust collection case 50 is mounted on the mounting section 35 of the main body case 30 and then the lid body 40 is closed, and the hose 21 is connected to the connection opening 43 of the lid body 40. When controlling the switch (not shown) of the control section 22A, the motor fan 23 actuates. By the actuation of the motor fan 23, the negative pressure room section 56 of the container case body 53 becomes the negative pressure through the opening 34A of the main body case 30. This negative pressure acts upon the openings 64 of the tubular filter 62, the passage 61 of the tubular filter 62, the suction opening 52 of the container case body 53, the connection pipe 44 of the lid body 40, the hose 21, the extension pipe 23 and the suction opening body 24, thereby the dust on a cleaning surface is sucked together with the air from the suction opening body 24.

The sucked dust and air are adapted to be sucked to the connection opening 43 of lid body 40 through the extension pipe 23 and the hose 21. The dust and the air that are sucked to the connection opening 43 are adapted to be sucked to the passage 61 of the tubular filter 62 of the dust separation section 60 through the suction opening 52 of the dust collection case 50.

Some of the air sucked to the passage 61 passes through the net filter F2 of the openings 64 of the tubular filter 62, and sucked to the negative pressure room section 56 of the container case body 53, and furthermore, passes through the filter 80 loaded at the opening 51 of the container case body 53 and sucked by the intake opening 33A of the motor fan 33. At this time, the microscopic dust that passed through the net filter F2 is captured by the filter 80.

On the other hand, because the passage 61 extends linearly to the longitudinal direction, the dust which is sucked to the passage 61 of the tubular filter 62 and which has more weight than predetermined weight goes straight through the passage 61 and hits the strike wall section 63B of the strike section 63, and is adapted to be introduced inside of the dust collection room section 55 by the guide pipe 70. That is to say, the dust and the air are separated by the dust separation section 60.

Also, some of the air is adapted to be introduced inside of the dust collection room section 55 through the strike section 63 and the guide pipe 70, and the introduced air turns into spiral flow by the guide wall G of the dust collection room section 55, and the dust introduced inside of the dust collection room section 55 is accumulated as it is compressed by the spiral flow.

The air introduced into the dust collection room section 55 is, when turned into spiral flow, passes through the ventilation opening 59 of the top panel 58 of the dust collection room section 55 and the net filter F1, and is sucked to the negative pressure room section 56 of the container case body 53. At this time, the microscopic dust which has passed through the net filter F1 is sucked together with the air to the negative pressure room section 56. In addition, the air sucked to the negative pressure room section 56 is further sucked by the intake opening 33A of the motor fan 33 through the filter 80 which is loaded at the opening 51 of the container case body 53. At this time, the microscopic dust which passed through the net filter F1 is captured by the filter 80.

In this way, the air that is exhausted through the openings 64 and the air that is exhausted through the ventilation opening 59 are converged together at the negative pressure room section 56. Further, the converged air is adapted to be sucked by the intake opening 33A of the motor fan 33 through the filter 80 which is loaded at the opening 51 of the container case body 53. As stated above, the microscopic dust which passed through the net filters F1 and F2 is captured by the filter 80 at this time.

By the way, light weighted microscopic dust in the dust which is sucked to the passage 61 of the tubular filter 62 attaches to the net filter F2 since it flows with the air that passes the net filter F2 of the openings 64 without going straight through the passage 61 of the tubular filter 62. If clogging of the net filter F2 caused by the attachment of the microscopic dust becomes larger, the amount of wind that goes through the net filter F2 reduces, but the negative pressure of the negative pressure room section 56 of the container case body 53 increases corresponding to the amount it reduced as well as the negative pressure within the dust collection room section 55 through the ventilation opening 59 of the top panel 58. Consequently, a wind velocity of the air that goes straight through the passage 61 of the tubular filter 62 becomes greater, therefore the amount of wind which goes straight increases.

When the wind velocity that goes straight through the passage 61 of the tubular filter 62 becomes greater, the air that goes straight forward peels off the dust attached to the net filter F2. On this occasion, because the diameter of the tubular filter 62 gradually decreases as going linearly to the side of the opening 62B, the wind that goes straight through the passage 61 becomes easier to hit the entire side of the net filter F2, therefore the dust attached to the net filter F2 is easily peeled off.

The peeled dust is adapted to be introduced and accumulated in the dust collection room section 55 through the strike section 63 and the guide pipe 70.

Also, even if the amount of wind that passes through the net filter F2 is reduced by clogging, the amount of wind the motor fan 33 sucks can be maintained constant because the amount of wind goes straight through the passage 61 of the tubular filter 62 increases. Consequently, it is always possible to suck the dust by a predetermined sucking power with irrespective of clogging of the net filter F2.

Additionally, by a fact that the dust and the air are not separated by generation of spiral flow within the passage 61 of the tubular filter 62, the loss of air passage within the passage 61 becomes less. Furthermore, when the air sucked from the passage 61 of the tubular filter 62 to the negative pressure room section 56 of the container case body 53 through the net filter F2, the flowing direction of air does not change significantly as shown by the arrow Q (see FIG. 3), because the suction opening 52, the tubular filter 62, the opening 51 of the container case body 53 and the intake opening 33A of the motor fan 33 are arranged in alignment, therefore flows virtually linearly to the motor fan 33 to be sucked.

Consequently, the loss of air passage becomes even less (i.e., loss in an amount of air passing through becomes even less), so that the performance of the motor fan 33 can be achieved sufficiently. Further, because the connection pipe 44 of the lid body 40 and the tubular filter 62 are arranged in a straight line, a direction of the air introduced to the suction opening 52 of the container case body 53 becomes in alignment with the extending direction of the tubular filter 62, therefore its loss of air passage becomes even more less.

Moreover, by providing the dust collection room section 55 below the dust separation section 60 and by providing the ventilation opening 59 at the top panel 58 of the dust collection room section 55, the ventilation opening 59 which communicates the dust collection room section 55 and the negative pressure room section 56 penetrates the top panel 58 in a vertical direction. By this structure, the dust attached to the net filter F1 which is fixed to the ventilation opening 59 falls to a lower part by its own weight and is accumulated inside of the dust collection room section 55. Also, the clogging is hard to occur since the dust attached to the net filter F1 can be removed easily, therefore the deterioration in sucking efficiency can be avoided.

According to the present invention as described above, it is possible to reduce the loss of air passage, and even amount of wind at the suction opening does not decrease even if the dust accumulates, therefore it is always possible to suck the dust by a predetermined sucking power.

[Mode for Carrying Out the Invention 2]

FIGS. 10-13 show an electric vacuum cleaner corresponding to the second embodiment of the present invention. The same reference numbers indicated in FIGS. 1-8 are given for the parts identical or resembles to the structure of the embodiment shown in FIGS. 1-8, and their descriptions are omitted.

Figure 10:
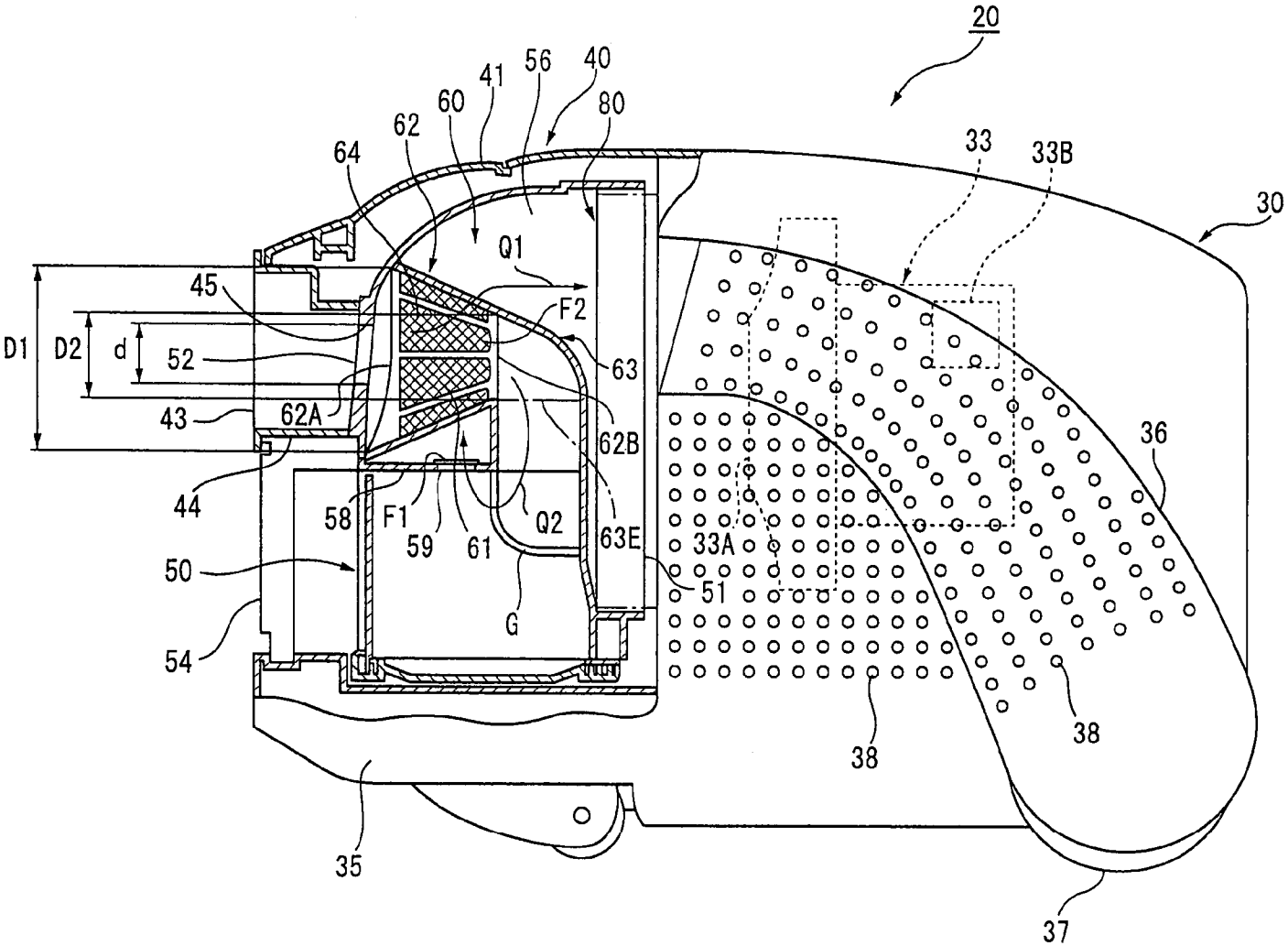
FIG. 10 is a partial sectional side view showing the vacuum cleaner main body of the electric vacuum cleaner of the other embodiment of the present invention.
Figure 11:
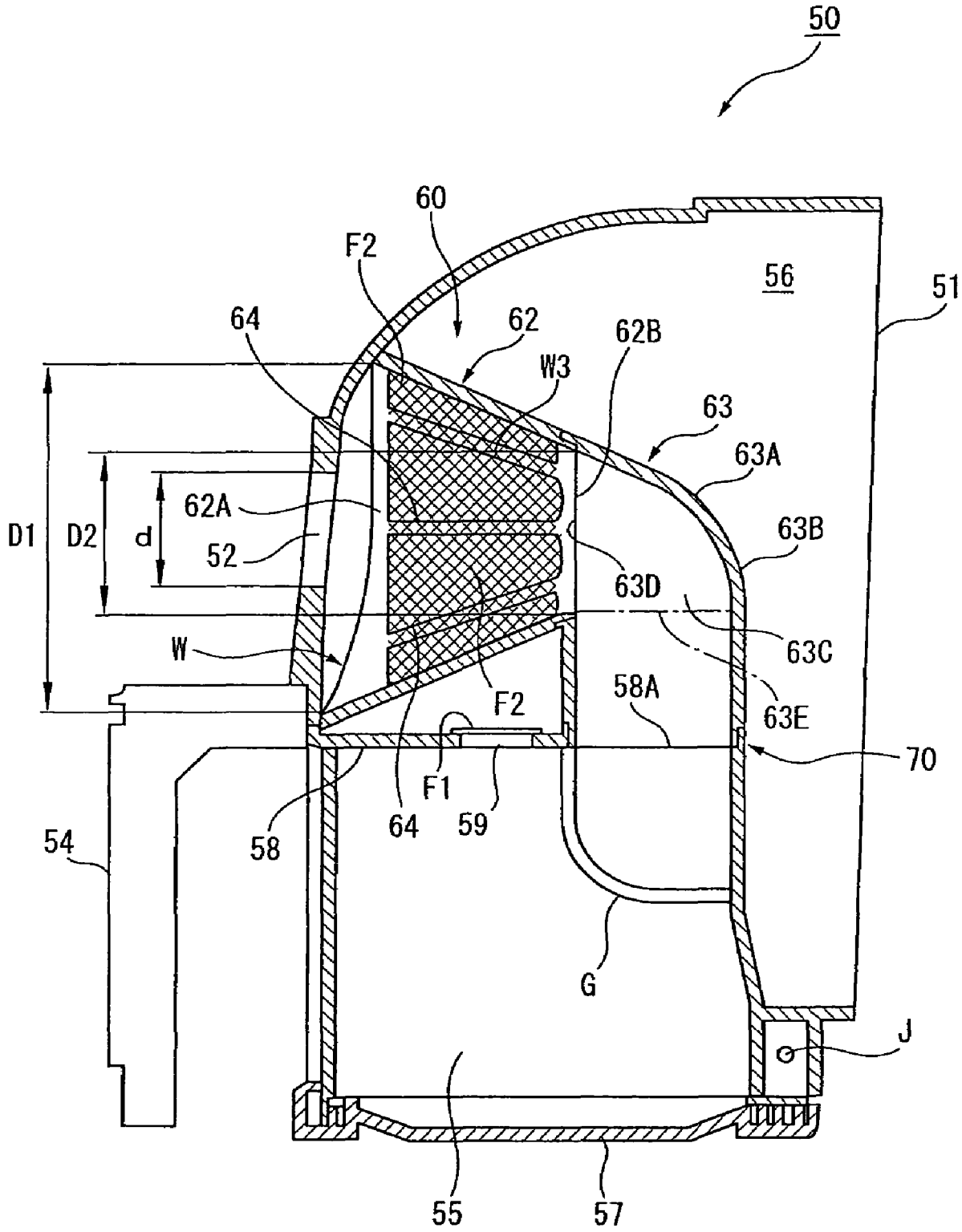
FIG. 11 is an enlarged sectional view showing the dust collection case in FIG. 10.

The dust separation section 60 in the second embodiment of the present invention has, as mentioned above, the tubular filter 62 formed with the passage 61 which is in a tubular shape and a strike member (tubular body) provided with the strike section 63 which is set at the other end opening 62B of the tubular filter 62. As shown in FIGS. 10 and 11, a diameter D1 of the one end opening 62A of the tubular filter 62 is formed larger than a diameter d of the suction opening (air inflow opening) 52 of the container case body 53, and a diameter D2 of the other end opening 62B of the tubular filter 62 is formed larger than a diameter of its suction opening 52. That is to say, the diameter d of the suction opening (air inflow opening) 52 is formed smaller than the diameter D2 of the other end opening 62B of the tubular filter 62.

When the air containing the dust flows and enters in the tubular filter 62 from the suction opening 52, the air containing the dust flows to the direction of the one end opening 62B from the one end opening 62A of the tubular filter 62, therefore the one end opening 62A of the tubular filter 62 becomes as an upstream end and the other end opening 62B becomes as a downstream end in consideration of the flow of air. Further, the one end opening 62A (upstream end) of the tubular filter 62 is closely contacted or fixed to a rear side of the front wall 53*a* of the container case body 53 at a periphery of the suction opening (air inflow opening) 52. Thereby the suction opening 52 of the container case body 53 and the one end opening 62A are each connected so as to set the suction opening 52 at the position which is inside of the one end opening 62A. In addition, the diameter of the one end opening 62A (upstream end) of the tubular filter 62 is formed larger than the diameter of the suction opening 52.

Also, the diameter of the tubular filter 62 gradually decreases as going linearly to the other end (downstream end) from the one end (upstream end). In other words, the diameter of the tubular filter 62 of the dust separation section 60 is gradually adapted to diminish in a circular cone shape (taper shape) as going to the downstream direction of the air passage.

Moreover, the passage 61 of the tubular filter 62 extends linearly to a longitudinal direction, and the connection pipe 44 of the lid body 40, the suction opening 52 of the container case body 53, the tubular filter 62, the opening 51 of the container case body 53 and the intake opening 33A of the motor fan 33 are arranged in alignment.

Figure 12:
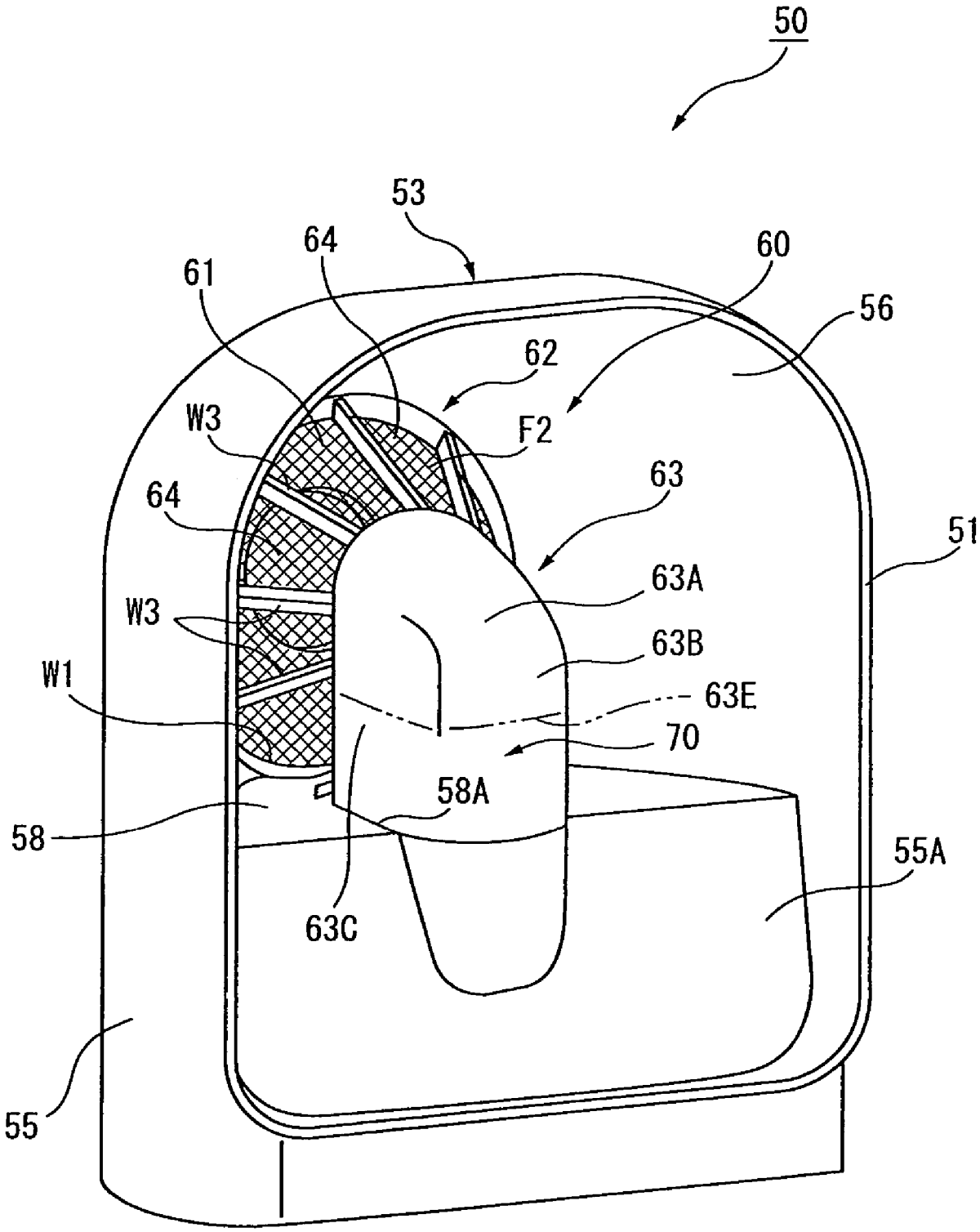
FIG. 12 is a perspective diagram viewing the dust collection case in FIG. 11 from oblique-rear side.

As shown in FIG. 11, the tubular filter 62 has the tubular frame W which is provided with the plurality of openings 64, and the net filter (mesh shaped filter) F2 which is in a mesh shape attached to an inner peripheral side of the tubular frame W (see FIG. 12). The tubular frame W also has the frame section W1 which is in a circular shape (round shape) forming the one end opening 62A, the frame section W2 which is in a round shape and a tubular shape (circular shape) forming the other end opening 62B, and the plurality of frame sections W3 (rib shaped frame section) which are in rib shape that connect the frame sections W1 and W2 (see FIGS. 11-13). By the way, the spaces surrounded by each frame sections W1-W3 are the openings 64. The openings 64 are equally provided throughout the entire circumference of the tubular filter 62. In addition, the passage 61 is formed and surrounded by the frame sections W1-W3 and the net filter F2.

Also, the net filter F2 is formed in a tubular shape along the inner periphery of the tubular frame W as the filter tube section, and is attached to the tubular frame W by adhesion or fusion bonding for example in such a manner as to cover the plurality of openings 64.

Additionally, in the tubular frame W, the diameter D1 of the upstream end is formed larger than the diameter d of the suction opening (air inflow opening) 52 and the diameter D2 of the downstream end is formed larger than the diameter d of the suction opening (air inflow opening) 52. In other words, the diameter d of the suction opening (air inflow opening) 52 is formed smaller than the diameter D2 of the downstream end (other end opening 62B) of the tubular frame W. Also, the suction opening 52, the one end opening 62A and the other end opening 62B are provided substantially concentric.

Furthermore, a metallic coating layer formed on the surface of the mesh shape resin fiber by the sputtering is used for the net filter F2, thereby the net filter F2 is made to provide extremely easy slippage so as to avoid attachment of the dust.

Figure 13:
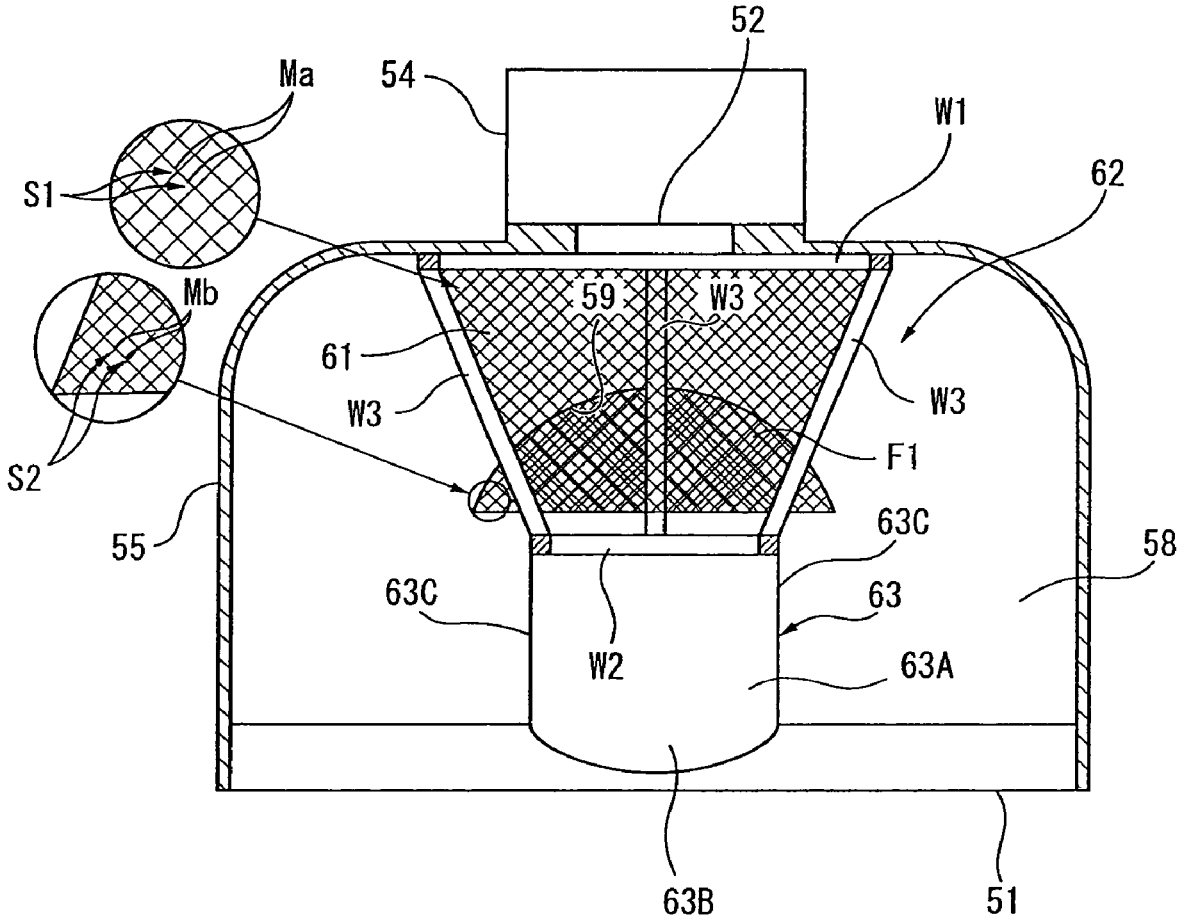
FIG. 13 is an explanatory view showing a part of the dust collection case in FIG. 11 in a horizontal sectional view and also showing a part of a net filter by enlarging.

Moreover, as shown in FIG. 13, if a coarseness of a mesh (opening) Ma of the net filter F2 of the tubular filter 62 is S1, more specifically, if a dimension of an opening of mesh (net) is S1, and if the coarseness of a mesh (opening) Mb of the net filter F2 attached to the ventilation opening 59 which is an exhaust opening is S2, more specifically, if a dimension of an opening of mesh (net) is S2, then the dimension of the mesh opening S1 of the net filter F2 is formed smaller than the dimension of the mesh opening S2 of the net filter F1 (exhaust filter).

Also, if an amount of wind of the air that passes through the tubular filter 62 and inflows (sucked) to the negative pressure room section 56 is Q1, and if an amount of wind of the air that inflows (sucked) to the negative pressure room section 56 through the ventilation opening 59 which is as the exhaust opening and the net filter F1 is Q2, then the amount of wind of the air Q1 that passes through the net filter F2 of the tubular filter 62 is set less than the amount of wind of the air Q2 that passes through the net filter F1 of the dust collection room section (dust collection section) 55. That is to say, the amount of wind Q2 is set larger than the amount of wind Q1.

A relation between the wind amounts Q1 and Q2 is determined through various conditions such as a sucking performance of the motor fan 33, the coarseness of mesh of the net filters F1 and F2 (size of the opening (opening) of mesh) and cross-sectional area or length of each air passages. But the relation between the wind amounts Q1 and Q2 can be changed by the coarseness (size of the opening of mesh) of mesh of the net filters F1 and F2 as long as the conditions other than the net filters F2 and F2 are determined and are constant.

In addition, the passage 61 of the tubular filter 62 is communicated with the intake opening 33A of the motor fan 33 through the openings 64 of the tubular filter 62, the negative pressure room section 56 of the container case body 53 and the opening 34A of the motor-driven section 34 of the main body case 30. Also, the extending directions of the passage 61 of the tubular filter 62 and the connection pipe 44 of the lid body 40 are in alignment, and the intake opening 33A of the motor fan 33 faces toward the extending direction of the passage 61 of the tubular filter 62.

The strike section 63 has the slant wall section 63A extending from the upper side of the other end opening 62B of the tubular filter 62 to the lower side on a slant, and the strike wall section 63B which faces to the other end opening 62B of the tubular filter 62 and which is also incurved from the one end of the slant wall section 63A and extending to the lower part, and the side wall section 63C formed at both sides of the slant wall section 63A and the strike wall section 63B. Additionally, the strike section 63 has an opening 63D jointed to the other end opening 62B of the tubular filter 62 and also has an opening 63E which faces the lower part.

The strike section 63 is provided at upper part of the guide pipe 70 which is separately formed to the tubular filter 62 as shown in FIGS. 11 and 12. The guide pipe 70 extends in a vertical direction and is communicated with inside of the dust collection room section 55 through the opening 63E of the strike section 63 and the connection hole 58A of the top panel 58.

By the way, it may be recommendable to form the tubular filter 62, the strike section 63 and the guide pipe 70 integrally and form separately from the container case body 53, and fix to the top panel 58 of the dust collection room section 55 of the container case body 53 by adhesion or supersonic fusion bonding. Also, it may be recommendable to form the strike section 63 and the guide pipe 70 integrally and form separately from the tubular filter 62 and the container case body 53, and fix the tubular filter 62 to the strike section 63 and the front wall 53*a* by adhesion or supersonic fusion bonding together with fix a lower end of the guide pipe 70 to the top panel 58 by adhesion or supersonic fusion bonding.

[Operation]

Next, an operation of the electric vacuum cleaner constituted as above will be described hereinafter.

As mentioned above, the dust on a cleaning surface is sucked with the air inside of the tube shaped passage 61 by operating the motor fan 33. Some of the air sucked to the passage 61 (particularly a peripheral air of the airflow that flows into the passage 61) passes through the net filter F2 of the openings 64 of the tubular filter 62 and sucked to the negative pressure room section 56 of the container case body 53, and further sucked by the intake opening 33A of the motor fan 33 through the filter 80 loaded at the opening 51 of the container case body 53. On this occasion, the microscopic dust which passed through the net filter F2 is captured by the filter 80.

Meanwhile, because the passage 61 extends linearly to the longitudinal direction, the dust which is sucked to the passage 61 of the tubular filter 62 and which has more weight than predetermined weight and the remaining air (air) go straight through the passage 61 and hit the strike wall section 63B of the strike section 63.

At this time, in the dust that inflows with an atmospheric air (air) from the suction opening 52 into the passage 61, although the light dust is in some of the air which is at a side of the net filter F2, the other air goes virtually straight forward by the inertia force. Since the light dust is relatively light in weight, the inertia energy is less. The dust that goes straight forward is relatively heavy in weight and therefore the inertia energy is large.

Therefore, within the dust that inflows from the suction opening 52, when the dust that goes virtually straight forward by the inertia force caused when flowing into the passage 61 from the suction opening 52 hits the downstream end part of the net filter (filter tube section) F2, the dust breaks into the mesh (mesh opening) of the downstream end part of the filter F2 by the inertia energy, thereby the downstream end part of the net filter F2 clogs and a permeability loses, as a result, a recovery in the permeability cannot be expected.

But in the present embodiment, since a vast majority of dust that flows into the passage 61 from the suction opening 52 and also the dust at the periphery part go straight forward by the inertia energy, and in addition, since the diameter d of the suction opening 52 is formed smaller than the diameter D2 of the opening 62B which is the downstream end of the tubular filter 62, the dust that goes virtually straight forward by the inertia force caused when flowing into the passage 61 from the suction opening 52 hits the strike wall section 63B of the strike section 63 without hitting the downstream end of the filter F2. Therefore, clogging at the downstream end of the net filter (filter tube section) F2 caused by the dust flowing into the passage 61 from the suction opening 52 and going straight forward can be avoided. On this occasion, the remaining air that goes straight without passing through the net filter F2 also hits the strike wall section 63B of the strike section 63.

In addition, the dust struck the strike wall section 63B and the remaining air which goes straight without passing through the filter F2 are biased to a lower direction and then adapted to be introduced inside of the dust collection room section 55 by the guide pipe 70. As described, some of the air and the dust are separated by the dust separation section 60, and the separated dust and the remaining air are adapted to be introduced inside of the dust collection room section 55 by the guide pipe 70.

The air that is introduced inside of the dust collection room section 55 becomes spiral flow by the guide wall G of the dust collection room section 55, and accumulates the dust on a bottom side of the dust collection room section 55 while compressing the dust which is introduced inside of the dust collection room section 55. Later, the air passes through the ventilation opening 59 of the top panel 58 of the dust collection room section 55 and the net filter F1, and is sucked to the negative pressure room section 56 of the container case body 53.

On this occasion, the microscopic dust which passed through the net filter F1 is sucked together with the air to the negative pressure room section 56. In addition, the air that is sucked to the negative pressure room section 56 is furthermore sucked by the intake opening 33A of the motor fan 33 through the filter 80 which is loaded at the opening 51 of the container case body 53. The microscopic dust that passed through the net filter F1 is captured by the filter 80 at this time.

In this manner, the air exhausted through the openings 64, and the air exhausted through the ventilation opening 59 are converged together at the negative pressure room section 56. Further, the converged air is sucked by the intake opening 33A of the motor fan 33 through the filter 80 which is loaded at the opening 51 of the container case body 53. As stated above, the microscopic dust which passed through the net filters F1 and F2 is captured by the filter 80.

In addition, the amount of wind of the air Q1 that passes through the net filter F2 as mentioned above is set less than the amount of wind of the air Q2 that is sucked inside of the negative pressure room section 56 through the guide pipe 70, the dust collection room section 55 and the opening (exhaust opening). Consequently, the vast majority of the dust flowing into the tubular filter 12 from the suction opening 52 flows the passage 61 in the tubular filter 62 linearly toward the strike wall section 63B of the strike section 63. Therefore, a separation rate of the dust at inside of the tubular filter 62 increases, that is, within the dust flowing into the tubular filter 62, a proportion of flowing toward the strike wall section 63B without flowing to the side of the net filter F2 of the tubular filter 62 increases. This separation rate increases more as the amount of wind Q2 becomes larger to the amount of wind Q1.

Furthermore, the light weighted microscopic dust attaches to the net filter F2 since it flows with the air that passes the net filter F2 of the openings 64 without going straight through the passage 61 of the tubular filter 62. If the clogging of the net filter F2 caused by the attachment of the microscopic dust becomes larger, the amount of wind that goes through the net filter F2 reduces, but the negative pressure of the negative pressure room section 56 of the container case body 53 increases corresponding to the amount it reduced as well as the negative pressure within the dust collection room section 55 through the ventilation opening 59 of the top panel 58. Consequently, the wind velocity of the air that goes straight through the passage 61 of the tubular filter 62 becomes greater, therefore the amount of wind which goes straight increases. When the wind velocity that goes straight through the passage 61 of the tubular filter 62 become greater, the air that goes straight peels off the dust attached to the net filter 62.

By the way, the mesh opening (coarseness) S1 of mesh of the net filter F2 of the tubular filter 62 is set smaller than the mesh opening (coarseness) S2 of mesh the net filter F1. Consequently, the power increases, that is to say, the amount of wind sucking the dust to the dust collection room section 55 increases, therefore, the net filter F2 becomes hard to be clogged.

In addition, even if the amount of wind that passes through the net filter F2 is reduced by clogging, the amount of wind that the motor fan 33 sucks can be maintained constantly, because the amount of wind that goes straight through the passage 61 of the tubular filter 62 increases. Consequently, it is always possible to suck the dust by a predetermined sucking power irrespective of the clogging of the net filter F2.

Also, by the fact that the dust and the air are not separated by generation of spiral flow within the passage 61 of the tubular filter 62, the loss of air passage within the passage 61 becomes less. Furthermore, when the air is sucked from the passage 61 of the tubular filter 62 to the negative pressure room section 56 of the container case body 53 through the net filter F2, the flowing direction of air does not change significantly as shown by the arrow Q (see FIG. 3), since the suction opening 52, the tubular filter 62, the opening 51 of the container case body 53 and the intake opening 33A of the motor fan 33 are arranged in alignment, therefore it flows virtually linearly to the motor fan 33 to be sucked.

Consequently, the loss of air passage becomes even less, as a result, the performance of the motor fan 33 can be achieved sufficiently. Further, because the connection pipe 44 of the lid body 40 and the tubular filter 62 are arranged in a straight line, the direction of the air introduced to the suction opening 52 of the container case body 53 becomes in alignment with the tubular filter 62, therefore its loss of air passage (i.e., loss of an amount of air passing through) becomes even lesser.

As described above, the electric vacuum cleaner in the second embodiment of the present invention is comprised of the dust separation section 60 which is provided at the suction air passage leading from the suction opening 52 of the vacuum cleaner main body 20 to the intake vent (intake opening 33A) for separating the dust from the air sucked from the suction opening, and the dust collection section (dust collection room section 55) provided at the suction air passage for capture and collect the dust that are separated from the air at the dust separation section 60. Furthermore, the dust separation section 60 has the tubular filter 62, and the cross-sectional area of the air inflow opening (the suction opening 52 of the present embodiment acts as both the suction opening for the vacuum cleaner main body and the air inflow opening to the tubular filter 62) which compared to the tubular filter 62 is smaller than the cross-sectional area of the air exhaust end (the other end opening 62B) which is to the tubular filter 62. This relation is set by setting the diameter d of the suction opening 52 so as to become smaller than the diameter D2 of the other end opening 62B of the tubular filter 62, in the present embodiment.

According to the above mentioned structure, the dust that goes substantially straight by the inertia force caused when flowing from the suction opening 52 into the passage 61 does not hit the downstream end part of the tubular filter 62. By this structure, the clogging of the downstream end part of the net filter (filter tube section) F2 by the dust that flows and goes straight from the suction opening 52 into the passage 61 can be avoided.

Also, according to the electric vacuum cleaner described in the second embodiment of the present invention, the dust collection section (dust collection room section 55) has an exhaust opening (ventilation opening 59) which is communicated with the intake vent (intake opening 33A) of the motor fan 33. Further, the amount of wind Q1 that passes through the net filter F2 of the tubular filter 62 (without passing through the dust collection room section 55) is set less than the amount of wind Q2 that flows to the intake vent (intake opening 33A) of the motor fan 33 through the dust collection section (dust collection room section 55) and the exhaust opening (ventilation opening 59).

According to this structure, the separation rate of the dust inside of the tubular filter 62, that is, the ratio of within the dust that flows into the tubular filter 62 and that goes straight without flowing to the side of the mesh of the tubular filter 62 increases.

Furthermore, according to the electric vacuum cleaner described in the second embodiment of the present invention, a mesh shape filter (net filter F2) is used for the tubular filter 62, and an exhaust filter (net filter F1) in a mesh shape is attached to the exhaust opening (ventilation opening 59) and, the dimension of the opening S1 of the mesh of the tubular filter 62 is set smaller than the dimension of the opening S2 of mesh of the exhaust filter (net filter F1).

According to this structure, since the power rises, more specifically, since the amount of wind sucking the dust to the dust collection room (dust collection room section 55) becomes larger, the net filter F2 becomes hard to clog.

According to the invention as described above, the loss of air passage (i.e., loss in an amount of air passing through) can be made small, and the amount of wind does not decrease even if the dust accumulates, and the dust attached to a dust separation means which separates the dust from the air can be easily removed.

[Mode for Carrying Out the Invention 3]

Figure 14:
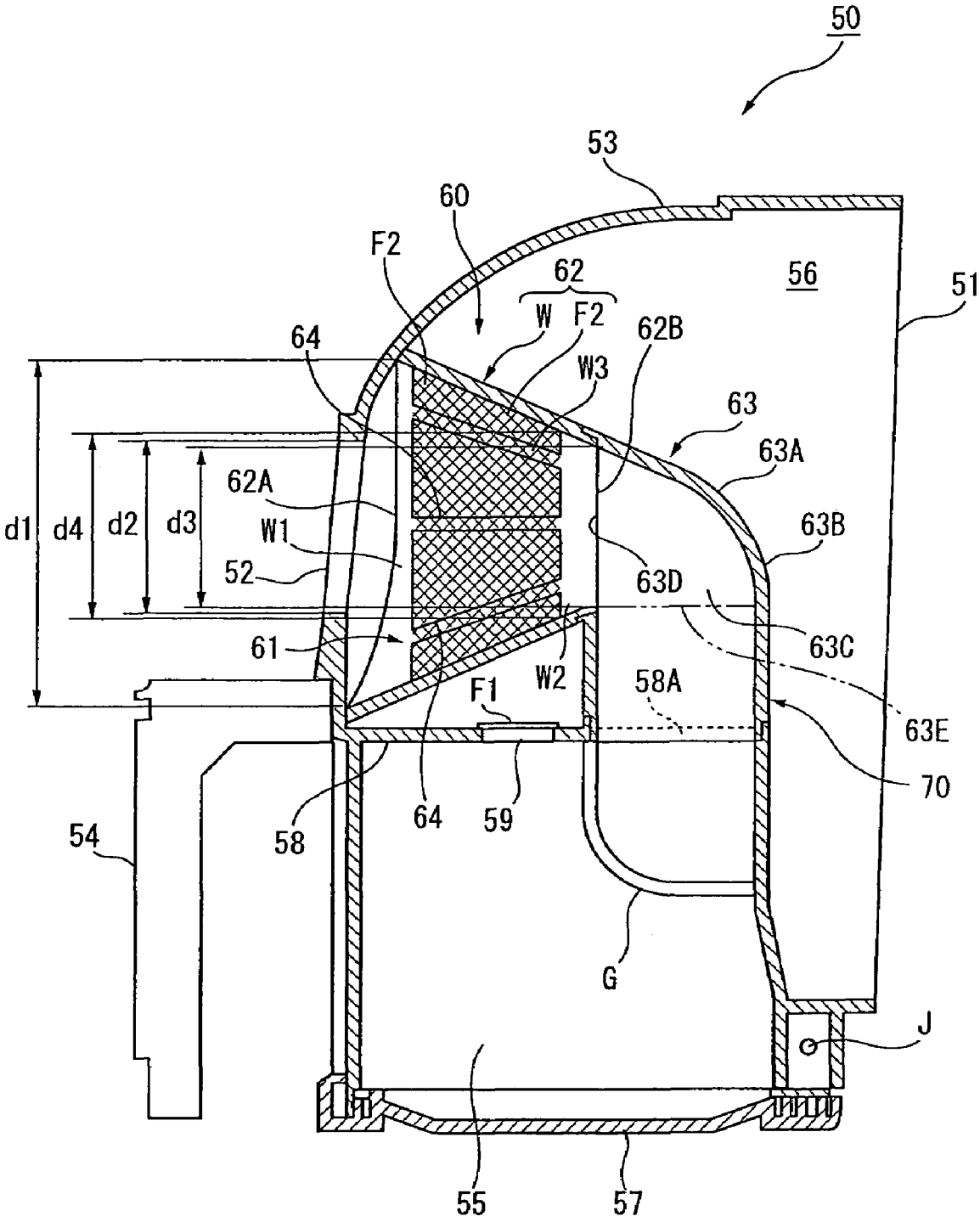
FIG. 14 is a partial sectional side view showing the vacuum cleaner main body of the electric vacuum cleaner of still other embodiment of the present invention.
Figure 15:
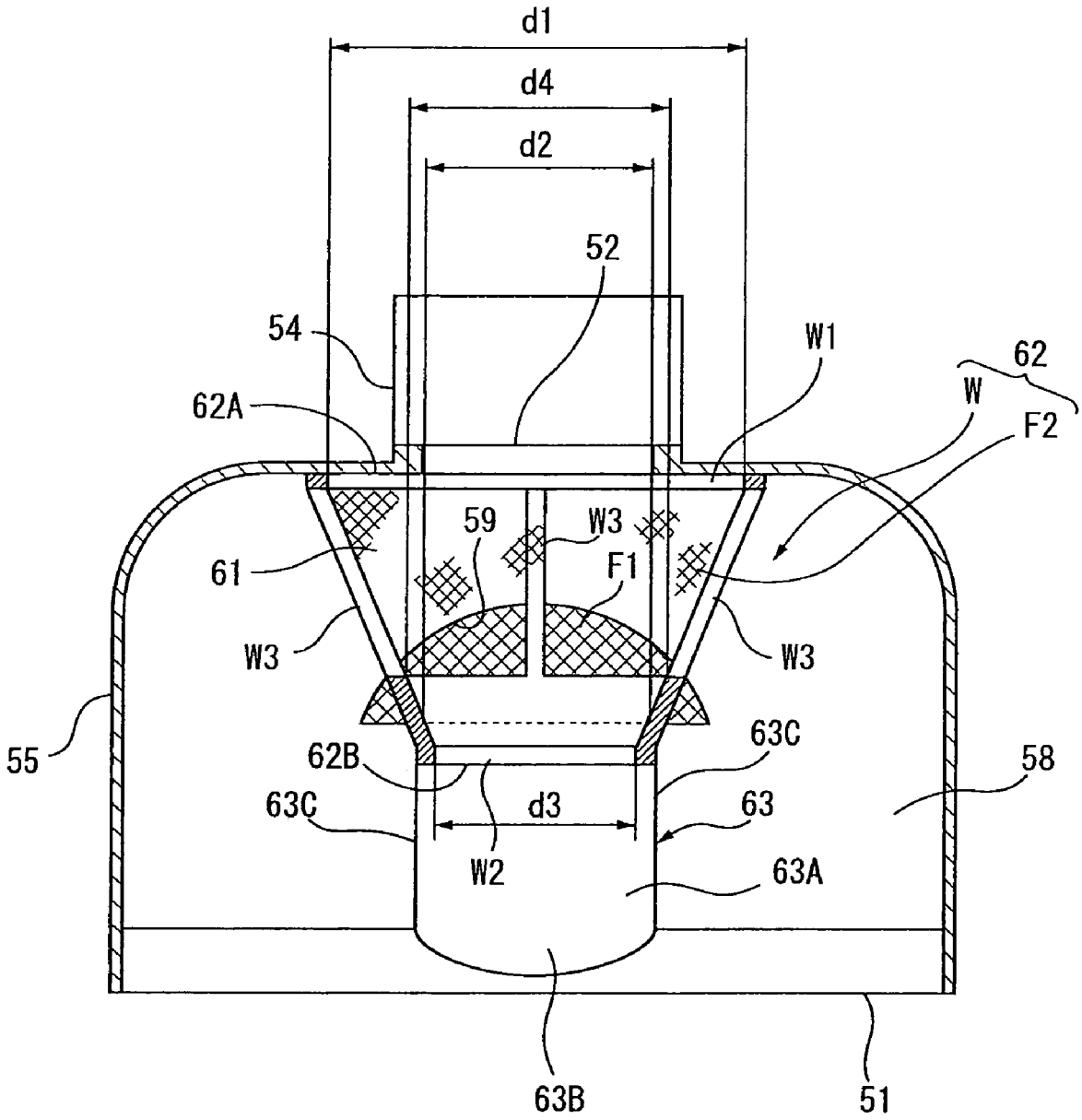
FIG. 15 is a partial horizontal sectional view showing the dust collection case and a tubular filter in FIG. 14.

FIGS. 14 and 15 show an electric vacuum cleaner corresponding to the third embodiment of the present invention. The same reference numbers indicated in FIGS. 1-8 are given for the parts identical or resembles to the composition of the embodiment shown in FIGS. 1-8, and their descriptions are omitted.

The dust separation section 60 in the third embodiment of the present invention has, as mentioned above, the tubular filter 62 forming the passage 61 which is in a tubular shape and the strike member (tubular body) provided with the strike section 63 which is provided at the other end opening 62B of the tubular filter 62. As shown in FIGS. 14 and 15, a diameter d1 of the one end opening 62A of the tubular filter 62 is formed larger than a diameter d2 of the suction opening (air inflow opening) 52 of the container case body 53, and a diameter d3 of the other end opening 62B of the tubular filter 62 is formed smaller than the diameter d2 of its suction opening 52.

Here, when the air containing the dust flows and enters in the tubular filter 62 from the suction opening 52, the air containing the dust flows to the direction of the one end opening 62B from the one end opening 62A of the tubular filter 62, therefore the one end opening 62A of the tubular filter 62 becomes as the upstream end, and the other end opening 62B becomes as the downstream end in consideration of the flow of air. In addition, the one end opening 62A (upstream end) of the tubular filter 62 is closely contacted or fixed to the rear side of the front wall 53*a* of the container case body 53 in a periphery of the suction opening (air inflow opening) 52. Thereby the suction opening 52 of the container case body 53 and the one end opening 62A are each connected so as to set the suction opening 52 at a position which is inside of the one end opening 62A.

Also, the diameter of the tubular filter 62 gradually decreases as going linearly to the other end (downstream end) from the one end (upstream end). In other words, the diameter of the tubular filter 62 of the dust separation section 60 is adapted to be gradually diminished in the circular cone shape (taper tube shape) as going to the downstream end.

Furthermore, the passage 61 of the tubular filter 62 extends linearly in the longitudinal direction, and the connection pipe 44 of the lid body 40, the suction opening 52 of the container case body 53, the tubular filter 62, the opening 51 of the container case body 53 and the intake opening 33A of the motor fan 33 are arranged in alignment.

Also, the tubular filter 62 has the tubular frame W which is provided with the plurality of openings 64 and the net filter (mesh shaped filter, filter tube section) F2 which is in the tubular shape and in the mesh shape that is attached to the inner peripheral side of the tubular frame W. The tubular frame W has the frame section W1 in the circular shape (round shape) which is forming the one end opening 62A, the frame section W2 which is in the round shape and in the tubular shape (circular shape) that is forming the other end opening 62B, and the plurality of frame sections W3 (rib shaped frame section) in a rib shape which connect the frame sections W1 and W2. By the way, the spaces surrounded by each frame sections W1-W3 are the openings 64. The openings 64 are equally provided throughout the entire circumference of the tubular filter 62. In addition, the passage 61 is formed and surrounded by the frame sections W1-W3 and the net filter F2.

Moreover, the net filter F2 is adapted to be as a filter tube section formed in a tubular shape along the inner periphery of the tubular frame W, and is attached to the tubular frame W by adhesion or fusion bonding for example in such a manner as to cover the plurality of openings 64. Also, the frame section W2 of the tubular frame W is formed in a wide range and is adapted to be a non-mesh tube section. In the frame section W2 as the non-mesh tube section, a diameter d4 of the up stream end is formed larger than the diameter d2 of the suction opening (air inflow opening) 52, and the diameter of the downstream end d3 is formed smaller than the diameter d2 of the suction opening (air inflow opening) 52. By this, a periphery of the suction opening 52 corresponds with an intermediate part of the frame section W2 in an air passage direction, and the dust at a periphery within the dust in the air that flows-in from the suction opening 52 to the passage 61 is adapted to be moved toward the frame section W2 by the inertia force caused when flowing in. By the way, the suction opening 52, the one end opening 62A and the other end opening 62B are formed substantially concentric.

In the net filter F2, the coarseness of mesh of the mesh shape, that is, the opening of the mesh (net) is formed gradually or step-by-step smaller as going from the up stream side to the down stream side of the passage 61. For example, in the net filter F2, the coarseness of the mesh of the mesh shape, that is, the opening of the mesh or net is formed gradually or step by step smaller between 110 μm-30 μm as going from the up stream side to the down stream side of the passage 61.

Furthermore, a metallic coating layer formed on the surface of the mesh shape resin fiber by the sputtering is used for the net filter F2, therefore the net filter F2 is made to provide extremely easy slippage so as to avoid the attachment of the dust.

[Operation]

Next, the operation of the electric vacuum cleaner constituted as above will be described hereinafter.

As mentioned above, the dust on a cleaning surface is sucked with the air in the passage 61 of the tubular filter 62 of the dust separation section 60 by activating the motor fan 33. The air that is sucked to the passage 61 is sucked to the negative pressure room section 56 of the container case body 53 through the net filter F2 of the openings 64 of the tubular filter 62, and is further sucked by the intake opening 33A of the motor fan 33 through the filter 80 loaded at the opening 51 of the container case body 53. On this occasion, the microscopic dust which passed through the net filter F2 is captured by the filter 80.

Meanwhile, because the passage 61 extends linearly to the longitudinal direction, the dust that is sucked to the passage 61 of the tubular filter 62 and has more weight than predetermined weight goes straight through the passage 61 and hits to the strike wall section 63B of the strike section 63.

On this occasion, within the dust that is flown from the suction opening 52 and within them at a periphery area, and the dust that goes substantially straight by the inertia force caused when flowing in from the suction opening 52 into the passage 61 has a large inertia energy. Consequently, when the dust that flows in from the suction opening 52 and within them at the periphery area and the one that goes substantially straight by the inertia force caused when flowing into the passage 61 from the suction opening 52 hits the downstream end part of the net filter (filter tube section) F2, the mesh (mesh opening) of the downstream end part of the filter F2 becomes clogged by the inertia energy and thereby permeability loses, and the recovery of the permeability cannot be expected.

But in the present embodiment, because within the dust that is flown from the suction opening 52 and within them at the periphery area, and the one that goes substantially straight by the inertia force caused when flowing into the passage 61 from the suction opening 52 hits the strike wall section 63B of the strike section 63 after hitting the frame section W2 as the non-mesh section without hitting the downstream end part of the filter F2, the clogging at the downstream end part of the net filter (filter tube section) F2 can be reduced. The dust that struck the strike wall section 63B is introduced inside of the dust collection room section 55 by the guide pipe 70. In this manner, the air and the dust are separated by means of the dust separation section 60.

Also, some of the air is adapted to be introduced inside of the dust collection room section 55 through the strike section 63 and the guide pipe 70, and the introduced air turns to spiral flow by the guide wall G of the dust collection room section 55, and the dust that is introduced inside of the dust collection room section 55 is adapted to be accumulated as it is compressed by spiral flow.

The air that is introduced inside of the dust collection room section 55 becomes spiral flow by the guide wall G of dust collection room section 55, and adapted to accumulate the dust introduced inside of the dust collection room section 55 to the bottom side of dust collection room section 55 as the air compresses the dust. Then, the air percolates the ventilation opening 59 of the top panel 58 of the dust collection room section 55 and the net filter F1, and sucked to the negative pressure room section 56 of the container case body 53.

On this occasion, the microscopic dust which passed through the net filter F1 is sucked together with the air to the negative pressure room section 56. In addition, the air that is sucked to the negative pressure room section 56 is furthermore sucked by the intake opening 33A of the motor fan 33 through the filter 80 which is loaded at the opening 51 of the container case body 53. The microscopic dust that passed through the net filter F1 is captured by the filter 80 at this time.

In this manner, the air exhausted through the openings 64, and the air exhausted through the ventilation opening 59 are converged together at the negative pressure room section 56. Further, the converged air is sucked by the intake opening 33A of the motor fan 33 through the filter 80 which is loaded at the opening 51 of the container case body 53. As stated above, the microscopic dust which passed through the net filters F1 and F2 is captured by the filter 80.

Because the light weight microscopic dust flows with the air that passes the net filter F2 of the openings 64 without going straight through the passage 61 of the tubular filter 62, it attaches to the net filter F2. In addition, if the clogging of the net filter F2 caused by the attachment of the microscopic dust becomes larger, the amount of wind that goes through the net filter F2 reduces, but the negative pressure of the negative pressure room section 56 of the container case body 53 increases corresponding to the amount it reduced as well as the negative pressure within the dust collection room section 55 through the ventilation opening 59 of the top panel 58. Consequently, the wind velocity of the air going straight through the passage 61 of the tubular filter 62 becomes greater, and the amount of wind which goes straight increases. When the wind velocity that goes straight through the passage 61 of the tubular filter 62 become greater, the air that goes straight peels off the dust attached to the net filter F2.

As stated, the wind (air) contains the microscopic and relatively light dust, and this light dust is adapted to be captured by the net filter F2. It is in such a state that it can easily be peeled off since the inertia energy of the light dust is less and therefore it will not hit the mesh (net) of the net filter F2 strongly. Also, within the dust contained in the wind (air), although the dust that is flown from the suction opening 52 to the passage 61 and within them at the periphery area and the one that goes substantially straight by the inertia force caused when flowing in from the suction opening 52 into the passage 61 has the large inertia energy, this dust hits the wide ranged frame section (non-mesh section) W2 without hitting the net filter F2, therefore the cause for the clogging of the mesh (net) of the net filter F2 can be evaded.

Therefore, when the dust captured by the net filter F2 reaches a predetermined amount, it is peeled off easily from the net filter F2 by the sucked air that is sucked to the passage 61, and the dust peeled from the net filter F2 is adapted to be introduced and accumulated in the dust collection room section 55 through the strike section 63 and the guide pipe 70.

Furthermore, because the diameter of the tubular shaped net filter F2 is gradually decreased as going linearly from the upstream end to the downstream end, the wind that goes to the side of the mesh (net) of the net filter F2 without going straight through the passage 61 in the net filter F2 becomes easier to attach entire surfaces of the net filter F2 equally. Moreover, this wind (air) contains the relatively light dust, and this light dust hits the entire surfaces of the net filter F2 equally and is adapted to be captured by the net filter F2. It is in such a circumstance that the light dust can easily be peeled off since the light dust has the less inertia energy and therefore it will not break into the mesh (net) of the net filter F2 strongly.

In addition, even if the amount of wind that passes through the net filter F2 is reduced by the clogging, the amount of wind that the motor fan 33 sucks can be maintained constantly because the amount of wind goes straight through the passage 61 of the tubular filter 62 increases. Consequently, it is always possible to suck the dust by a predetermined sucking power regardless of the clogging in the net filter F2.

Also, by the fact that the dust and the air are not separated by generation of spiral flow within the passage 61 of the tubular filter 62, the loss of air passage (i.e., loss in an amount of air passing through) within the passage 61 becomes less. Furthermore, when the air is sucked from the passage 61 of the tubular filter 62 to the negative pressure room section 56 of the container case body 53 through the net filter F2, the direction of the airflow does not change significantly as shown by the arrow Q (see FIG. 3), because the suction opening 52, the tubular filter 62, the opening 51 of the container case body 53 and the intake opening 33A of the motor fan 33 are arranged in alignment, therefore flows virtually linearly to the motor fan 33 to be sucked.

Consequently, the loss of air passage (i.e., loss in an amount of air passing through) becomes even less, and the performance of the motor fan 33 is improved. Further, because the connection pipe 44 of the lid body 40 and the tubular filter 62 are arranged in a straight line, the direction of the air introduced to the suction opening 52 of the container case body 53 becomes in alignment with the extending direction the tubular filter 62, therefore its loss of air passage (i.e., loss in an amount of air passing through) becomes evenlesser.

As described above, the electric vacuum cleaner in the third embodiment of the present invention comprises the dust separation section 60 provided at the suction air passage leading from the suction opening 52 of the vacuum cleaner main body 20 to an intake vent (opening 34A) of the motor fan 33 for separating the dust from the air sucked to the suction opening 52, and the dust collection section (dust collection room section 55) provided at the suction air passage for capturing and collecting the dust separated from the air at the dust separation section 60. Furthermore, the dust separation section 60 has the filter tube section (net filter F2) in a mesh shape which is located at the upstream side and the non-mesh tube section (frame section W2) which is communicated with the lower stream end of the filter tube section (net filter F2).

According to this structure, the light dust that flows into the filter tube section (net filter F2) is captured by the filter tube section (net filter F2). It is in such a state that the light dust can easily be peeled off since the inertia energy of the light dust is less and therefore it will not break strongly into the mesh (net) of the filter tube section. Also, within the dust contained in the wind (air), although the dust that is flown from the suction opening 52 to the passage 61 and within them at the periphery area and the one that goes substantially straight by the inertia force caused when flowing from the suction opening 52 into the passage 61 which is inside of the filter tube section has the large inertia energy, this dust hits the wide ranged non-mesh section (frame section W2) without hitting the net filter F2, therefore the cause for clogging of the mesh (net) of the filter tube section (net filter F2) can be evaded.

In the embodiment described above, although the tubular filter 62 and the filter tube section (net filter F2) are formed in a circular cone shape, that have their diameters which diminish gradually as going to the direction of the down stream side, it is possible to form the tubular filter 62 and the filter tube section (net filter F2) in the tubular shape which has substantially the same diameter from the upstream end to the downstream end. As well as in this case, when the dust that flows into the filter tube section, and within them at the periphery part that goes substantially straight hits the downstream end part of the filter tube section, there is likely to cause that the dust which has caused the clogging cannot be peeled off easily by the clogging of the downstream end part of the filter tube section. Therefore, as well as in this case, the cause for the clogging of the mesh (net) of the filter tube section (net filter F2) can be evaded as similar to the filter tube section which is in the circular cone shape, by providing the part where the dust flows into the filter tube section and within them at the periphery part that goes substantially straight hits the filter tube section as the non-mesh section.

Also in the third embodiment of the present invention, the dust separation section 60 is formed in the circular cone shape that diminishes its diameter gradually as going to the downstream direction. According to this structure, because the diameter of the filter tube section (net filter F2) is gradually decreased as going linearly from the upstream end to the downstream end, the wind that goes to the side of the mesh (net) of the filter tube section (net filter F2) without going straight through the passage 61 in the filter tube section becomes easier to attach the entire surfaces of the filter tube section (net filter F2) equally. Moreover, this wind (air) contains the relatively light dust, and this light dust hits the entire surfaces of the filter tube section (net filter F2) equally and is adapted to be captured by the net filter F2. It is in such a circumstance that the light dust can easily be peeled off since the light dust has less inertia energy and therefore it will not break into the mesh (net) of the net filter F2 strongly.

In addition, in the third embodiment of the present invention, the filter tube section (net filter F2) and the non-mesh tube section (frame section W2) are constituting the tubular filter 62 and the diameter d1 of the side of the air inflow opening (one end opening 62A) of the tubular filter 62 is formed larger than the diameter d2 of the air inflow opening (suction opening 52), and the diameter d3 of the downstream end (other end opening 62B) of the tubular filter 62 is formed smaller in diameter than the diameter d2 of the air inflow opening (suction opening 52) and the diameter d4 of the upstream end of the non-mesh tube section (frame section W2) is formed larger than the diameter d2 of the air inflow opening (suction opening 52).

According to this structure, the light dust that flows into the filter tube section (net filter F2) is captured by means of the filter tube section (net filter F2). It is in such a state that the light dust can easily be peeled off since the inertia energy of the light dust is less and therefore it will not break strongly into the mesh (net) of the filter tube section. Also, within the dust contained in the wind (air), although the dust that is flown from the suction opening 52 to the passage 61 and within them at the periphery area and the one that goes substantially straight by the inertia force caused when flowing out from the suction opening 52 into the passage 61 which is inside of the filter tube section has the large inertia energy, this dust hits the wide ranged non-mesh section (frame section W2) without hitting the net filter F2, therefore the cause for the clogging of the mesh (net) of the filter tube section (net filter F2) can be evaded.

As described above, according to this invention, the loss of air passage can be made small and the amount of wind does not decrease even if the dust accumulates, and the dust attached to the dust separating means which is for separating the dust from the air can be easily removed.

[Mode for Carrying Out the Invention 4]

Figure 16:
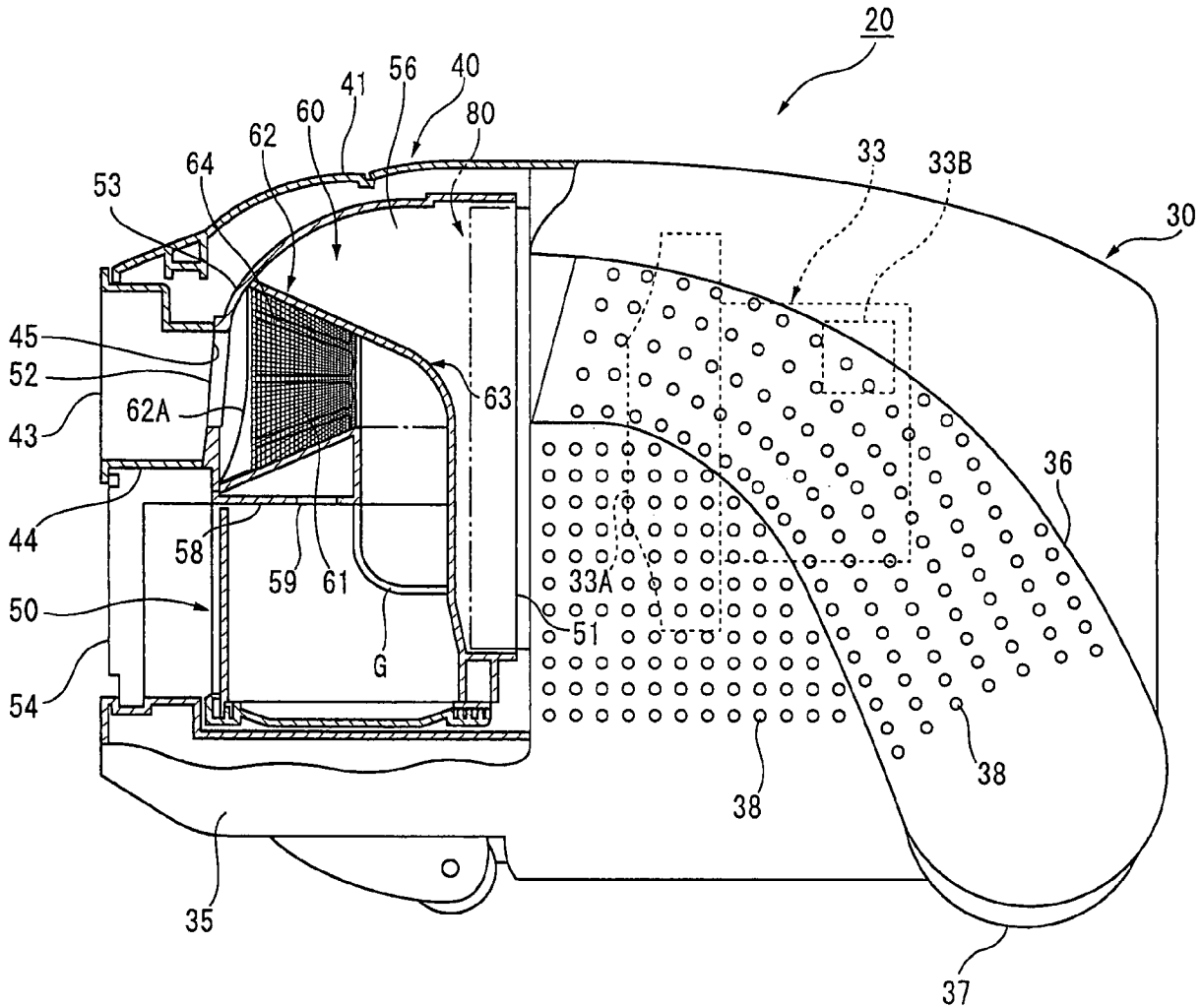
FIG. 16 is a partial sectional side view showing the vacuum cleaner main body of the electric vacuum cleaner of still other embodiment of the present invention.
Figure 17:
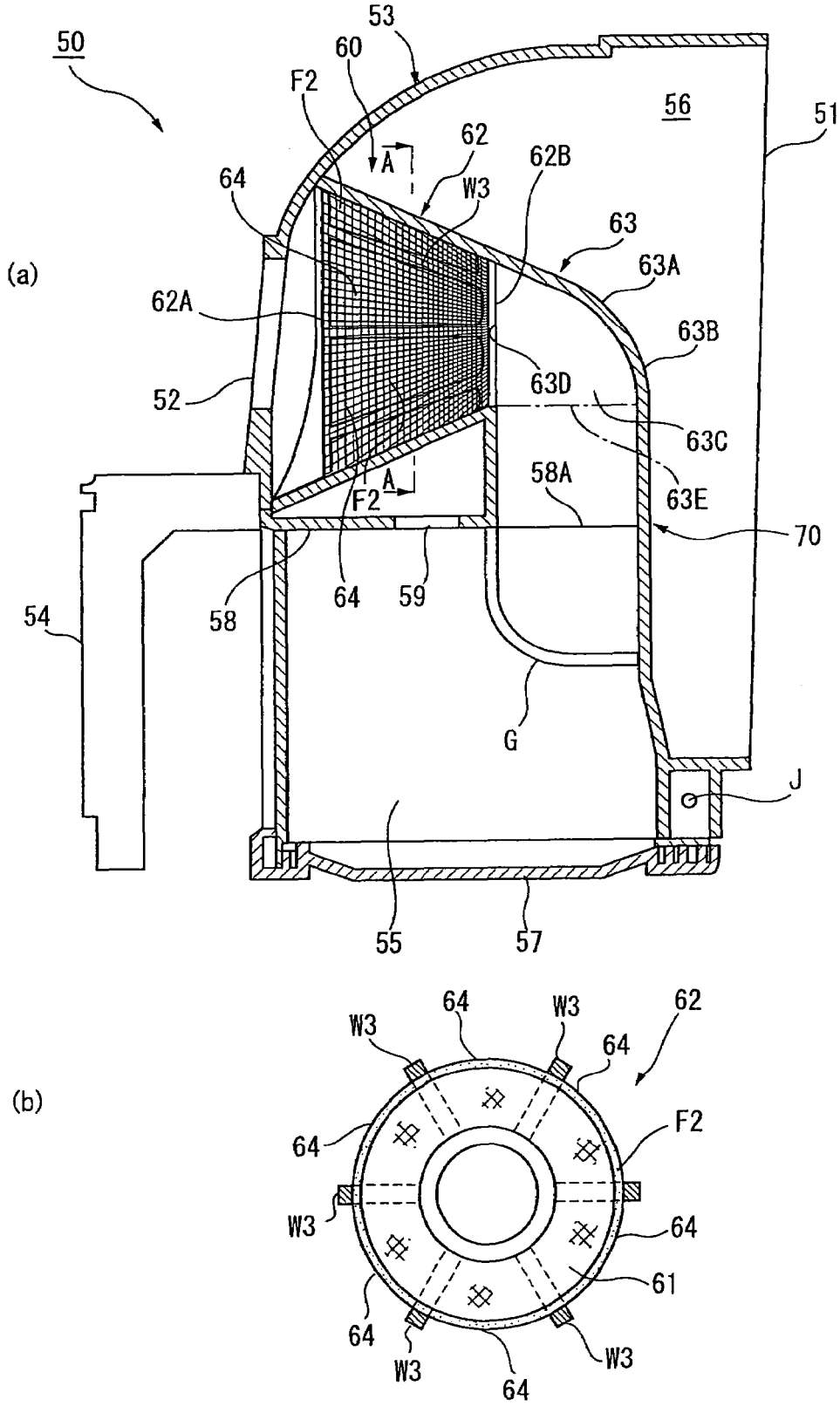
FIG. 17(*a*) is an enlarged sectional view showing the dust collection case in FIG. 10.
Figure 18:
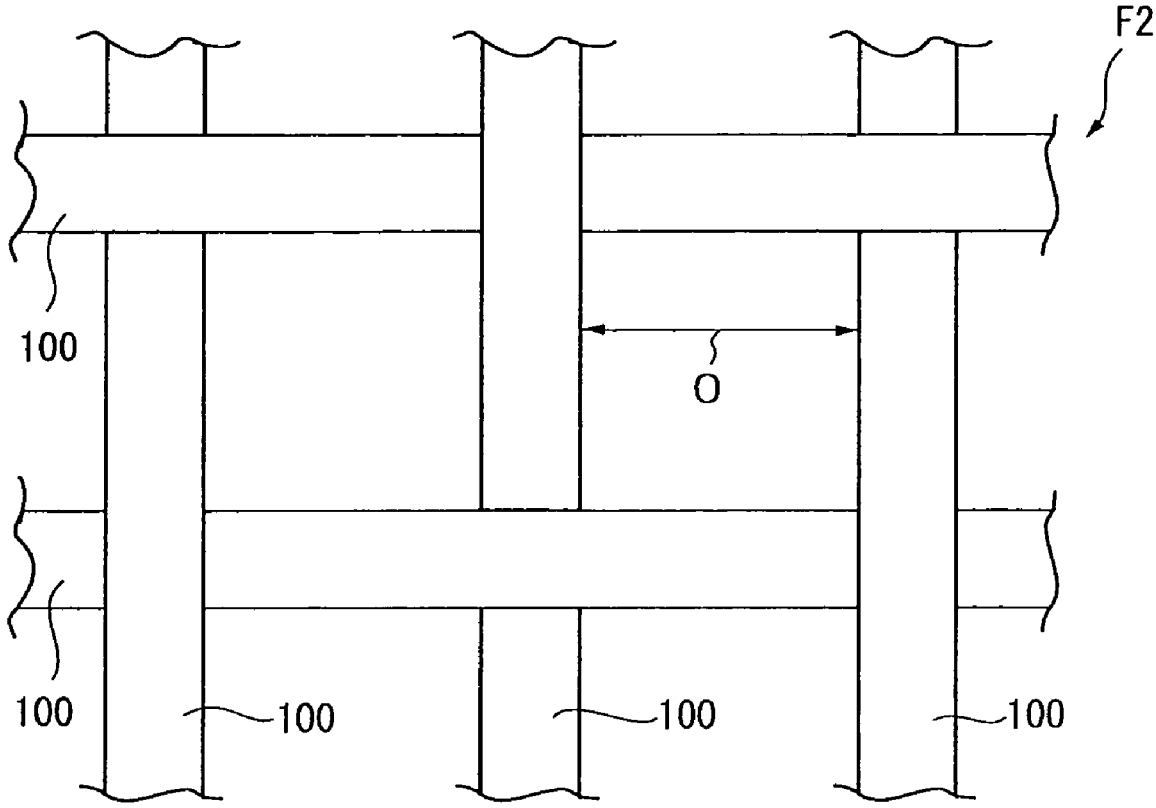
FIG. 18 is an explanatory view showing a part of a mesh shaped net filter in FIGS. 16 and 17 by enlarging.

FIGS. 16-18 show an electric vacuum cleaner corresponding to the third embodiment of the present invention. The same reference numbers indicated in FIGS. 1-8 are given for the parts identical or resembles to the composition of the embodiment shown in FIGS. 1-8, and their descriptions are omitted.

As mentioned above, the tubular filter 62 has the frame sections W1 and W2 which are in the round shape, the plurality of frame sections W3 in stick shape which connect the frame sections W1 and W2, and the filter F2 in the mesh shape provided at the plurality of openings 64 which are formed by the each frame sections W1-W3 (see FIG. 17(*a*))

The openings 64 are provided equally throughout the entire circumference at the peripheral wall of the passage 61, and the passage 61 is formed and surrounded by the frame sections W3 and the filter F2.

The filter F2 in the mesh shape stands for a filter formed by braiding fine threads in the mesh shape, and a large numbers of threads 100 are braided in such a manner that are folded mutually as shown in FIG. 18. The filter F2 is formed in the tubular shape in such a manner as to surround the plurality of openings 64 integrally, and is provided at inner surface of the plurality of frame sections W3 which the frame sections W1 and W2 are connected (see FIG. 17(*b*)).

In addition, an opening O of the filter F2 is formed so that it becomes gradually finer within the range of 110 μm to 30 μm as going from the upstream side of the passage 61 to the downstream side of the passage 61, and the coarseness of mesh of the filter F2 becomes gradually finer. In addition, here, the opening O of the filter F2 which is proximity to a part contacted with the frame section W1 is at least 110 μm, and the opening O of the filter F2 which is proximity to a part contacted with the frame section W2 is 30 μm.

Here, the "upstream side" stands for the side that the air is sucked and flows-in when the motor fan 33 is activated, more specifically, the side of the suction opening 52 of the container case body 53. The "downstream side" stands for the side that the air is sucked and flows out when the motor fan 33 is activated, more specifically, the side of the intake opening 33A of the motor fan 33. Furthermore, the opening O stands for the mesh aperture, that is, a width between the thread 100 and the thread 100 (see FIG. 18).

Here at, the surface finishing is applied onto the filter F2 for reducing the friction resistance. For the surface finishing, there are, for example, the sputtering process, the fluoric coating and Teflon (registered trademark) coating.

Next, an operation of the electric vacuum cleaner constituted as above will be described hereinafter.

As mentioned above, the dust on a cleaning surface is sucked with the air in the passage 61 of the tubular filter 62 of the dust separation section 60 by activating the motor fan 33. The air sucked to the passage 61 is sucked to the negative pressure room section 56 of the container case body 53 through the net filter F2 of the openings 64 of the tubular filter 62, and further sucked by the intake opening 33A of the motor fan 33 through the filter 80 loaded at the opening 51 of the container case body 53.

Also, some of the air is adapted to be introduced inside of the dust collection room section 55 through the strike section 63 and the guide pipe 70, and introduced air turns into spiral flow by the guide wall G of the dust collection room section 55, then flows into the negative pressure room section 56 through the ventilation opening 59.

On the other hand, the dust that is sucked to the passage 61 of the tubular filter 62 and that has more weight than a predetermined weight goes straight through the passage 61 by an action of the inertia force because the passage 61 extends linearly to the longitudinal direction, and hits to the strike wall section 63B of the strike section 63, then introduced inside of the dust collection room section 55 by the guide pipe 70. Then, the dust introduced inside of the dust collection room section 55 is adapted to be accumulated as it is compressed by the spiral flow of the air that likewise flows into the dust collection room section 55.

Furthermore, the dust that is microscopic and light in weight sucked to the passage 61 of the tubular filter 62 flows with the air that passes the openings 64 without going straight through the passage 61.

As just described, the dust and the air are separated by means of the dust collection room section 60.

Here, as the mesh shaped filter F2 is provided at the openings 64 which is located at the peripheral wall of the passage 61, even if the dust flows with the air that passes the openings 64, the dust can be captured by means of the filter F2. In addition, it becomes capable of separating the air and the dust efficiently.

Also, even if the dust is lifted into the air again by the spiral flow generated when introduced into the dust collection room section 55, the air and the dust are each separated by the net filter F1 provided at the ventilation opening 59 and the filter F2 provided at the openings 64, therefore an efficiency in separation can be enhanced.

In addition, as the wind velocity at the upstream side of the passage 61 is fast and therefore the dust goes relatively straight, the opening O of the filter F2 can be created larger. Here, because the opening O is formed in such that it becomes finer as going from the side of the suction opening 52 as the upstream side of the passage 61 to the side of the intake opening 33A as the downstream side of the passage 61, the opening O of the filter F2 is coarse at the side of the suction opening 52, therefore the permeability at the side of the suction opening 52 of the passage 61 improves and efficiency in suction of air can be improved.

Meanwhile, it is difficult for the dust to go relatively straight due to the deterioration in the wind velocity at the side of the intake opening 33A which is the downstream side of the passage 61. But in the opening O of the filter F2, the side of the intake opening 33A of the passage 61 is formed fine and can capture the fine dust that flows with the air unfailingly without allowing it to pass. Also, because the opening O is fine and so that a friction is large, therefore the permeability at the side of the intake opening 33A can be suppressed and it is possible to make the fine dust difficult to flow.

Furthermore, because the opening O of this filter F2 is adapted to be finer as going to the direction from the upstream side of the passage 61 to the downstream side, the flow of air passing the passage 61 becomes smoother and the clogging of the filter F2 can be made difficult to occur.

Like stated, the electric vacuum cleaner in the present invention has the dust separation section 60 provided in the air passage which is leading from the suction opening 52 of the vacuum cleaner main body 20 to the intake opening 33A of the motor fan 33 for separating the dust from the air that are sucked together from the suction opening 52, and a dust collection room section (dust collection section) 55 provided in the air passage for collecting the dust that are separated by the dust separation section 60. In addition, the dust separation section 60 has the one end opening 62A that is communicated with the suction opening 52 and the tubular shaped passage (air passage) 61 which the other end opening 62B is communicated with the dust collection room section 55, and the openings 64 which are provided at the peripheral wall of the passage 61. Furthermore, the mesh shape filter F2 is provided at the openings 64.

By this structure, it is possible to separate the dust and the air without generating spiral flow at inside of the passage 61 of the tubular filter 62 which is the dust separation section 60. Therefore, the separation can be done in efficient manner and the improvement of separating efficiency can be made. Also, by this structure, the deterioration in sucking efficiency can be avoided as the loss of air passage within the passage 61 becomes small.

Additionally, the fine dust can be captured by the mesh shaped filter F2 which is provided at the openings 64 when the dust and the separated air pass from the passage 61 of the tubular filter 62 to the openings 64 and sucked to the negative pressure room section 56 of the container case body 53.

Furthermore, because the opening O of the filter F2 is made finer as going from the upstream side to the downstream side of the passage 61, a sufficient permeability can be obtained at the upstream side of passage 61 and the deterioration in the sucking efficiency can be avoided. In addition, the fine dust can be unfailingly captured at the downstream side of the passage 61 and it is possible to separate the dust and the air in efficient manner as well as it is possible to separate the dust and the air sufficiently.

Additionally, because the size of the opening O of the filter F2 is formed within the range of 110 μm to 30 μm, the opening O at maximum becomes 110 μm, therefore it is possible to obtain enough permeability in an extent that the dust sucked inside of the passage 61 does not closely contact with the filter F2. Furthermore, the opening O at minimum becomes 30 μm, therefore it is possible to obtain a necessary permeability while capable of unfailingly capturing the fine dust which is flowing with the air, therefore it is possible to improve the separating efficiency.

Also, because the surface finishing for reducing the friction resistance is applied on the surface of filter F2, the dust becomes difficult to be hooked at the surface of filter F2 and the occurrence of the early clogging can be avoided.

Particularly, when the surface finishing is the sputtering process, clogging can be avoided even more as metallic atoms are equally attached on the surface of filter F2 and the friction resistance can be reduced exceedingly.

By the way, because the filter F2 is provided at the inner surface of the frame sections W3, the circumstance that the dust sticks on the frame sections W3 can be avoided, and clogging being difficult to occur.

As described above, according to the electric vacuum cleaner of the present invention, it is possible to improve the separating efficiency by separating the dust and the air efficiently.

[Mode for Carrying Out the Invention 5]

As described above, although one embodiment relating to the present invention has been described with reference to the accompanying drawings, the present invention is not limited to the specific embodiments as described above, the modifications of design or the like are included in the present invention without departing from the scope of the present invention.

Figure 19:
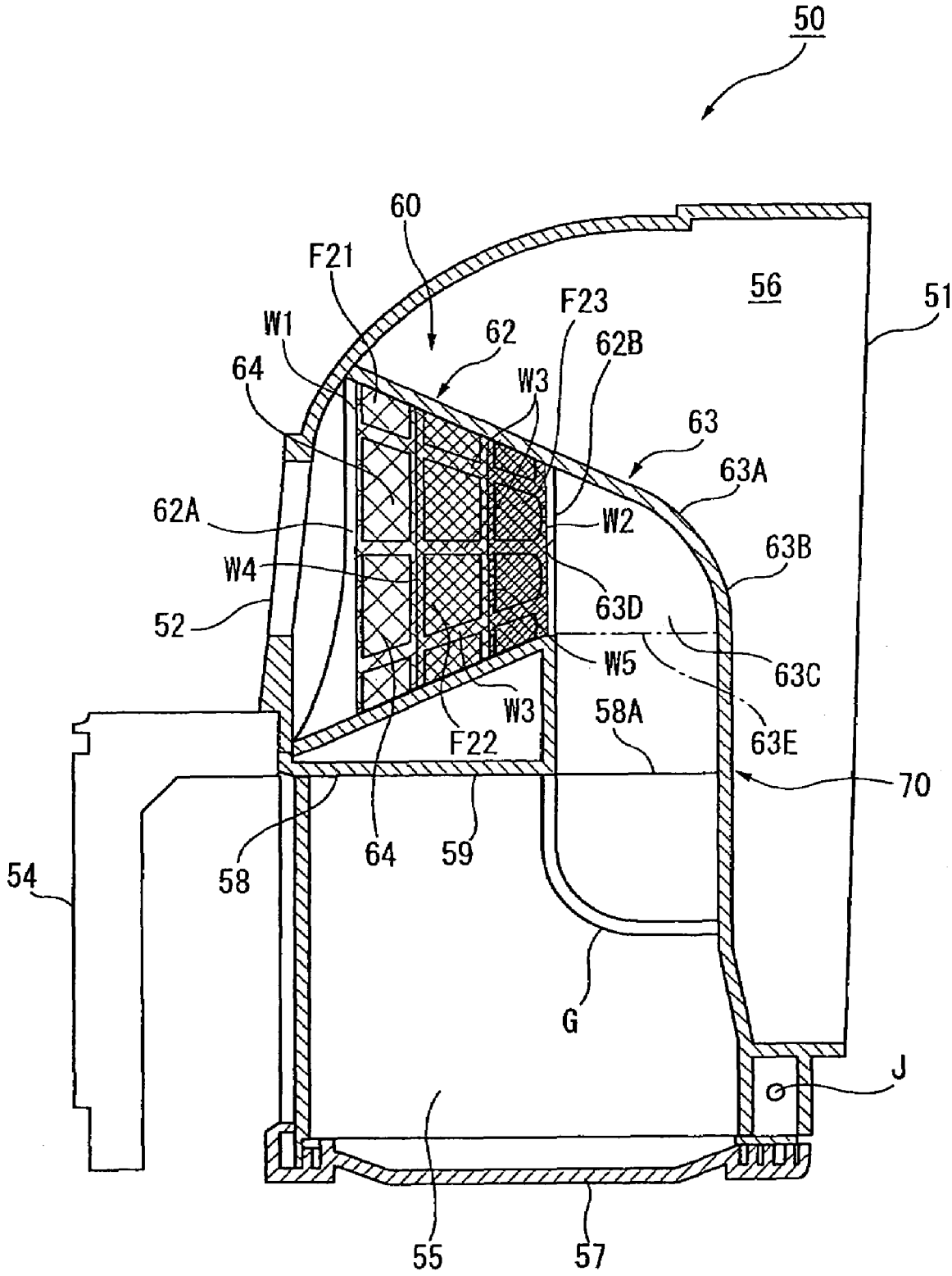
FIG. 19 is an enlarged sectional view showing the dust collection case of still other embodiment of the present invention.

For example, in the embodiment mentioned above, although the opening O of the mesh shaped filter F2 is formed gradually finer as going from the suction opening 52 side to the intake opening 33A side, it may be also recommendable to set the opening O finer in step-by-step way as shown in FIG. 19.

In this instance, for example, at first, separate between the frame section W1 and the frame section W2 with intermediate frame sections W4 and W5, and provide a filter F21 which has the opening O of for example, 110 μm between the frame section W1 and the intermediate frame section W4, and a filter F22 which has the opening O of for example, 70 μm from the intermediate frame section W4 to the intermediate frame section W5, and a filter F23 which has the opening O of for example 30 μm between the intermediate frame section W5 and the frame section W2. By this, it becomes easier to constitute the filter so as to make the opening O finer in the step-by-step way. As well as in this case, it is possible to avoid the dust to be stuck to the frame sections W3-W5 by providing each filter F21-F23 to inner surface of the frame sections W3,W4 and W5.

As mentioned above, according to the electric vacuum cleaner in the present invention, it is possible to improve the separating efficiency by separating the dust and the air efficiently.

[Mode for Carrying Out the Invention 6]

FIGS. 20-23 show an electric vacuum cleaner corresponding to the third embodiment of the present invention. The same reference numbers indicated in FIGS. 1-8 are given for the parts identical or resembles to the structure of the embodiment shown in FIGS. 1-8, and their descriptions are omitted.

Figure 20:
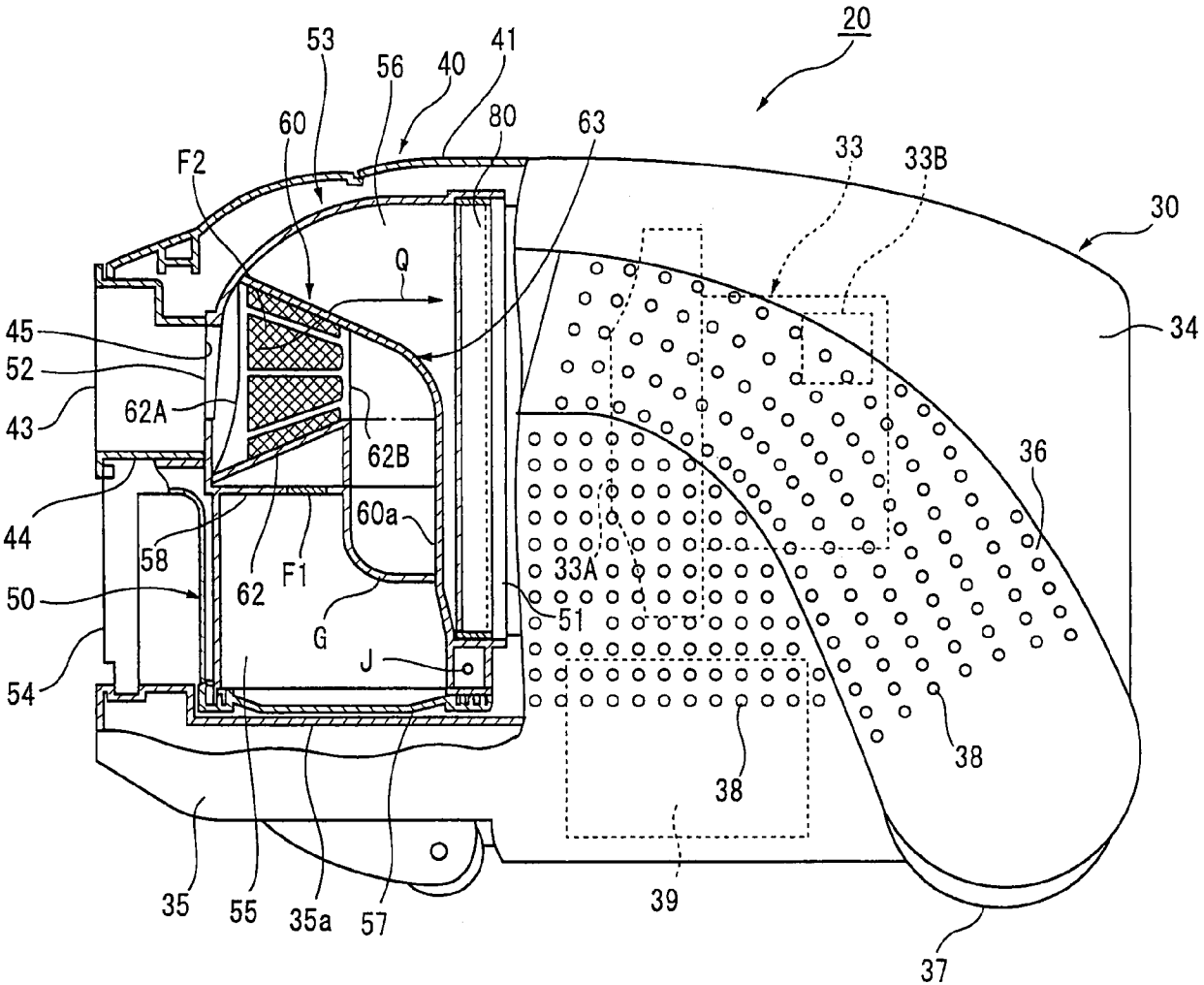
FIG. 20 is a partial sectional side view showing the vacuum cleaner main body of the electric vacuum cleaner of still other embodiment of the present invention.

In the motor-driven section 34 of the main body case 30, a battery 39 is loaded at a down side of the motor fan 33 as shown in FIG. 20. The battery 39 provides electric power to the motor fan 33. Additionally, it is possible to provide the electric power of a commercial alternating current to the motor fan 33 or the like through a cord reel by substituting the battery 39 shown in the figure with the cord reel and arranging the cord reel at the same part.

Figure 21:
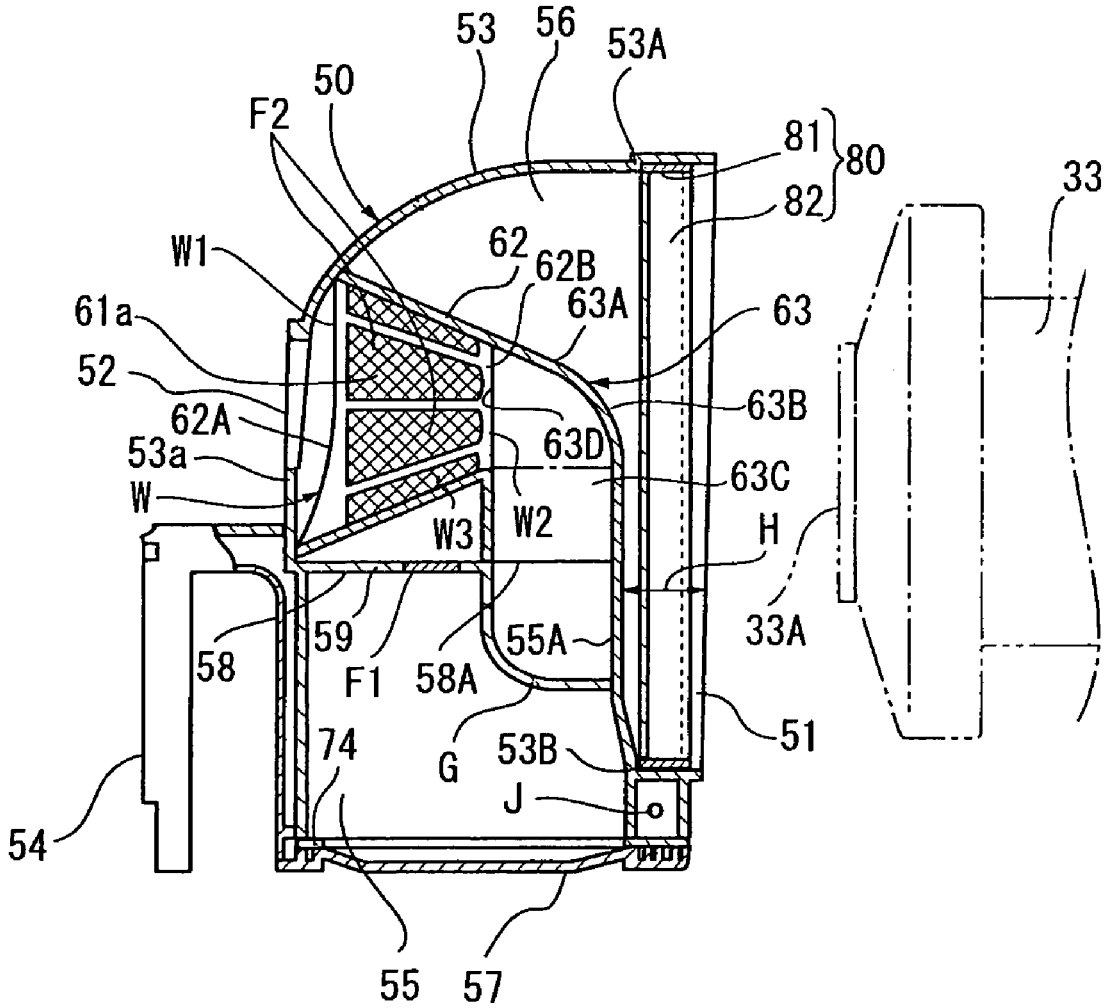
FIG. 21 is an explanatory view showing the dust collection case in FIG. 20 by enlarging and also showing a relationship of arrangement between a motor fan.
Figure 22:
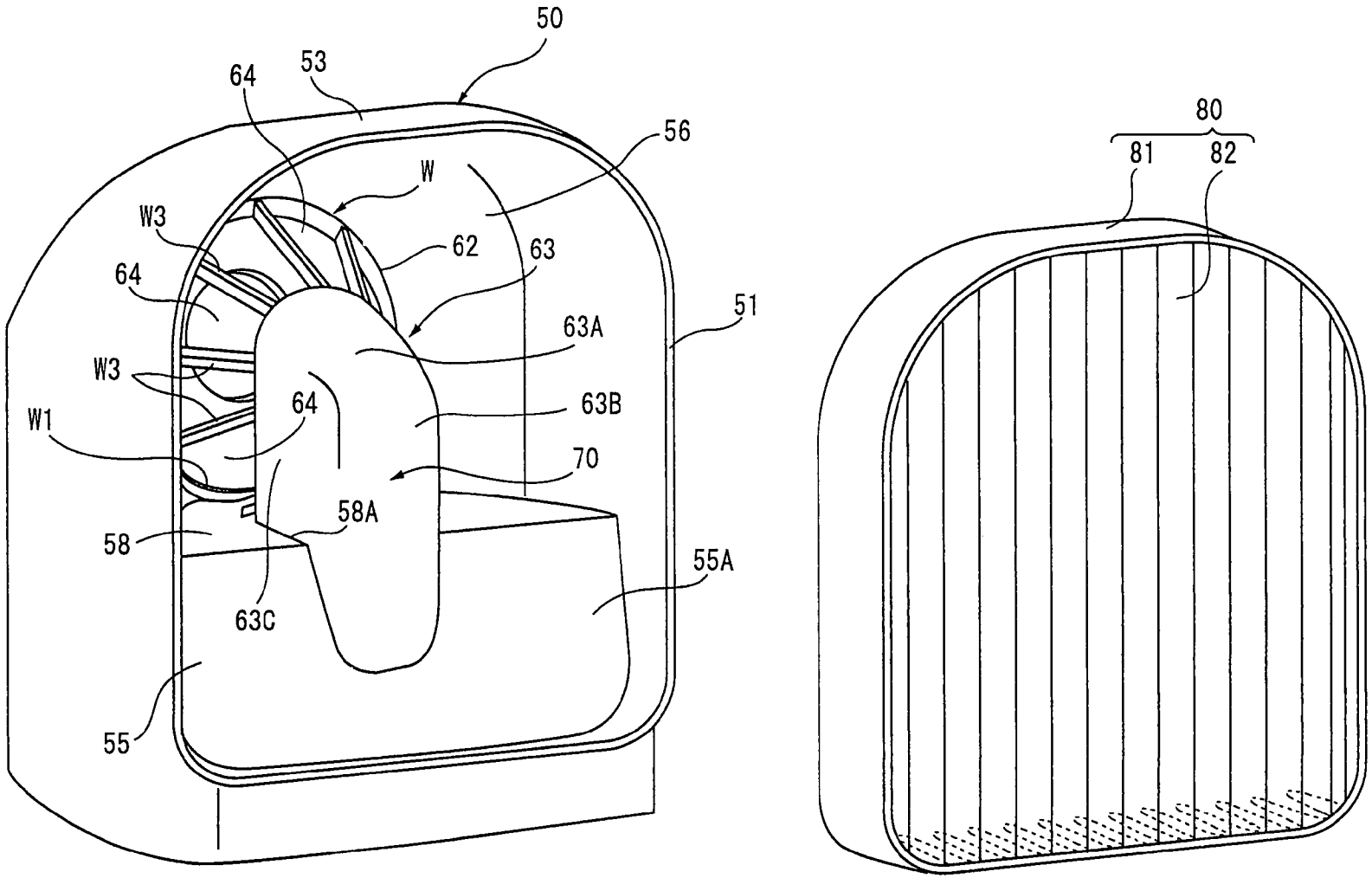
FIG. 22 is a disassembled perspective view showing the dust collection case in FIG. 21 and a filter which is fixed to a rear opening of the dust collection case by disassembling them.
Figure 23:
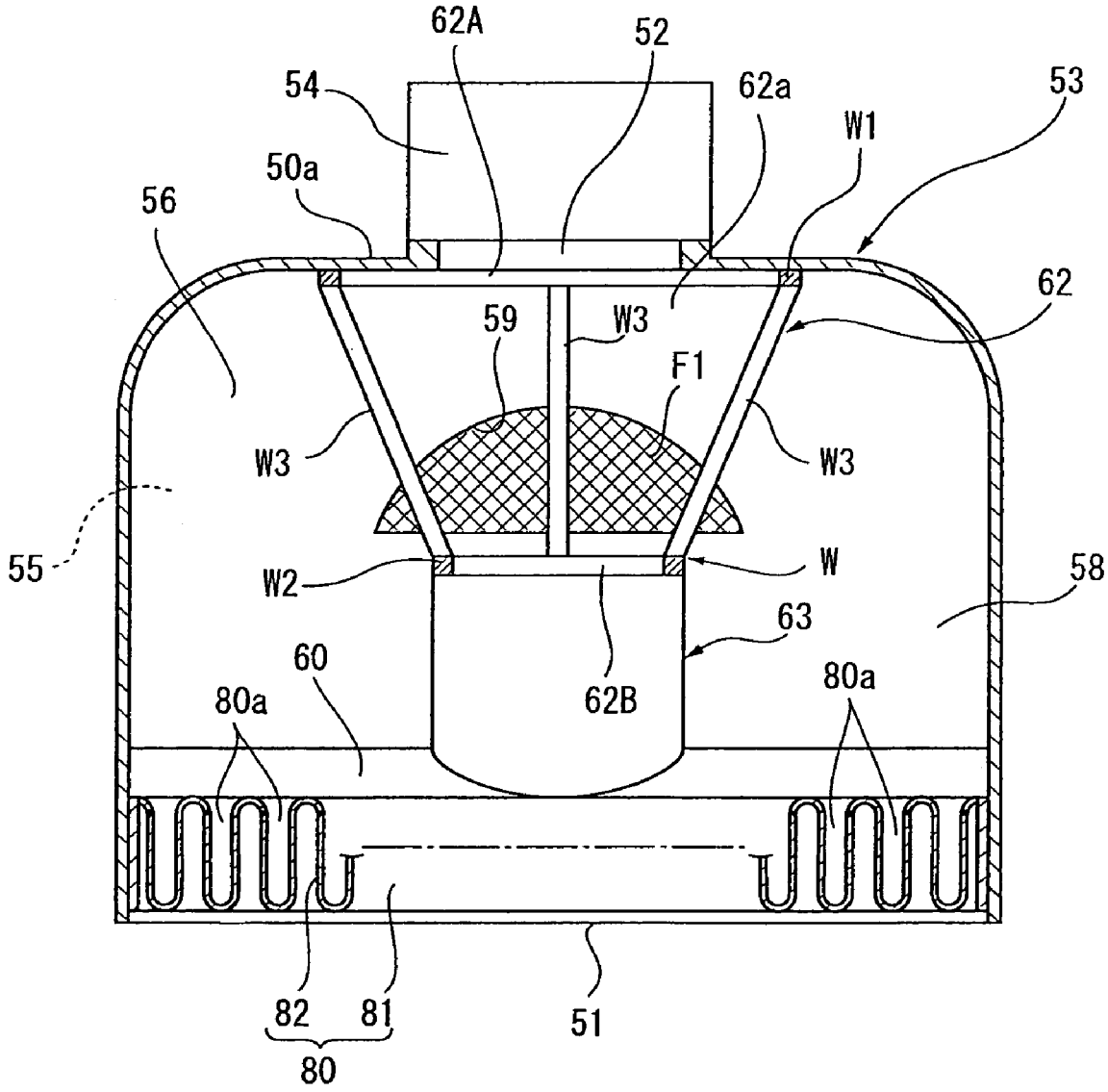
FIG. 23 is a horizontal sectional view showing the dust collection case, the tubular filter and the filter of the rear opening in FIG. 21.

As shown in FIG. 20 and FIG. 21, the container case body 53 has the dust collection room section (dust accumulating section) 55 which is formed at a lower part of the case body 53, the negative pressure room section (negative pressure space) 56 formed mainly at an upper part of the dust collection room section 55, a first dust separation section 60 provided at inside of the negative pressure room section 56, and the strike section 63 as a guiding section which is leading the dust separated by the dust separation section 60 to the dust collection room section 55.

The bottom face of the dust collection room section 55 is opened. The bottom plate 57 is attached to the bottom part of the dust collection room section 55 capable of opening and closing in about the axis J, and it is possible to dispose the dust accumulated in the dust collection room section 55 by opening the bottom plate 57. The closed state of the bottom plate 57 is adapted to be released through a mechanism which is not shown in the figure that is operated simultaneously by the press-in operation of a control button provided on the handle section 54. 74 denotes a circular shaped seal which is fixed at an inner surface of the bottom plate 57 and thereby air tightness at a lower end part of the dust collection room section 55 is provided when the bottom plate 57 is in closed condition.

The suction opening 52 is formed at an upper part of the front wall 53*a* of the dust collection case 50 as an opening for a sucking use. Also, the dust collection case 50 has a rear side wall (first wall) 55A of the dust collection room section 55 near to the rear part of the opening 51, and the top panel (second wall) 58 which is continuously bent from the upper end of the rear side wall 55A to the front wall 53*a*. The top panel 58 and the rear side wall 55A divide the lower part's dust collection room section 55 and the upper part's negative pressure room section 56. At the top panel 58 which constitutes a ceiling wall of the dust collection room section 55, the ventilation opening 59 is formed that communicates the dust collection room section 55 with the negative pressure room section 56.

The ventilation opening 59 is provided such that the ventilation opening 59 substantially faces a center of the dust collection room section 55. By this, the ventilation opening 59 faces to the filter F2 of the first dust separation section 60 which will be described later from a lower part of it. The filter F1 which is made from a net for example and which is attached to the ventilation opening 59.

The mesh of the filter F1 is 30 μm-110 μm, preferably 60 μm-80 μm. By the filter F1, it is possible to avoid the dust which has more size than predetermined size to flow into the negative pressure room section 56, as well as facilitating the maintenance for removing the dust clogged at the filter F1.

The connection hole 58A is formed at the side of the wall 60*a* of the top panel 58. At lower part of the connection hole 58A, there is provided the guide wall G to generate spiral flow at inside of the dust collection room section 55.

The first dust separation section 60 constitutes an inertia separation device which is in a direct advancing flow type for separating the air and the dust by inertia-separation effect, and has the tubular filter 62 which forms the tubular passage 61 as a separation air passage, and has the strike section (guiding section) 63.

The tubular filter 62 as an air passage body has the tubular frame W which is for example, in a hollow cone shape in which one end and an other end are both opened and has the plurality of openings (separation opening) 64 as the air guiding opening at its entire circumference in a regular interval, and has the filter F2 for blocking the openings 64 of the tubular frame W. To say in detail, the tubular frame W, the tubular filter 62, is constituted by a small and large pair of round frame sections W1 and W2 and the plurality of ribs W3 which connect the frame sections W1 and W2. The respective openings 64 are formed by spaces surrounded by the both frame sections W1, W2 and W3. The filter F2 is made by the net for example, and is attached along the inner periphery surface of aforementioned frame in a tubular shape.

Therefore, the tubular filter 62 constitutes a structure as if both sides in an axial direction of a mound are opened, and the tubular shaped passage 61 is formed which is surrounded by the tubular filter 62. It is recommendable to provide aforementioned ventilation opening 59 at least near to the small diameter part of the tubular filter 62 in a facing manner.

This tubular shaped passage 61 extends linearly to the axial direction (to the longitudinal direction in the present embodiment) of the vacuum cleaner main body 20. The tubular shaped passage 61 is communicated with the intake opening 33A of the motor fan 33 subsequently through the openings 64 of the tubular filter 62, the negative pressure room section 56 of the container case body 53 and the opening 34A of the motor-driven section 34 of the main body case 30.

The diameter of the one end opening 62A which is a large diameter of the tubular filter 62 is formed larger than the diameter of the suction opening 52 of the container case body 53. The tubular filter 62 is connected to the container case body 53 so that the suction opening 52 falls within the one end opening 62A. The diameter of the other end opening 62B which is a small diameter of the tubular filter 62 is formed virtually the same diameter of the suction opening 52. By this, the diameter of the tubular filter 62 is gradually decreasing as going from the one end to other end linearly. By the way, it may be recommendable that the diameter of the other end opening 62B of the tubular filter 62 is smaller than the diameter of the suction opening 52.

An axis line of the tubular filter 62 and an axis line of the connection pipe 44 of the lid body 40 continue virtually in alignment, and the intake opening 33A of the motor fan 33 is provided in such a manner as to face on these extending axes. The connection pipe 44 of the lid body 40, the suction opening 52 of the container case body 53, the tubular filter 62, the opening 51 of the container case body 55 and the intake opening 33A of the motor fan 33 are subsequently arranged along the axial direction (the longitudinal direction in the present embodiment) of the vacuum cleaner main body 20 at virtually the same height position.

The strike section 63 is provided continuously at the other end opening 62B of the tubular filter 62. To say in detail, the strike section 63 has the slant wall section 63A extending from the upper side of the other end opening 62B of the tubular filter 62 to the lower side on a slant, and the strike wall section 63B (wind striking wall section) which faces to the other end opening 62B of the tubular filter 62 and is also incurved from the one end of the slant wall section 63A and extending to the lower part, and the side wall section 63C which is formed at both sides of the slant wall section 63A and the strike wall section 63B. Additionally, the strike section 63 has the opening 63D which is jointed to the other end opening 62B of the tubular filter 62.

A lower part of the strike section 63 constitutes a tubular shape and which is for example, extending in a vertical direction and covering the connection hole 58A, and is also connected throughout the ceiling wall 58 and the uprising wall

60*a*. By this connection, the strike section 63 communicates the tubular shaped passage 61 with the dust collection room section 55.

This uprising wall 60*a* is provided slightly inside (front side) than the opening 51 of the container case body 53, and giving a predetermined depth H to the opening 51. The filter 80 which constitutes the second dust separation section is attachably and detachably loaded inside of the opening 51 by using the depth H (see FIGS. 20, 21 and 23).

The filter 80 is provided with a filter frame 81 and a filter element 82 which is loaded in such a manner as to block entire inner side of the frame 81. The filter element 82 is constituted by making the filter medium in a mat shape, and particularly in the present embodiment, a pleat-shaped filter element is used which the pleat process is applied for expanding the filter element 82 in a thickness direction thereof. The mesh of this filter element 82 is finer than the mesh of filters F1 and F2 which are at a former step.

Next, an operation of the electric vacuum cleaner constituted as above will be described.

As mentioned above, by actuating the motor fan 33, the partial air sucked to the tubular shaped passage 61 is sucked by the negative pressure room section 56 of the container case body 53 through the first filter F2 of the openings 64 of the tubular filter 62, and further sucked by the intake opening 33A of the motor fan 33 through the filter 80 which is loaded on the opening 51 of the container case body 53.

In this sucking of the air, the dust which has more weight than a predetermined weight and which is sucked to the tubular shaped passage 61 that extends straight in a longitudinal direction of the vacuum cleaner main body 20 cannot be passed through the openings 64 by changing its direction suddenly because of its inertia. Consequently, aforementioned dust which has weight is adapted to be separated from the air that passes the openings 64, and goes straight through the tubular shaped passage 61, and then hits to the strike wall section 63B of the guiding section 63 and is introduced into the dust collection room section 55 along the strike section 63.

Some of the air is adapted to be introduced into the dust collection room section 55 through the strike section 63 as similar to aforementioned dust which has the more weight. The introduced air as just stated then becomes spiral flow by the guide wall G in a downward direction which revolves along the inner peripheral surface of the dust collection room section 55. Consequently, the dust introduced into the dust collection room section 55 is adapted to be accumulated as it is compressed along the lower inner peripheral surface of the dust collection room section 55 by aforementioned spiral flow.

The air turned into the spiral flow by being introduced inside of the dust collection room section 55 is reversed and drifted upward at a center part in the dust collection room section 55, and goes through the ventilation opening 59 of the dust collection room section 55 and is sucked by the negative pressure room section 56 of the container case body 53, and further goes through the filter 80 which is loaded on the opening 51 of the container case body 53 and is sucked by the intake opening 33A of the motor fan 33.

In this case, since the ventilation opening 59 is provided at the wall 58 in such a manner as to face virtually the center part of the dust collection room section 55, it is less likely that the dust within the dust collection room section 55 attaches to the filter F1 of the ventilation opening 59. Moreover, the air sucked to the intake opening 33A from the dust collection room section 55 through the ventilation opening 59 flows the negative pressure room section 56 via outer peripheral surface of the filter F2 which is in a hollow cone shape by a positional relationship between the ventilation opening 59 and the dust separation section 60, or to be more precise, the air flows the negative pressure room section 56 while blowing the filter F2 from the lower direction of the filter F2.

At the same time, because the light weighted dust flows with the air that goes through the filter F2 of the openings 64 by an intake negative pressure of the motor fan 33 without going straight through the tubular shaped passage 61 which is in the tubular filter 62 of the dust separation section 60, the dust becomes attached to the inner peripheral surface of filter F2. If the clogging of the filter F2 caused by the attachment of the light weighted dust becomes larger, the amount of wind that goes through the filter F2 reduces. But the negative pressure of the negative pressure room section 56 increases corresponding to the amount it reduced as well as the negative pressure within the dust collection room section 55 through the ventilation opening 59 of the first wall 58. Consequently, the wind velocity and the amount of wind of the air that goes straight through the tubular shaped passage 61 increase.

As stated above, even if the amount of wind that passes through the filter F2 is reduced by clogging, the amount of wind the motor fan 33 sucks can be maintained substantially constant because the amount of wind goes straight through the passage 61 increases. Therefore, it is always possible to suck the dust by the predetermined sucking power with irrespective of the clogging of the filter F2.

Moreover, if the wind velocity that goes straight through the tubular shaped passage 61 becomes larger as above mentioned, the air that goes straight becomes easier to peel off the dust attached to the filter F2. On this occasion, because the diameter of the tubular shaped air passage body 62 gradually decreases as going from the upstream side's opening 62A to the downstream side's opening 62B, the air that goes straight through the tubular shaped passage 61 hits equally to entire surfaces of the filter F2 and flows as gravitated toward the center part of the tubular shaped passage 61. Therefore the air becomes easier to peel off the dust attached to the inner surface of the filter F2.

In addition, because the air trying to reach the intake opening 33A of the motor fan 33 from the dust collection room section 55 through the ventilation opening 59 hits the outer peripheral surface of the filter F2 as already mentioned, the air becomes easier to peel off the dust attached to the inner surface of the filter F2.

To say in detail, because the dust attached to the inner surface of the filter F2 is influenced by a force pulling toward an outside direction by the negative pressure caused by the negative pressure room section 56 and a transferring force caused by the air passing the tubular shaped passage 61, particularly a relatively long dust and a membranous dust which became equivalent to a relatively long condition substantially by a development of the attachment to the inner surface of the filter F2, are easier to stop at its current position while maintaining an unstable attached condition at the inner surface of the filter F2 by an antagonism of aforementioned two forces. If there is retention of the dust at the inner surface of the filter F2 as such, the dust attachment develops easily from there as a center. In addition, the velocity of the dust contained air that tries to penetrate the hollow cone shaped filter F2 in a longitudinal direction becomes slow as going to a side of the small diameter part of the tubular filter 62 which the filter F2 is attached to the inner peripheral surface, therefore the dust attaches easily to the inner surface of it.

However, since the force trying to pull the dust attached to the inner surface of the filter F2 by the negative pressure of the negative pressure room section 56 can be weakened in that area where the air hits by the air hitting the outside of the filter F2, a superiority in aforementioned transferring force can be made by breaking a balance of aforementioned forces. By this, the dust attached to the inner surface of filter F2 can be peeled off easily even more. In addition, because the ventilation opening 59 faces to the small diameter part of the tubular filter 62 and the air hits at least outside of the side of the small diameter part of the filter F2, it is possible to remove the dust attached to an inner surface of the small diameter part effectively.

In addition to this, in the area where the air hits outside of the filter F2, since the force trying to pull the air in the filter F2 outside by the negative pressure of the negative pressure room section 56 can be weakened, it is possible to reduce and restrain the attachment of the dust to aforementioned area.

Furthermore, since it is structured that the air passed the ventilation opening 59 hits from the lower part of the filter F2, even if it is the dust that is attached to the lower part of the inner surface of the filter F2, it is possible to peel off effectively as already mentioned.

The dust that is peeled off from the inner surface of the filter F2 as stated above is adapted to be introduced into the dust collection room section 55 through the strike section 63 as similar to the heavy weighted dust, and is separated from the air centrifugally in the dust collection room section 55 and is accumulated.

In addition, in the dust separation room section 60, because the dust is separated from the air by using the inertia force caused by the heavy weighted dust such as coarse dust trying to move forward rather than swirling the dust contained air and centrifugally separating the dust and the air while reversing the moving direction of the spiral flow, the loss of air passage becomes less in the dust separation section 60. Moreover, because the suction opening 52, the separation air passage 62*a*, the opening 51 of container case body 53 and the intake opening 33A of the motor fan 33 are virtually at the same height position and are arranged in order continuously in the longitudinal direction, the main flow of the air does not change significantly as shown representatively by the arrow Q in FIG. 3, and flows substantially straight forward at almost the same height position when the air is sucked to the negative pressure room section 56 of the container case body 53 through the filter F2 from the tubular shaped passage 61, and is sucked by the motor fan 33.

Consequently, the loss of air passage becomes even less, which the performance of the motor fan 33 can be achieved sufficiently. Furthermore, because the connection pipe 44 of the lid body 40 and the tubular shaped tubular filter 62 are arranged in a straight line, the direction of the air introduced to the suction opening 52 of the container case body 53 and the extending direction of the tubular filter 62 become substantially in alignment, therefore its loss of air passage becomes even more less.

As mentioned, because the air inside of the negative pressure room section 56 passes the filter 80 and sucked by the motor fan 33, the microscopic dust passed the filters F1 and F2 can be captured by the filter 80, and the motor fan 33 can suck the cleaned air cleaned by them.

Furthermore, in the cleaning operation as described above, at an upstream side of the filter 80 which is for separating the dust by the percolation, the dust separation section 60 which is for separating the dust by the inertia separating effect is arranged, so that the coarse dust or the like is separated at the dust separation section 61 beforehand. By this, it is possible to avoid the filter 80 to be as an apparent clogged condition at an early stage due to the attachment of the large dust at the filter 80 that is supposed to be removed at the dust separation section 60.

The present invention is not limited by aforementioned one embodiment. For example, it may be also recommendable to provide the tubular filter 62 in a straight pipe shape such as a circular cylinder or an angular pipe, and the filter F1 of the aforementioned one embodiment can be omitted, and in the dust collection room section 55, it is also possible to omit the guide wall G which is for creating the spiral flow. In addition, the filter 80 which constitutes the second dust separation section in aforementioned one embodiment can also be detachably sustained at the main body case 30 and can be fixed into the opening 51 which is provided at the container case body 53 of the dust collection case 50 in connection with attaching the dust collection case 50 to the main body case 30.

As described above, according to the present invention, it is possible to provide the electric vacuum cleaner in which the loss of air passage can be reduced compared with the one that carries out the cyclone type separation, and the deterioration in the amount of wind can be suppressed easily even if the dust accumulates at the dust separation section.

[Mode for Carrying Out the Invention 6]

Figure 24:
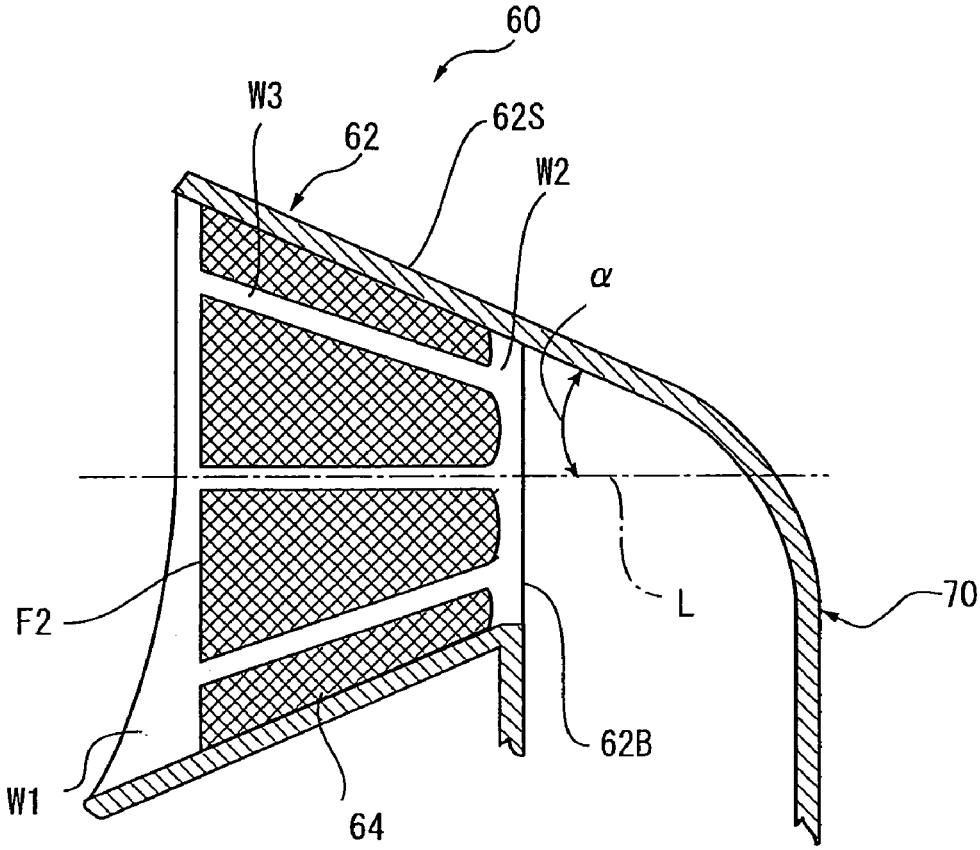
FIG. 24 is a sectional view of the tubular filter of still other embodiment of the present invention.
Figure 25:
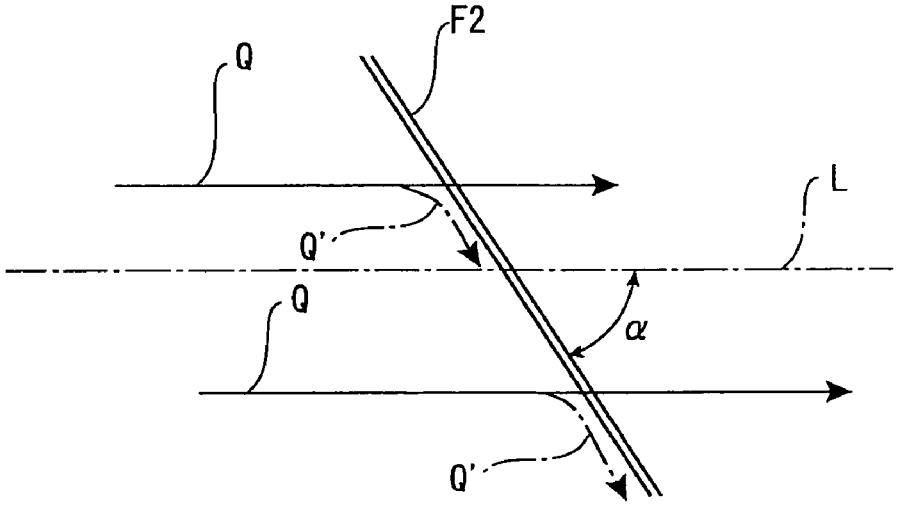
FIG. 25 is an operational-explanatory view of the tubular filter shown in FIG. 24.

FIGS. 24 and 25 show an electric vacuum cleaner corresponding to the sixth embodiment of the present invention. The same reference numbers indicated in FIGS. 1-8 are given for the parts identical or resembles to the structure of the embodiment shown in FIGS. 1-8, and their descriptions are omitted.

In the sixth embodiment of the present invention, it is constituted that when the wind velocity going straight of the passage 61 of the tubular filter 62 increases, the air going straight through the passage peels off the dust attached to the net filter F2. On this occasion, as an angle $\alpha$ between a peripheral wall 62S and a center line L of the tubular filter 62 is set virtually 30 degrees, the wind going straight through the passage 61 hits the entire surface of the net filter F2 equally, and the wind becomes easier to flow along the surface of the net filter F2, consequently the dust attached to the net filter F2 becomes easier to be peeled off.

Next, operation on the electric vacuum cleaner constituted as above mentioned will be described hereunder.

By actuating the motor fan 33 in such a manner as mentioned above, the air sucked to the passage 61 is adapted to be sucked by the negative pressure room section 56 of the container case body 53 through the net filter F2 of the openings 64 of the tubular filter 62, and is further sucked by the intake opening 33A of the motor fan 33 through the filter 80 which is loaded on the opening 51 of the container case body 53.

Meanwhile, because the passage 61 extends linearly to the longitudinal direction, the dust which is sucked to the passage 61 of the tubular filter 62 and which has more weight than predetermined weight goes straight through the passage 61 by the inertia and is introduced inside of the dust collection room section 55 by the guide pipe 70. That is to say, the dust and the air are separated by the dust separation section 60.

Also, some of the air is adapted to be introduced inside of the dust collection room section 55 through the guide pipe 70, and the introduced air then turns into spiral flow by the guide wall G of the dust collection room section 55, and the dust introduced inside of the dust collection room section 55 is accumulated by the spiral flow as it is compressed.

The air that is introduced into the dust collection room section 55 is, when it is turned into spiral flow, sucked into the negative pressure room section 56 of the container case body 53 through the ventilation opening 59 of the top panel 58 of the dust collection room section 55.

As the light weighted microscopic dust flows with the air that goes through the net filter F2 of the openings 64 without going straight through the passage 61 of the tubular filter 62, the dust becomes attached to the net filter F2. Although the amount of wind that goes through the net filter F2 reduces by the attachment of the microscopic dust to the net filter F2, the negative pressure of the negative pressure room section 56 of the container case body 53 increases corresponding to the amount it reduced as well as the negative pressure within the dust collection room section 55 through the ventilation opening 59 of the top panel 58. Consequently, the wind velocity of the air that goes straight through the passage 61 of the tubular filter 62 becomes greater, therefore the amount of wind going straight increases.

When the wind velocity that goes straight through the passage 61 of the tubular filter 62 become greater, the air that goes straight peels off the dust attached to the net filter 62. On this occasion, as the angle α between the peripheral wall 62S and the center line L of the tubular filter 62 is set virtually 30 degrees, the wind going straight through the passage 61 hits the entire surfaces of the net filter F2 equally, and the wind becomes easier to flow along the surface of the net filter F2, consequently the dust attached to the net filter F2 becomes easier to be peeled off.

By the way, if the degrees of the angle α between the peripheral wall 62S of the tubular filter 62 and the center line L of the tubular filter 62 becomes larger, the amount of dust attaching the net filter F2 increases because the amount of wind Q hitting the net filter F2 equally increases as shown in FIG. 25. Also, the amount of wind Q' flowing along the net filter F2 as shown by the chained line decreases. Consequently, the attached dust becomes harder to be peeled off from the net filter F2 by the wind Q', only the amount of dust attaching to the net filter F2 increases.

But when the angle α becomes less than 45 degrees, the amount of dust that attaches to the net filter F2 can be decreased because of the amount of wind Q hitting equally to the net filter F2 decreases, and furthermore, because the amount of wind Q' flowing along the net filter F2 increases, it becomes preferable that the wind Q' becomes peeling off the dust attached to the net filter efficiently.

If the angle α becomes too small, the amount of dust attaching to the net filter F2 decreases significantly because the amount of wind Q hitting equally to the net filter F2 decreases significantly, but the amount of wind Q hitting equally to the net filter F2 becomes subtle, therefore the amount of wind Q' flowing along the net filter F2 decreases significantly. Consequently, the dust attached to the net filter F2 becomes harder to be peeled off by the wind Q'.

Therefore, when the angle α is at virtually 30 degrees, it is possible to reduce the amount of dust attached to the net filter F2 as well as increase the amount of wind Q' that is flowing along the net filter F2, thereby it becomes most preferable that the dust attached to the net filter F2 can be peeled off in most effective manner.

The peeled dust is then introduced and accumulated inside of the dust collection room section 55 through the guide pipe 70.

According to the invention as described above, even if the dust attaches to the net filter, the attached dust can be removed efficiently by the air that flows in the air passage.

[Mode for Carrying Out the Invention 7]

FIGS. 26-33 show an electric vacuum cleaner corresponding to the seventh embodiment of the present invention. The same reference numbers used in above mentioned embodiment of the invention are given for the parts identical or resembles to the structure of the above mentioned embodiment of the invention, and their descriptions are omitted.

Figure 26:
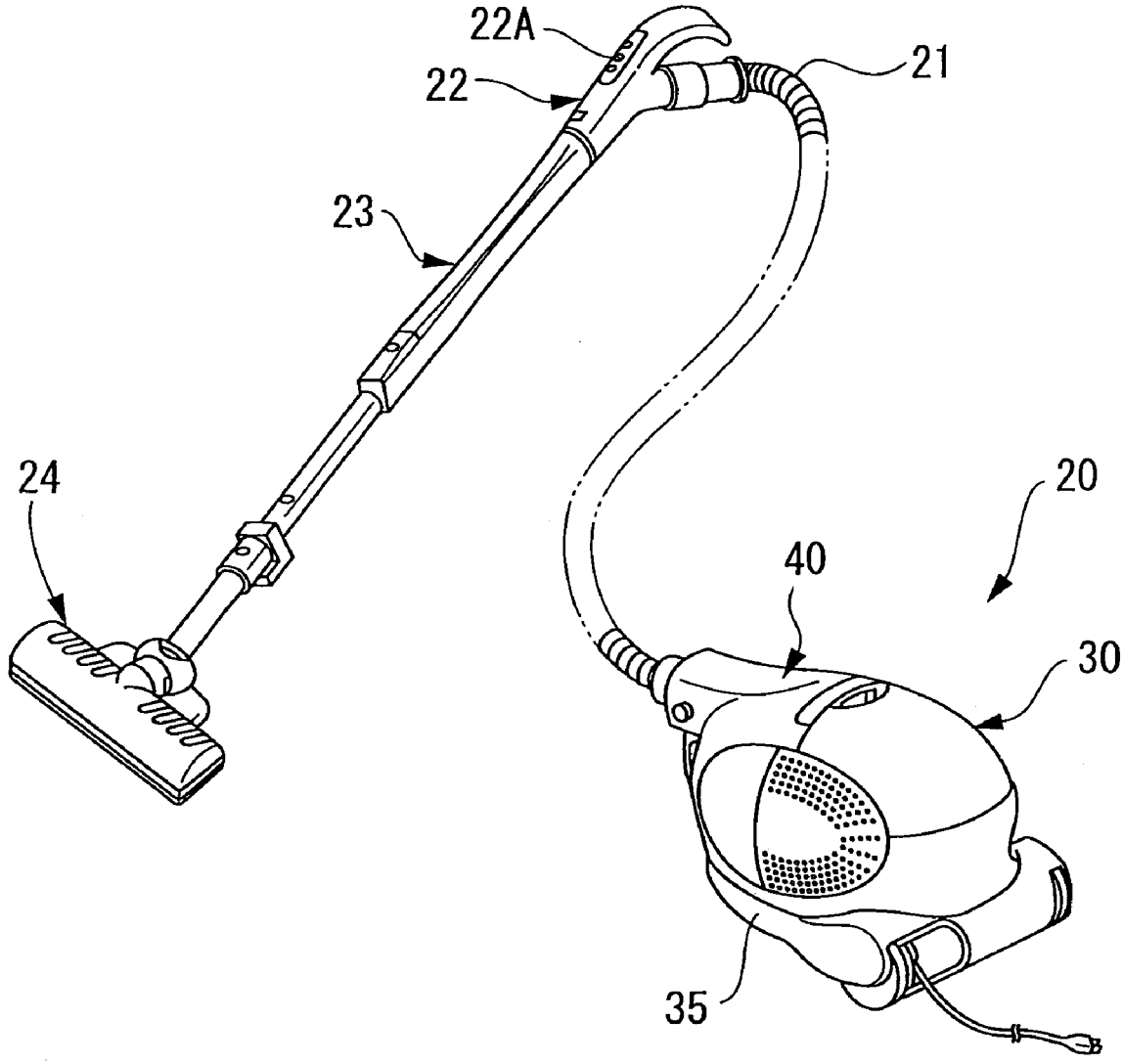
FIG. 26 is a perspective view schematically showing an external appearance of the electric vacuum cleaner of still other embodiment of the present invention.

In FIG. 26, 20 is the vacuum cleaner main body, and the one end of the hose 21 is connected attachabley and detachably to the vacuum cleaner main body 20 and the hand operating pipe 22 is provided on its other end. The extension pipe 23 is connected attachably and detachably to the hand operating pipe 22 and the suction opening body 24 is connected to the end of the extension pipe 23 attachably and detachably. Also, the control section 22A is provided on the hand operating pipe 22, and there is provided on the control section 22A the control switch which is not shown.

Figure 27:
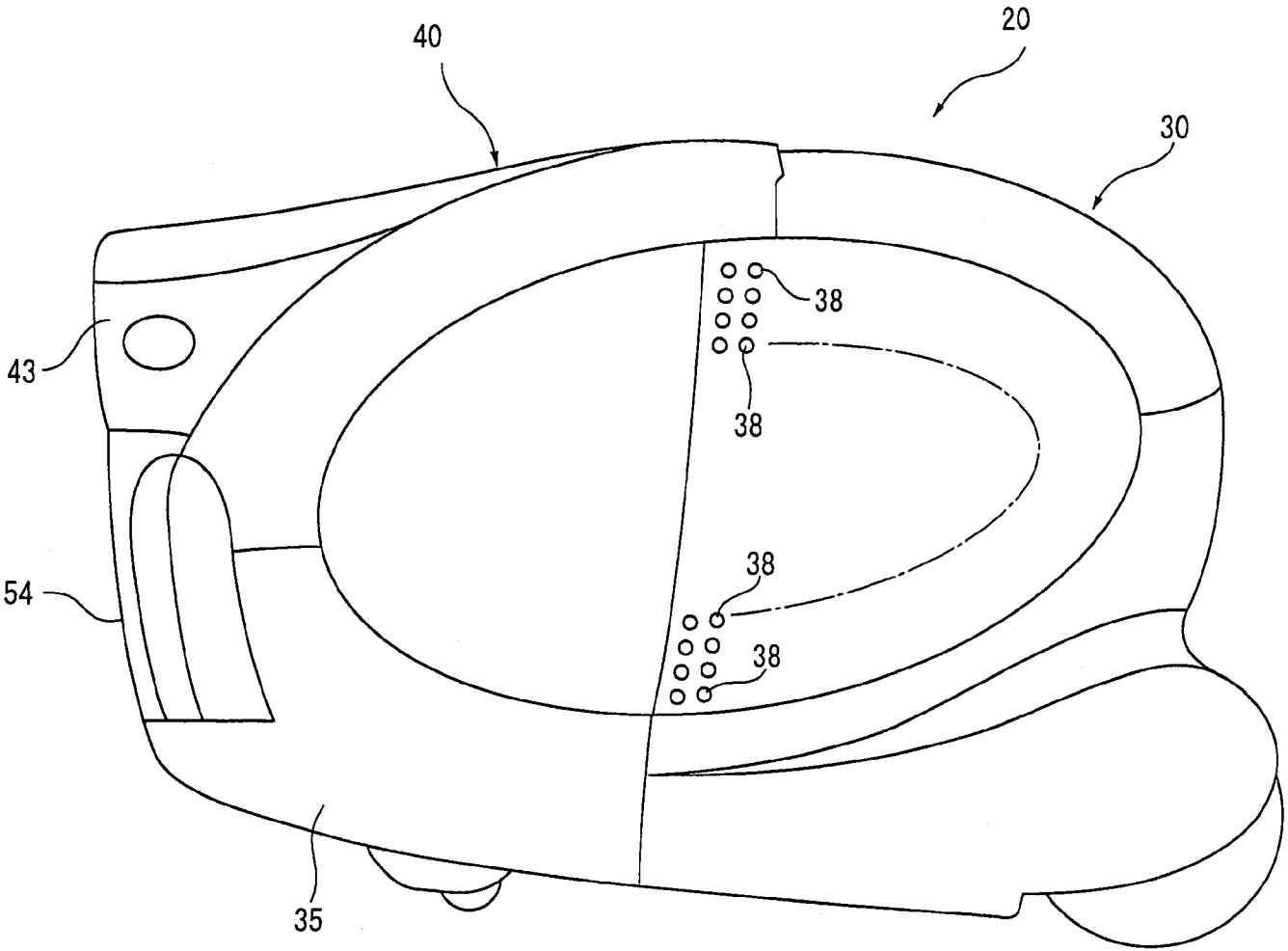
FIG. 27 is an enlarged side view of the vacuum cleaner main body in FIG. 26.
Figure 28:
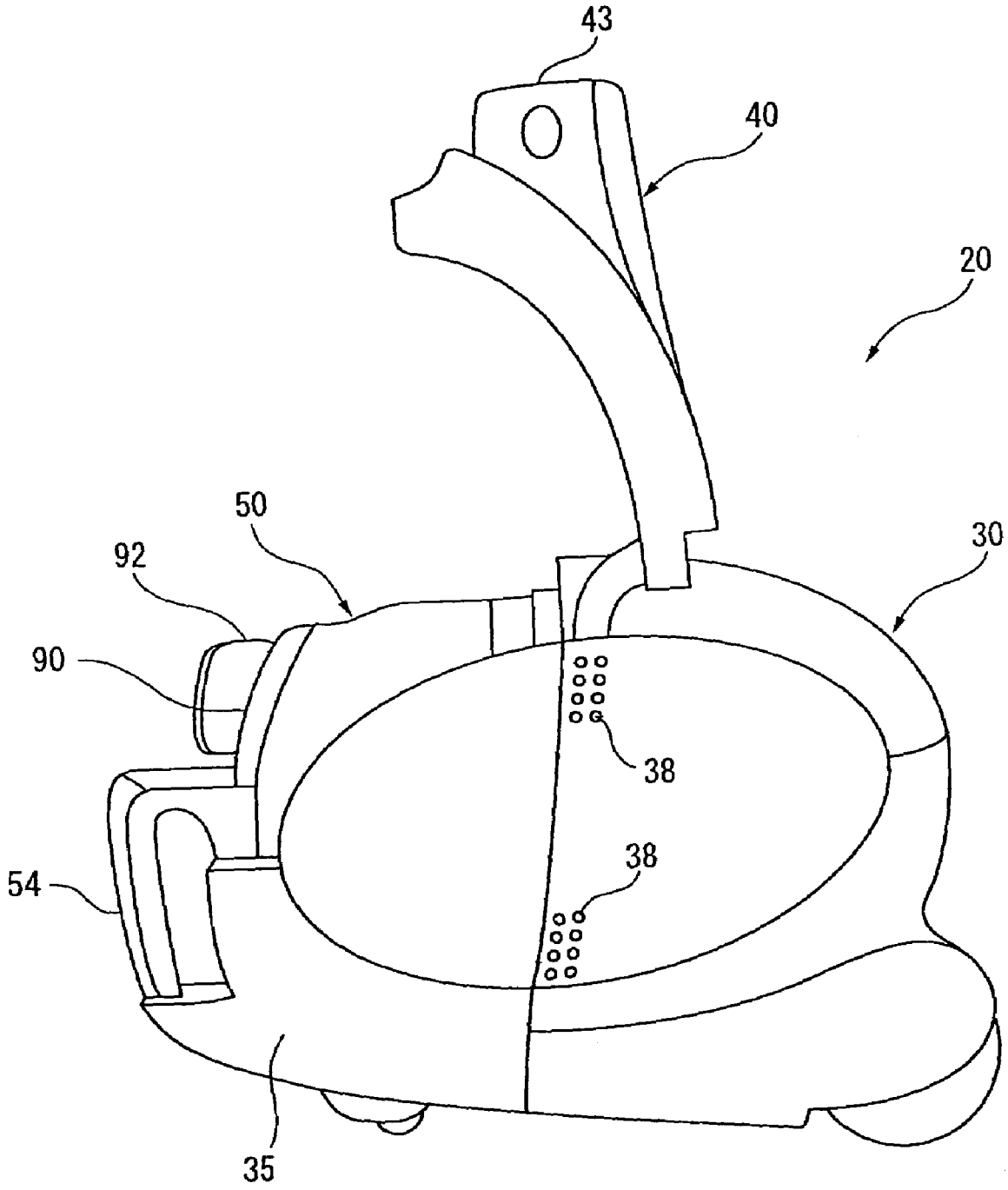
FIG. 28 is a side view of the vacuum cleaner main body in a condition that the lid body in FIG. 27 is opened.
Figure 29:
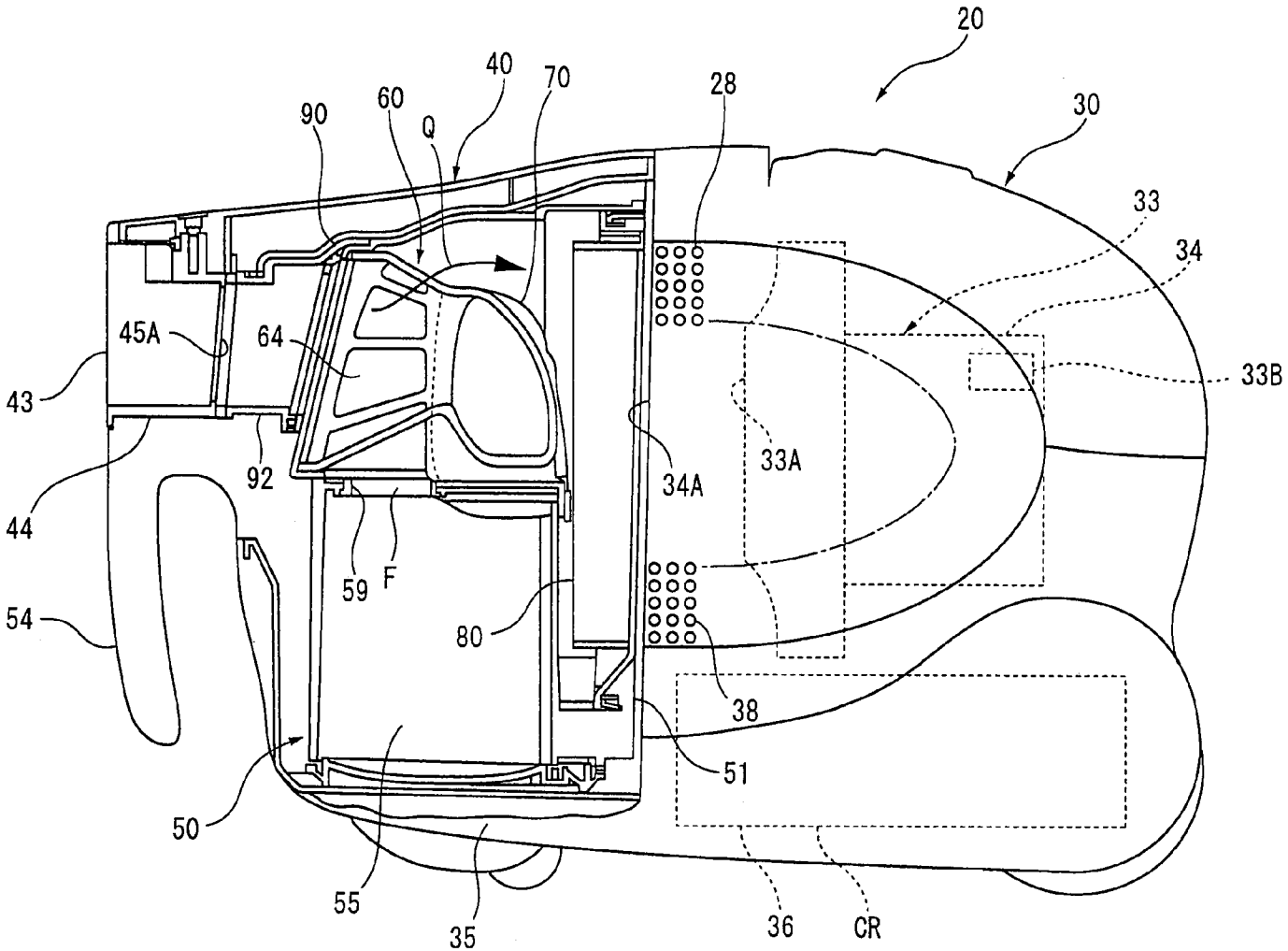
FIG. 29 is a partial sectional side view of the vacuum cleaner shown in FIG. 27.

As shown in FIGS. 27 to 29, the vacuum cleaner main body 20 is comprised of the main body case 30 and a dust collection case (dust cup) 50 which is attachably and detachably mounted on the main body case 30 and the lid body 40 capable of opening and closing in a vertical direction with the back end of the lid body 40 being connected to the main body case 30 by the hinge connection.

The main body case 30 has a cord reel room 36 which is formed at a lower part and installed with a cord reel CR and has the motor-driven room 34 which is loaded with the motor fan 33 and formed above the cord reel room 36. At front side of the cord reel room 36, there is provided the mounting section 35 which is in the plate shape that protrudes to the forward direction. Onto the mounting section 35 the dust collection case 50 is attachably and detachably mounted. Furthermore, the dust collection case 50 is adapted to be fixed by a hold of the lid body 40 and the mounting section 35 when the lid body 40 is closed.

Also, the front side of the motor-driven section 34 of the main body case 30 is made opened, and this opening 34A faces and is communicated with the intake opening (intake vent) 33A of the motor fan 33. At both side faces of the main body case 30, the plurality of exhaust holes 38 are formed. These exhaust holes 38 are communicated with the exhaust opening 33B of the motor fan 33 through the exhaust air passage which is not shown, and the air exhausted from the exhaust opening 33B of the motor fan 33 is exhausted outside from the exhaust holes 38 through the exhaust air passage.

To the lid body 40, the connection pipe 44 which has the connection opening 43 at the front end of the connection pipe 44 which is attachably and detachably connecting the dust collection hose 21, is provided. The connection pipe 44 is extended in a longitudinal direction and its rear end has an opening 45A.

Figure 30:
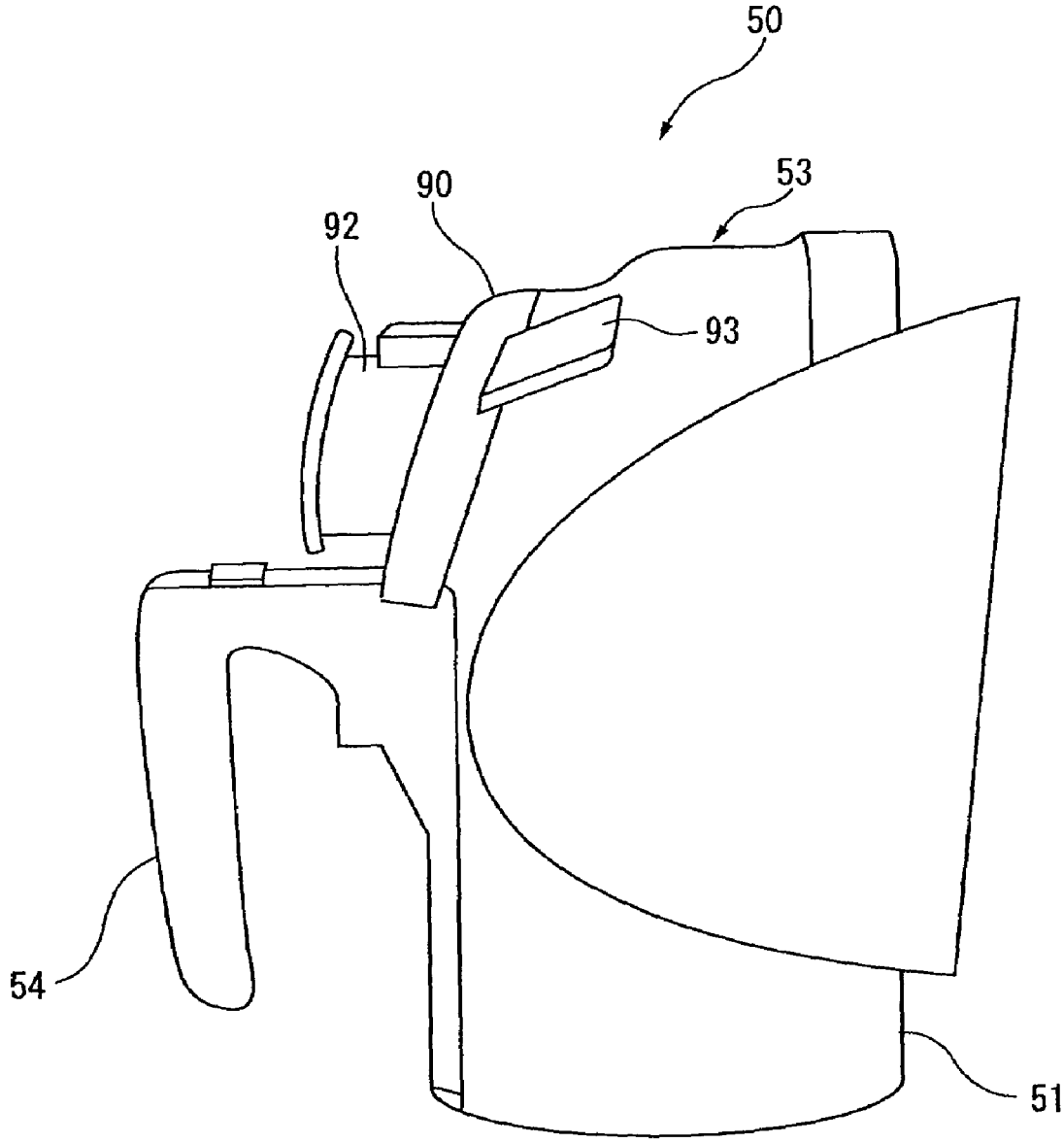
FIG. 30 is a side view of the dust collection case in FIG. 29.
Figure 31:
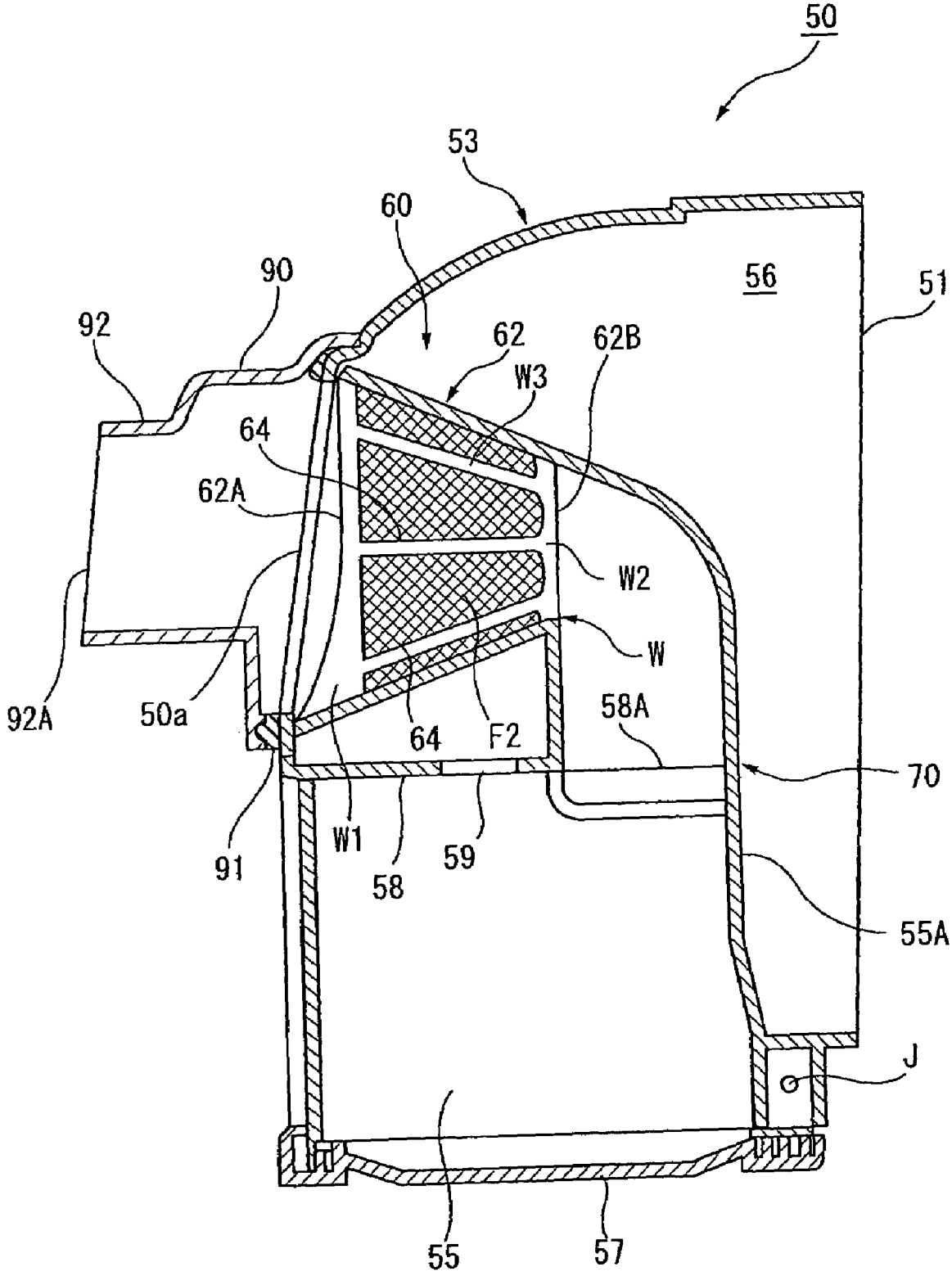
FIG. 31 is a sectional view schematically showing a cross section of the dust collection case in FIG. 29 and a part which guides a dust to a dust collection room.
Figure 32:
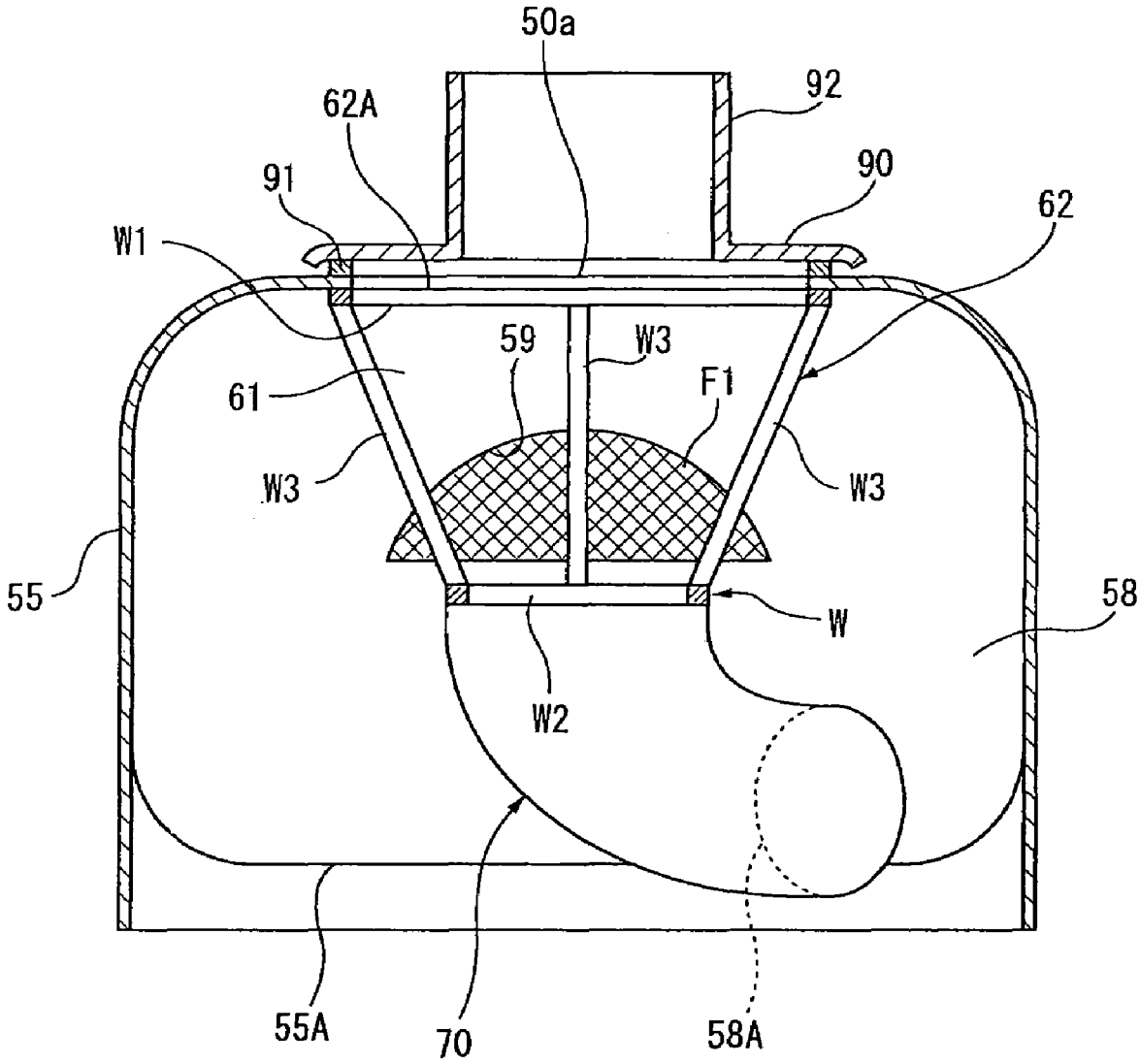
FIG. 32 is a horizontal sectional view showing the dust collection case in FIG. 31 and the tubular filter.

As shown in FIG. 30 to FIG. 32, the dust collection case 50 has the opening 51 on the rear face (right side in FIG. 31) and a case body 53 which has a front side opening (case opening) 50*a* at the front face, and the handle section 54 which is integrally formed at the case body 53.

The case body 53 has the dust collection room section (dust collection section) 55 formed at the lower part, the negative pressure room section 56 formed at above the dust collection room section 55, the dust separation section 60 provided within the negative pressure room section 56 and the guide pipe 70 for guiding the dust separated at the dust separation section 60 to the dust collection room section 55.

The front side opening 50*a* of the case body 53 is closed by means of an opening and closing lid 90. On a back of the opening and closing lid 90, a seal member 91 is fixed which attaches to a peripheral part of its front side opening 50*a*. The seal member 91 seals between the front side opening 50*a* and the opening and closing lid 90.

To the opening and closing lid 90, a communicating pipe 92 is provided which is communicated with the connection pipe 44 of the lid body 40, and an opening 92A which is located at a front end of the communicating pipe (suction opening) 92 is jointed with the opening 45A of the connection pipe 44, and the communicating pipe 92 is communicated with the passage 61 of the dust separation section 60 through the front side opening 50*a*. Above the opening and closing lid 90, a pair of arms 93 (only one is shown) are provided extending in a backward direction (rightward direction in FIG. 30), and an axis P is provided at end of the arms 93 that extends in right and left direction (the direction perpendicular to a page space in FIG. 33). The axis P is rotatably fixed to an upper part of the case body 53.

Figure 33:
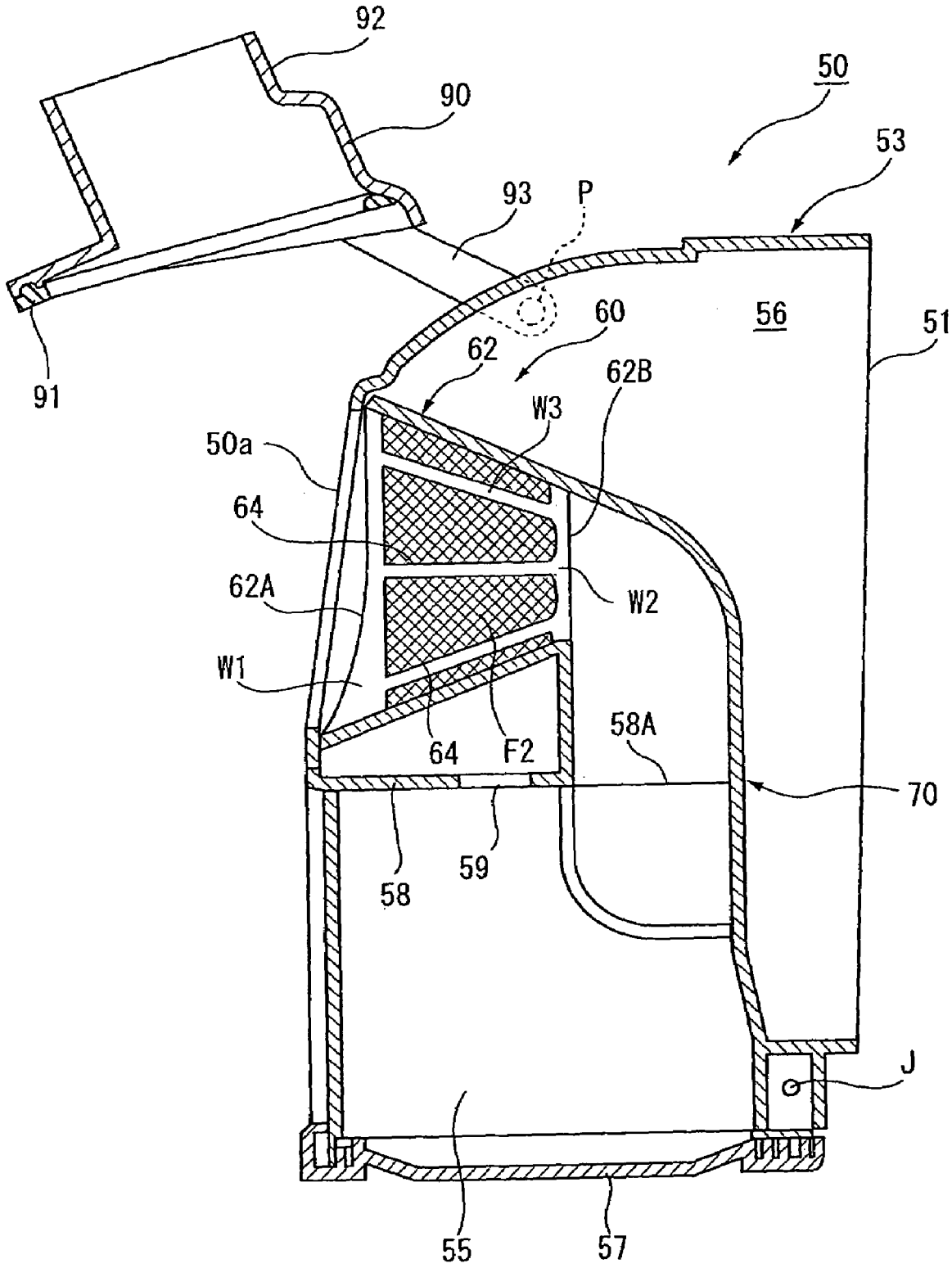
FIG. 33 is an explanatory view showing a condition that the lid body of the dust collection case in FIG. 31 is opened.
Figure 34:
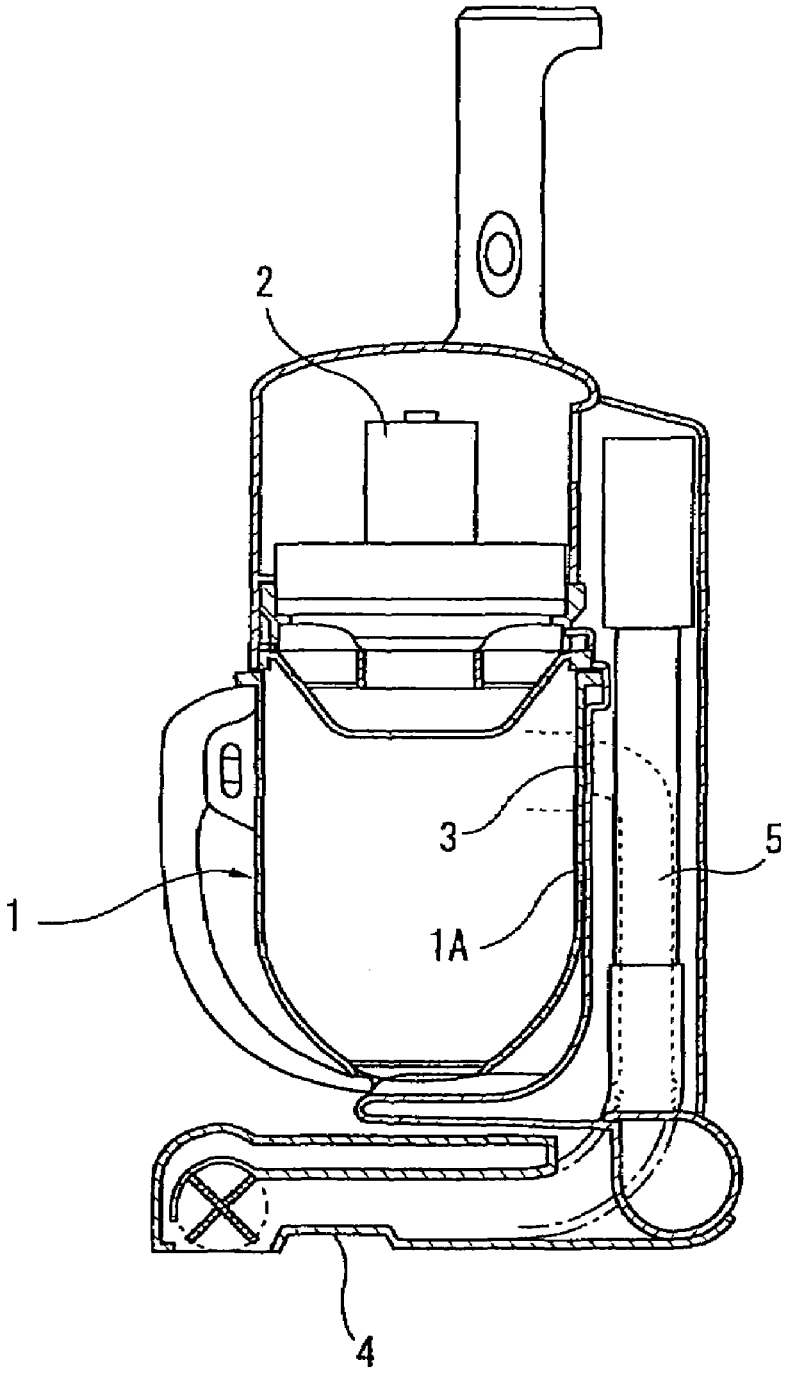
FIG. 34 is a sectional view showing one example of a conventional electric vacuum cleaner.

In addition, the opening and closing lid 90 opens the front side opening 50*a* of the case body 53 by rotating about the axis P as a center as shown in FIG. 33. In other words, the opening and closing lid 90 operates the opening and closing movement by rotating about the axis P as the center.

[Operation]

Next, an operation of the electric vacuum cleaner constituted as above will be described hereinafter.

First, as shown in FIG. 29, the dust collection case 50 is mounted on the mounting section 35 of the main body case 30 and the lid body 40 is closed, and the hose 21 is connected to the connection opening 43 of the lid body 40. When operating the switch of the control section 22A which is not shown, the motor fan 23 actuates. By the actuation of the motor fan 23, the negative pressure room section 56 of the case body 53 becomes negative pressure through the openings 34A of the main body case 30. This negative pressure acts upon the openings 64 of the tubular filter 62, the passage 61 of the tubular filter 62, the front side opening 50*a* of the case body 53, the communicating pipe 92 of the opening and closing lid 90, the connection pipe 44 of the lid body 40, the hose 21, the extension pipe 23 and the suction opening body 24, thereby the dust is sucked together with the air from the suction opening body 24.

The sucked dust and air are sucked toward the connection opening 43 of the lid body 40 through the extension pipe 23 and the hose 21. The dust and the air that are sucked to the connection opening 43 are sucked toward the passage 61 of the tubular filter 62 of the dust separation section 60 through the connection pipe 44 of the lid body 40, the communicating pipe 92 of the opening and closing lid 90 and the front side opening 50*a* of the case body 53.

When cleaning the dust attached to the net filter F2 of the dust separation section 60, first, the lid body 40 is opened as shown in FIG. 28 and the dust collection case 50 is dismounted from the mounting section 35 of the main body case 30. Then, the opening and closing lid 90 of the case body 53 of the dust collection case 50 is opened and the front side opening 50*a* of the case body 53 is opened as shown in cross-section in FIG. 33. By this opening operation, it is possible to put fingers or the like from its front side opening 50*a* so that the dust attached to the net filter F2 can be rubbed off by the fingers or the like, therefore the cleaning of the net filter F2 becomes ever so easy. Furthermore, it can be cleaned even more if the whole dust collection case 50 is wet-cleaned. Like so, the cleaning of the net filter of the dust separation section becomes very easy to be cleaned.

As described above, the electric vacuum cleaner according to the embodiment of the present invention, the dust separation section 60 is provided at the suction air passage which is leading from the suction opening (connection opening 43 or suction opening 52, suction opening 100) of the vacuum cleaner main body 20 to the intake opening (33A, 107A) of the motor fan (33, 107) to separate the dust sucked from the suction opening (connection opening 43 or suction opening 52, suction opening 100) with the air and the dust collection section (dust collection room section 55, dust collection room 104) provided at the suction air passage for collecting the dust separated from the air at the dust separation section 60.

In addition, the dust separation section 60 of this electric vacuum cleaner has the tubular passage (passage 61) which the one end communicates with the suction opening (connection opening 43 or suction opening 52, suction opening 100) so that the dust sucked from the suction opening (connection opening 43 or suction opening 52, suction opening 100) flows in and the other end communicates with the dust collection section (dust collection room section 55, dust collection room 104), and the air guiding opening (openings 64, openings 102H) provided at the peripheral wall of the tubular passage (passage 61) and is communicated with the intake opening (33A, 107A) of the motor fan (33, 107).

Generally in the conventional electric vacuum cleaner with the cyclone system, because the air swirls round and then reversed and drifted upward and sucked, the loss of air passage of the air is large (i.e., loss in an amount of air passing through is large). Also in the conventional electric vacuum cleaner with the paper package as the paper filter, when the predetermined amount of dust is accumulated in the paper package, the amount of air decreases easily. On the contrary, in the electric vacuum cleaner of the present embodiment, as the dust sucked with the air goes straight by inertia and is collected, and the air is sucked by the motor fan (33, 107) through the air guiding opening (openings 64, openings 102H), the air and the dust are separated without generating spiral flow, therefore the loss of air passage becomes less.

Also, the electric vacuum cleaner according to the embodiment of the present invention, the dust separation section 60 is provided at the suction air passage leading from the suction opening (connection opening 43 or suction opening 52, suction opening 100) of the vacuum cleaner main body 20 to the intake opening (33A, 107A) of the motor fan (33, 107) to separate the dust sucked from the suction opening (connection opening 43 or suction opening 52, suction opening 100) with the air and the dust collection section (dust collection room section 55, dust collection room 104) provided at the suction air passage for collecting the dust separated from the air at the dust separation section 60.

Moreover, the dust separation section 60 of this electric vacuum cleaner has a dust guiding duct adapted to inflow the dust sucked from the suction opening (connection opening 43 or suction opening 52, suction opening 100) from the one end and for guiding the dust flows in from the other end to the dust collection section by the inertia force, and an air guiding air passage is provided to be communicated with the midstream of the dust guiding duct and is communicated with the intake opening (64, 102H) of the motor fan (33, 107) without passing through the dust collection section.

As well as in the electric vacuum cleaner of the present embodiment, as the dust sucked with the air goes straight by inertia and is collected, and the air is sucked by the motor fan (33, 107) through the air guiding opening (openings 64, openings 102H), the air and the dust are separated without generating spiral flow, therefore the loss of air passage becomes less.

Also, the electric vacuum cleaner according to the embodiment of the present invention, the dust separation section 60 is provided at the suction air passage which is leading from the suction opening (connection opening 43 or suction opening 52, suction opening 100) of the vacuum cleaner main body 20 to the intake opening (33A, 107A) of the motor fan (33, 107) to separate the dust sucked from the suction opening (connection opening 43 or suction opening 52, suction opening 100) with the air and the dust collection section (dust collection room section 55, dust collection room 104) provided at the suction air passage for collecting the dust separated from the air at the dust separation section 60.

Moreover, the dust separation section 60 of this electric vacuum cleaner has the tubular passage (passage 61) which the one end is communicated with the suction opening (connection opening 43 or suction opening 52, suction opening 100) and adapted to flow in the dust sucked from the suction opening (connection opening 43 or suction opening 52, suction opening 100), and an air guiding air passage provided at the one end with the air guiding opening (openings 64, openings 102H) which is provided on the peripheral wall of the tubular passage (passage 61) and the other end is communicated with the intake opening (openings 64, openings 102H) of the motor fan (33, 107) without passing through the dust collection section (dust collection room section 55, dust collection room 104).

As well as in the electric vacuum cleaner of the present embodiment, as the dust sucked with the air goes straight by inertia and is collected, and the air is sucked by the motor fan (33, 107) through the air guiding opening (openings 64, openings 102H), the air and the dust are separated without generating spiral flow, therefore the loss of air passage becomes less.

Also, the electric vacuum cleaner according to the embodiment of the present invention, the dust strike section (63, 103) which is provided at the other end side of the tubular passage (passage 61) and is provided for hitting the dust that flows into the tubular passage (passage 61) and goes straight through it, and the dust collection section (dust collection room section 55, dust collection room 104) for collecting the dust being hit to the dust strike section (63, 103) is provided at a lower part of the strike section 63.

As well as in the electric vacuum cleaner of the present embodiment, as the dust sucked with the air goes straight by and is collected, and the air is sucked by the motor fan (33, 107) through the air guiding opening (openings 64, openings 102H), the air and the dust are separated without generating spiral flow, therefore the loss of air passage becomes less. Furthermore, the dust does not fly up within the dust collection section (dust collection room section 55, dust collection room 104).

Also, the air guiding opening (openings 64, 102H) of the electric vacuum cleaner according to the embodiment of the present invention is provided throughout the entire circumference of the peripheral wall of the tubular passage (passage 61).

As well as in the electric vacuum cleaner of the present embodiment, as the dust sucked with the air goes straight by the inertia and is collected, and the air is sucked by the motor fan (33, 107) through the air guiding opening (openings 64, openings 102H), the air and the dust are separated without generating spiral flow, therefore the loss of air passage becomes less.

Also, a filter is provided at the air guiding opening (openings 64, 102H) of the tubular passage (passage 61) of the electric vacuum cleaner according to embodiment of the present invention. According to this structure, because the light weighted dust (microscopic dust) does not go straight (difficult to be influenced by the inertia) to the dust strike section (strike section 63) by the inertia force caused when sucked into the tubular passage (passage 61) is sucked to the side of the motor fan 33 with the air through the air guiding opening (openings 64, openings 102H), it is possible to capture the light weighted dust at this occasion using the filter.

Also, the tubular passage (passage 61) of the electric vacuum cleaner according to the embodiment of the present invention is provided with the filter tube section (net filter F2) as a tubular shaped filter in the mesh shape which is located at the upstream side, and a tube section (frame section W2) which is continuously built to the downstream side of the filter tube section and has non-permeability. According to this structure, although the light weighted microscopic dust that is difficult to be influenced by inertia is captured by the filter tube section (net filter F2) at the upstream side, it is hard to break into the mesh of filter (net filter F2) and it is easier to be peeled off. In addition, the dust influenced by inertia hits to the non-permeability tube section (frame section W2) at the downstream side since it is easier to go straight, so the dust influenced by inertia does not clog the filter (net filter F2).

Also, the filter (net filter F2) of the electric vacuum cleaner in the embodiment of the present invention is in the mesh shape, and the opening O of the mesh shape filter (net filter F2) is formed finer as going from the upstream side to the down stream side of the tubular passage. According to this structure, because the dust is easier to go straight since the wind velocity at the upstream side is fast, the permeability is increased at the upstream side by having the opening O of the mesh shape filter (net filter F2) to be wider, therefore it is possible to increase the sucking efficiency. Furthermore, at the downstream side of the tubular passage (passage 61), because the opening O of the filter (net filter F2) is fine, the flow of air becomes smooth, therefore clogging of the filter (net filter F2) can be avoided.

Also, the filter (net filter F2) of the electric vacuum cleaner according to the embodiment of the present invention is in the mesh shape, and the surface finishing for reducing the friction resistance is applied on the filter (net filter F2). According to this structure, the dust is hard to be attached to the filter (net filter F2) since the surface finishing for reducing the friction resistance is applied on the filter (net filter F2).

Also, the diameter of the tubular passage (passage 61) of the electric vacuum cleaner according to the embodiment of the present invention is gradually decreased from the one end to the other end direction linearly. According to this structure, the air (wind) going straight becomes easier to hit equally the entire surfaces of the air guiding opening (openings 64) which is provided at the peripheral wall of the tubular passage (passage 61), therefore the dust attached to the filter (net filter F2) is easily peeled off.

Also, the diameter of the one end opening 62A of the tubular passage (passage 61) of the electric vacuum cleaner according to the embodiment of the present invention is larger than the diameter of the suction opening 52 of the vacuum cleaner main body, and the diameter of the other end opening 62B of the tubular passage is less than the diameter of the suction opening 52 of the vacuum cleaner main body. According to this structure, the air (wind) going straight becomes easier to hit equally the entire surface of the air guiding opening (openings 64) which is provided at the peripheral wall of the tubular passage (passage 61), therefore the dust attached to the filter (net filter F2) is easily be peeled off.

Also, the vacuum cleaner main body 20 of the electric vacuum cleaner according to the embodiment of the present invention is provided with the dust collection case 50 which has the dust separation section 60 and the dust collection section 60. Furthermore, the tubular passage (passage 61) of the dust separation section 60 is formed inside of the tubular filter 62 which is for separating the dust sucked from the suction opening (communicating pipe 92) of the vacuum cleaner main body 20, a diameter of a filter entrance opening of the tubular filter 62 is formed larger than the diameter of the suction opening (communicating pipe 92) of the vacuum cleaner main body 20, the case opening (front side opening 50*a*) which faces to the filter entrance opening is provided at the dust collection case 50, the opening and closing lid 90 for blocking the case opening (front side opening 50*a*) is provided capable of opening and closing, and the suction opening of the vacuum cleaner main body 20 is provided at the opening and closing lid 90.

According to this structure, the fingers or the like are difficult to put into the suction opening of the vacuum cleaner main body 20, therefore by providing the side of the suction opening as being capable of opening and closing, it is easy to carry out the cleaning since the user can easily remove the dust attached to the tubular filter 62.

Also, the dust collection case 50 of the electric vacuum cleaner according to the embodiment of the present invention is provided attachably and detachably to the vacuum cleaner main body 20. According to this structure, it is easy to carry out the cleaning since the whole dust collection case 50 can be wet-cleaned.

Also, the electric vacuum cleaner according to the embodiment of the present invention, the intake opening 33A of the motor fan 33 is provided to suck some of the air that flows into the tubular passage (air passage 61) through the dust collection section (dust collection room section 55) by communicating the dust collection section (the dust collection room section 55) with the air guiding air passage (negative pressure room section 56) and by communicating the dust collection section (dust collection room section 55) with the intake opening 33A of the motor fan 33.

According to this structure, when the filter is clogged by the attachment of the dust to the filter (net filter F2), a flowing speed of the air to the dust collection section (dust collection room section 55) becomes faster and the dust attached to the filter (net filter F2) is peeled off, therefore the clogging of the filter (net filter F2) can be solved.

Also, the electric vacuum cleaner according to the embodiment of the present invention, the ventilation opening 59 which exhausts some of the air guided from the dust strike section (strike section 63) to the dust collection section (dust collection room section 55) with the dust to the air guiding air passage (negative pressure room section 56) by communicating the dust collection section (dust collection room section 55) with the air guiding air passage (negative pressure room section 56) is provided at a wall (top panel 58) which forms and divides the dust collection section (dust collection room section 55).

According to this structure, it is possible to contribute to a downsizing of the vacuum cleaner main body 20 since it is possible to guide the remaining air that flows into the dust collection section (dust collection room section 55) to the intake opening 33A of the motor fan 33 by utilizing the air guiding air passage (negative pressure room section 56) which guides some of the air from the air guiding opening (openings 64) provided at the tubular passage (passage 61) directly to the intake opening 33A of the motor fan 33 so as to maintain a direct-advancing element.

Also, the electric vacuum cleaner according to the embodiment of the present invention, the dimension of the ventilation opening 59 of the dust collection section (dust collection room section 55) is smaller than the dimension of the air guiding opening (openings 64) of the tubular passage (passage 61). According to this structure, it is possible to increase the dust separation efficiency in the tubular passage (passage 61) by increasing the amount of air which flows from the air guiding opening (openings 64) of the tubular passage (passage 61) directly to the intake opening 33A of the motor fan 33 (i.e., maintaining a direct-advancing element) than the amount of air flowing to the dust collection section (dust collection room section 55).

Also, the electric vacuum cleaner according to the embodiment of the present invention, the first filter (net filter F2) is attached to the air guiding opening (openings 64) of the tubular passage (passage 61). According to this structure, when the first filter (net filter F2) clogs, the wind amount of air that passes through the air guiding opening (openings 64) reduces and the negative pressure at the air guiding air passage (negative pressure room section 56) increases. When the negative pressure at the air guiding air passage (negative pressure room section 56) increases, the negative pressure within the dust collection section (dust collection room section 55) becomes larger through the ventilation opening 59, and the wind velocity of air going straight of the tubular passage (passage 61) becomes faster, so that a clogged situation of the first filter (net filter F2) can be avoided since the dust attached to the first filter (net filter F2) can be peeled off, therefore it is possible to avoid the deterioration in the sucking efficiency.

Also, the electric vacuum cleaner according to the embodiment of the present invention, the dust collection section (dust collection room section 55) is provided at a down side position of the dust separation section 60, the ventilation opening 59 is provided at an upper wall (top panel 58) of the dust collection section (dust collection room section 55), and the second filter (net filter F1) is attached to the ventilation opening 59. According to this structure, as the ventilation opening 59 is provided in a vertical direction, it is possible to fall the dust attached to the second filter (net filter F1) by its own weight, therefore it is possible to remove the dust from the second filter (net filter F1) easily.

Also, the electric vacuum cleaner according to the embodiment of the present invention, the ventilation opening 59 is provided so that the air exhausted from the dust collection section (dust collection room section 55) hits the first filter (net filter F2). According to this structure, it becomes easier to peel off the dust attached to the inner surface of the first filter (net filter F2).

INDUSTRIAL APPLICABILITY

As described above, in the dust separation structure of the electric vacuum cleaner relating the present invention, it is structured that the relatively heavy dust sucked with the air is adapted to go straight by using inertia force, and separate the air from the dust which is moving straight at a part where the dust is moving forward and suck by the motor fan. The dust separation structure as such can be utilized in ordinary household-use electric vacuum cleaner (including the ones which the power is supplied by a battery or a cord), an upright type electric vacuum cleaner or a commercial-use electric vacuum cleaner or the like.

The invention claimed is:

1. An electric vacuum cleaner comprising:

a dust separation section provided at a suction air passage between a suction opening of a vacuum cleaner main body and an intake opening of a motor fan to separate dust sucked from the suction opening with air;

a dust collection section provided at the suction air passage for collecting the dust separated from the air at the dust separation section;

a tubular passage which is communicated at a first end with the suction opening to flow in the dust sucked from the suction opening;

an air guiding air passage having an air guiding opening on a peripheral wall of the tubular passage to guide air from the air guiding opening to the intake opening of the motor fan without passing through the dust collection section; and a dust strike section which is provided at a second end of the tubular passage, wherein the dust that flows into and through the tubular passage hits the dust strike section, wherein the dust collection section is provided at a lower part of the dust strike section for collecting the dust which has hit the dust strike section, and wherein a filter is provided at the air guiding opening of the tubular passage, and a diameter of the tubular passage gradually decreases linearly from the first end to the second end.

2. The electric vacuum cleaner according to claim 1, wherein the air guiding opening is provided throughout an entire circumference of the peripheral wall of the tubular passage.

3. The electric vacuum cleaner according to claim 1, wherein the tubular passage has: (i) a filter tube section which comprises a tubular shaped filter having a mesh shape and which is located at an upstream side, and (ii) a tube section which is continuously built to a downstream side of the filter tube section and which is not permeable.

4. The electric vacuum cleaner according to claim 1, wherein the filter has a mesh shape, and openings of the mesh shape filter are formed finer from an upstream side to a downstream side of the tubular passage.

5. The electric vacuum cleaner according to claim 1, wherein the filter has a mesh shape, and a surface finishing for reducing friction is applied to the filter.

6. The electric vacuum cleaner according to claim 1, wherein a diameter of the first end of the tubular passage is larger than a diameter of the suction opening of the vacuum cleaner main body, and a diameter of the second end of the tubular passage is less than the diameter of the suction opening of the vacuum cleaner main body.

7. The electric vacuum cleaner according to claim 1, wherein the vacuum cleaner main body comprises:

a dust collection case which comprises the dust separation section and the dust collection section;

a tubular filter which separates the dust sucked from the suction opening of the vacuum cleaner main body, wherein the tubular passage is formed inside of the tubular filter, and a diameter of a filter entrance opening of the tubular filter is larger than a diameter of the suction opening of the vacuum cleaner main body;

a case opening which faces the filter entrance opening, and which is provided at the dust collection case;

an opening and closing lid for opening and closing the case opening, wherein the suction opening of the vacuum cleaner main body is provided at the opening and closing lid.

8. The electric vacuum cleaner according to claim 7, wherein said the dust collection case is provided detachably attached to the vacuum cleaner main body.

9. The electric vacuum cleaner according to claim 1, wherein the intake opening of the motor fan sucks some of the air that flows into the tubular passage through the dust collection section by communicating the dust collection section with the air guiding air passage so as to communicate the dust collection section with the intake opening of the motor fan.

10. The electric vacuum cleaner according to claim 9, further comprising:

a ventilation opening which is provided at a wall which forms and divides the dust collection section, wherein the ventilation opening exhausts some of the air guided from the dust strike section to the dust collection section with the dust to the air guiding air passage by communicating the dust collection section with the air guiding air passage.

11. The electric vacuum cleaner according to claim 10, wherein a dimension of the ventilation opening of the dust collection section is smaller than a dimension of the air guiding opening of the tubular passage.

12. The electric vacuum cleaner according to claim 10, wherein:

the dust collection section is provided at a lower side position of the dust separation section;

the ventilation opening is provided at an upper wall of the dust collection section; and a second filter is attached to the ventilation opening.

13. The electric vacuum cleaner according to claim 10, wherein the ventilation opening is provided substantially directly underneath the filter which is provided at the air guiding opening of the tubular passage so that the air that exhausts from the dust collection section hits the filter.

* * * * *